US009248457B2

(12) United States Patent
Hanson et al.

(10) Patent No.: US 9,248,457 B2
(45) **Date of Patent: *Feb. 2, 2016**

(54) SYSTEMS AND METHODS FOR DISPENSING TEXTURE MATERIAL USING DUAL FLOW ADJUSTMENT

(75) Inventors: Randal W. Hanson, Bellingham, WA (US); Darrel Vander Griend, Everson, WA (US); Jason Morris, Bellingham, WA (US); Gary Hardwick, Bellingham, WA (US); John Kordosh, Simi Valley, CA (US)

(73) Assignee: Homax Products, Inc., Bellingham, WA (US)

( * ) Notice: Subject to any disclaimer, the term of this patent is extended or adjusted under 35 U.S.C. 154(b) by 586 days.

This patent is subject to a terminal disclaimer.

(21) Appl. No.: 13/560,949

(22) Filed: Jul. 27, 2012

(65) Prior Publication Data

US 2013/0026253 A1 Jan. 31, 2013

Related U.S. Application Data

(60) Provisional application No. 61/513,401, filed on Jul. 29, 2011, provisional application No. 61/664,678, filed on Jun. 26, 2012.

(51) Int. Cl.
*B05B 1/30* (2006.01)
*B05B 1/32* (2006.01)
(Continued)

(52) U.S. Cl.
CPC ..... *B05B 1/30* (2013.01); *B05B 1/3013* (2013.01); *B05B 1/3026* (2013.01); *B65D 83/206* (2013.01); *B65D 83/752* (2013.01)

(58) Field of Classification Search
CPC ..... B05B 1/30; B05B 1/3013; B05B 1/3026; B05B 1/3033; B05B 1/304; B05B 1/32; B05B 1/326; B65D 83/206; B65D 83/28; B65D 83/44; B65D 83/48
See application file for complete search history.

(56) References Cited

U.S. PATENT DOCUMENTS 208,330 A 9/1878 Palmer
351,968 A 11/1886 Derrick
(Continued)

FOREIGN PATENT DOCUMENTS

CA 770467 10/1967
CA 976125 10/1975
(Continued)

OTHER PUBLICATIONS

Chinese document disclosing a trigger spray assembly for a spray bottle; 2004; 1 page.
(Continued)

*Primary Examiner* — Darren W Gorman
(74) *Attorney, Agent, or Firm* — Michael R. Schacht

(57) ABSTRACT

An aerosol dispenser for dispensing stored material in a spray comprises a container, a conduit, and first and second adjustment systems. The container defines a chamber containing the stored material and pressurized material. The conduit defines a conduit passageway having a conduit inlet and a conduit outlet. The conduit inlet is arranged within the chamber and the conduit outlet is arranged outside of the chamber. The first adjustment system is arranged to vary a flow of stored material along the conduit passageway and is arranged between the conduit inlet and the conduit outlet. The second adjustment system arranged to vary a flow of stored material along the conduit passageway and is arranged between the first adjustment system and the conduit outlet.

40 Claims, 32 Drawing Sheets

(51) Int. Cl.

| | |
|---|---|
| ***B65D 83/20*** | (2006.01) |
| ***B65D 83/28*** | (2006.01) |
| ***B65D 83/44*** | (2006.01) |
| ***B65D 83/14*** | (2006.01) |

(56) References Cited

U.S. PATENT DOCUMENTS

| | | | | |
|---|---|---|---|---|
| D25,916 | S | | 8/1896 | Woods |
| 568,876 | A | | 10/1896 | Regan |
| 579,418 | A | | 3/1897 | Bookwalter |
| 582,397 | A | | 5/1897 | Shone |
| 604,151 | A | | 5/1898 | Horn |
| 625,594 | A | | 5/1899 | Oldham |
| 658,586 | A | | 9/1900 | Reiling |
| 930,095 | A | | 8/1909 | Seagrave |
| 931,757 | A | | 8/1909 | Harmer |
| 941,671 | A | | 11/1909 | Campbell |
| 1,093,907 | A | | 4/1914 | Birnbaum |
| 1,154,974 | A | | 9/1915 | Custer |
| 1,162,170 | A | | 11/1915 | Johnson |
| 1,294,190 | A | | 2/1919 | Sturcke |
| 1,332,544 | A | | 3/1920 | Davis |
| 1,486,156 | A | | 3/1924 | Needham |
| 1,590,430 | A | | 6/1926 | Erby |
| 1,609,465 | A | | 12/1926 | Day |
| 1,643,969 | A | | 10/1927 | Tittemore et al. |
| 1,650,686 | A | | 11/1927 | Binks |
| 1,656,132 | A | | 1/1928 | Arrasmith et al. |
| 1,674,510 | A | | 6/1928 | Hagman |
| 1,755,329 | A | | 4/1930 | McCormack |
| 1,770,011 | A | | 7/1930 | Poston |
| 1,809,073 | A | | 6/1931 | Schylander |
| 1,863,924 | A | | 6/1932 | Dunn |
| 1,988,017 | A | | 1/1935 | Norwick |
| 2,127,188 | A | | 8/1938 | Schellin et al. |
| 2,149,930 | A | | 3/1939 | Plastaras |
| 2,197,052 | A | | 4/1940 | Lowen |
| 2,198,271 | A | | 4/1940 | McCallum |
| D134,562 | S | | 7/1942 | Murphy |
| 2,305,269 | A | | 12/1942 | Moreland |
| 2,307,014 | A | | 1/1943 | Becker et al. |
| 2,320,964 | A | | 6/1943 | Yates |
| 2,353,318 | A | | 7/1944 | Scheller |
| 2,361,407 | A | | 10/1944 | McNair |
| 2,388,093 | A | | 10/1945 | Smith |
| 2,530,808 | A | | 11/1950 | Cerasi |
| 2,565,954 | A | | 8/1951 | Dey |
| 2,612,293 | A | | 9/1952 | Michel |
| 2,686,652 | A | | 8/1954 | Carlson et al. |
| 2,704,690 | A | | 3/1955 | Eichenauer |
| 2,723,200 | A | | 11/1955 | Pyenson |
| 2,763,406 | A | | 9/1956 | Countryman |
| 2,764,454 | A | | 9/1956 | Edelstein |
| 2,785,926 | A | | 3/1957 | Lataste |
| 2,790,680 | A | | 4/1957 | Rosholt |
| 2,801,880 | A | | 8/1957 | Rienecker |
| 2,831,618 | A | | 4/1958 | Soffer et al. |
| 2,839,225 | A | | 6/1958 | Soffer et al. |
| 2,887,274 | A | | 5/1959 | Swenson |
| 2,908,446 | A | | 10/1959 | Strouse |
| 2,923,481 | A | | 2/1960 | Pinke |
| 2,932,434 | A | | 4/1960 | Abplanalp |
| 2,962,743 | A | | 12/1960 | Henriksson |
| 2,965,270 | A | | 12/1960 | Soffer et al. |
| 2,968,441 | A | | 1/1961 | Holcomb |
| 2,976,897 | A | | 3/1961 | Beckworth |
| 2,997,243 | A | | 8/1961 | Kolb |
| 2,999,646 | A | | 9/1961 | Wagner |
| 3,016,561 | A | | 1/1962 | Hulsh |
| 3,027,096 | A | | 3/1962 | Giordano |
| 3,032,803 | A | | 5/1962 | Walshauser |
| 3,061,203 | A | * | 10/1962 | Kitabayashi ..... 239/337 |
| 3,072,953 | A | | 1/1963 | Bunke |
| 3,083,872 | A | | 4/1963 | Meshberg |
| 3,107,059 | A | | 10/1963 | Frechette |
| 3,116,879 | A | | 1/1964 | Wagner |
| 3,121,906 | A | | 2/1964 | Hulsh |
| 3,135,007 | A | | 6/1964 | Howell |
| 3,157,360 | A | | 11/1964 | Heard |
| 3,167,525 | A | | 1/1965 | Thomas |
| 3,191,809 | A | | 6/1965 | Schultz et al. |
| 3,196,819 | A | | 7/1965 | Lechner et al. |
| 3,198,394 | A | | 8/1965 | Lefer |
| 3,207,444 | A | | 9/1965 | Kelley et al. |
| 3,216,628 | A | | 11/1965 | Fergusson |
| 3,236,459 | A | | 2/1966 | McRitchie |
| 3,246,850 | A | | 4/1966 | Bourke |
| 3,258,208 | A | | 6/1966 | Greenebaum, II |
| 3,271,810 | A | | 9/1966 | Raffe |
| 3,284,007 | A | | 11/1966 | Clapp |
| 3,307,788 | A | | 3/1967 | Ingram |
| 3,314,571 | A | | 4/1967 | Greenebaum, II |
| 3,317,140 | A | | 5/1967 | Smith |
| 3,342,382 | A | | 9/1967 | Huling |
| 3,346,195 | A | | 10/1967 | Groth |
| 3,373,908 | A | | 3/1968 | Crowell |
| 3,377,028 | A | | 4/1968 | Bruggeman |
| 3,390,121 | A | | 6/1968 | Burford |
| 3,405,845 | A | | 10/1968 | Cook et al. |
| 3,414,171 | A | | 12/1968 | Grisham et al. |
| 3,415,425 | A | | 12/1968 | Knight et al. |
| 3,425,600 | A | | 2/1969 | Abplanalp |
| 3,428,224 | A | | 2/1969 | Eberhardt et al. |
| 3,433,391 | A | | 3/1969 | Krizka et al. |
| 3,445,068 | A | | 5/1969 | Wagner |
| 3,450,314 | A | | 6/1969 | Gross |
| 3,467,283 | A | | 9/1969 | Kinnavy |
| 3,472,457 | A | | 10/1969 | McAvoy |
| 3,482,738 | A | | 12/1969 | Bartels |
| 3,491,951 | A | | 1/1970 | Knibb |
| 3,498,541 | A | | 3/1970 | Taylor, Jr. et al. |
| 3,513,886 | A | | 5/1970 | Easter et al. |
| 3,514,042 | A | | 5/1970 | Freed |
| 3,544,258 | A | | 12/1970 | Presant et al. |
| 3,548,564 | A | | 12/1970 | Bruce et al. |
| 3,550,861 | A | | 12/1970 | Teson |
| 3,575,319 | A | | 4/1971 | Safianoff |
| 3,592,359 | A | | 7/1971 | Marraffino |
| 3,596,835 | A | | 8/1971 | Smith |
| 3,608,822 | A | | 9/1971 | Berthoud |
| 3,613,954 | A | | 10/1971 | Bayne |
| 3,647,143 | A | | 3/1972 | Gauthier et al. |
| 3,648,932 | A | | 3/1972 | Ewald et al. |
| 3,653,558 | A | | 4/1972 | Shay |
| 3,680,789 | A | | 8/1972 | Wagner |
| 3,698,645 | A | | 10/1972 | Coffey |
| 3,700,136 | A | | 10/1972 | Ruekberg |
| 3,703,994 | A | | 11/1972 | Nigro |
| 3,704,811 | A | | 12/1972 | Harden, Jr. |
| 3,704,831 | A | | 12/1972 | Clark |
| 3,705,669 | A | | 12/1972 | Cox et al. |
| 3,711,030 | A | | 1/1973 | Jones |
| 3,756,732 | A | | 9/1973 | Stoffler |
| 3,764,067 | A | | 10/1973 | Coffey et al. |
| 3,770,166 | A | | 11/1973 | Marand |
| 3,773,706 | A | | 11/1973 | Dunn, Jr. |
| 3,776,470 | A | | 12/1973 | Tsuchiya |
| 3,776,702 | A | | 12/1973 | Chant |
| 3,777,981 | A | | 12/1973 | Probst et al. |
| 3,788,521 | A | | 1/1974 | Laauwe |
| 3,788,526 | A | | 1/1974 | Thornton et al. |
| 3,795,366 | A | | 3/1974 | McGhie et al. |
| 3,797,946 | A | | 3/1974 | Witzmann et al. |
| 3,799,398 | A | | 3/1974 | Morane et al. |
| 3,806,005 | A | | 4/1974 | Prussin et al. |
| 3,811,369 | A | | 5/1974 | Ruegg |
| 3,813,011 | A | | 5/1974 | Harrison et al. |
| 3,814,326 | A | | 6/1974 | Bartlett |
| 3,819,119 | A | | 6/1974 | Coffey et al. |
| 3,828,977 | A | | 8/1974 | Borchert |
| 3,848,778 | A | | 11/1974 | Meshberg |
| 3,848,808 | A | | 11/1974 | Fetty et al. |
| 3,862,705 | A | | 1/1975 | Beres et al. |
| 3,871,553 | A | | 3/1975 | Steinberg |

(56) References Cited

U.S. PATENT DOCUMENTS 3,876,154 A 4/1975 Griebel
3,891,128 A 6/1975 Smrt
3,899,134 A 8/1975 Wagner
3,912,132 A 10/1975 Stevens
3,913,803 A 10/1975 Laauwe
3,913,804 A 10/1975 Laauwe
3,913,842 A 10/1975 Singer
D237,796 S 11/1975 Wagner
3,932,973 A 1/1976 Moore
3,936,002 A 2/1976 Geberth, Jr.
3,938,708 A 2/1976 Burger
3,945,571 A 3/1976 Rash
3,961,756 A * 6/1976 Martini ..... 239/337
3,975,554 A 8/1976 Kummins et al.
3,982,698 A 9/1976 Anderson
3,987,811 A 10/1976 Finger
3,989,165 A 11/1976 Shaw et al.
3,991,916 A 11/1976 Del Bon
3,992,003 A 11/1976 Visceglia et al.
4,010,134 A 3/1977 Braunisch et al.
4,032,064 A 6/1977 Giggard
4,036,438 A 7/1977 Soderlind et al.
4,036,673 A 7/1977 Murphy et al.
4,045,860 A 9/1977 Winckler
4,058,287 A 11/1977 Fromfield
4,078,578 A 3/1978 Buchholz
4,089,443 A 5/1978 Zrinyi
4,096,974 A 6/1978 Haber et al.
4,117,951 A 10/1978 Winckler
4,123,005 A 10/1978 Blunk
4,129,448 A 12/1978 Greenfield et al.
4,147,284 A 4/1979 Mizzi
4,148,416 A 4/1979 Gunn-Smith
4,154,378 A 5/1979 Paoletti et al.
4,159,079 A 6/1979 Phillips, Jr.
4,164,492 A 8/1979 Cooper
RE30,093 E 9/1979 Burger
4,171,757 A 10/1979 Diamond
4,173,558 A 11/1979 Beck
4,185,758 A 1/1980 Giggard
4,187,959 A 2/1980 Pelton
4,187,985 A 2/1980 Goth
4,195,780 A 4/1980 Inglis
4,198,365 A 4/1980 Pelton
4,202,470 A 5/1980 Fujii
4,204,645 A 5/1980 Hopp
4,232,828 A 11/1980 Shelly, Jr.
4,238,264 A 12/1980 Pelton
4,240,940 A 12/1980 Vasishth et al.
4,258,141 A 3/1981 Jarre et al.
4,275,172 A 6/1981 Barth et al.
4,293,353 A 10/1981 Pelton et al.
4,308,973 A 1/1982 Irland
4,310,108 A 1/1982 Motoyama et al.
4,322,020 A 3/1982 Stone
4,346,743 A 8/1982 Miller
4,354,638 A 10/1982 Weinstein
4,358,388 A 11/1982 Daniel et al.
4,364,521 A 12/1982 Stankowitz
4,370,930 A 2/1983 Strasser et al.
4,372,475 A 2/1983 Goforth et al.
4,401,271 A 8/1983 Hansen
4,401,272 A 8/1983 Merton et al.
4,411,387 A 10/1983 Stern et al.
4,417,674 A 11/1983 Giuffredi
4,434,939 A 3/1984 Stankowitz
4,438,221 A 3/1984 Fracalossi et al.
4,438,884 A 3/1984 O'Brien et al.
4,442,959 A 4/1984 Del Bon et al.
4,460,719 A 7/1984 Danville
4,482,662 A 11/1984 Rapaport et al.
4,496,081 A 1/1985 Farrey
4,546,905 A 10/1985 Nandagiri et al.
4,595,127 A 6/1986 Stoody
4,609,608 A 9/1986 Solc
4,620,669 A 11/1986 Polk
4,641,765 A 2/1987 Diamond
4,674,903 A 6/1987 Chen
4,683,246 A 7/1987 Davis et al.
4,685,622 A 8/1987 Shimohira et al.
4,702,400 A 10/1987 Corbett
4,706,888 A 11/1987 Dobbs
4,728,007 A 3/1988 Samuelson et al.
4,744,495 A 5/1988 Warby
4,744,516 A 5/1988 Peterson et al.
4,761,312 A 8/1988 Koshi et al.
4,792,062 A 12/1988 Goncalves
4,793,162 A 12/1988 Emmons
4,804,144 A 2/1989 Denman
4,815,414 A 3/1989 Duffy et al.
4,819,838 A 4/1989 Hart, Jr.
4,830,224 A 5/1989 Brison
4,839,393 A 6/1989 Buchanan et al.
4,850,387 A 7/1989 Bassill
4,854,482 A 8/1989 Bergner
4,863,104 A 9/1989 Masterson
4,870,805 A 10/1989 Morane
4,878,599 A 11/1989 Greenway
4,887,651 A 12/1989 Santiago
4,893,730 A 1/1990 Bolduc
4,896,832 A 1/1990 Howlett
D307,649 S 5/1990 Henry
RE33,235 E 6/1990 Corsette
4,940,171 A 7/1990 Gilroy
4,948,054 A 8/1990 Mills
4,949,871 A 8/1990 Flanner
4,951,876 A 8/1990 Mills
4,953,759 A 9/1990 Schmidt
4,954,544 A 9/1990 Chandaria
4,955,545 A 9/1990 Stern et al.
4,961,537 A 10/1990 Stern
4,969,577 A 11/1990 Werding
4,969,579 A 11/1990 Behar
4,988,017 A 1/1991 Schrader et al.
4,989,787 A 2/1991 Nikkel et al.
4,991,750 A 2/1991 Moral
5,007,556 A 4/1991 Lover
5,009,390 A 4/1991 McAuliffe, Jr. et al.
5,037,011 A 8/1991 Woods
5,038,964 A 8/1991 Bouix
5,039,017 A 8/1991 Howe
5,052,585 A 10/1991 Bolduc
5,059,187 A 10/1991 Sperry et al.
5,065,900 A 11/1991 Scheindel
5,069,390 A 12/1991 Stern et al.
5,083,685 A 1/1992 Amemiya et al.
5,100,055 A 3/1992 Rokitenetz et al.
5,115,944 A 5/1992 Nikolich
5,126,086 A 6/1992 Stoffel
5,150,880 A 9/1992 Austin, Jr. et al.
5,169,037 A 12/1992 Davies et al.
5,182,316 A 1/1993 DeVoe et al.
5,188,263 A 2/1993 Woods
5,188,295 A 2/1993 Stern et al.
5,211,317 A 5/1993 Diamond et al.
5,219,609 A 6/1993 Owens
5,232,161 A 8/1993 Clemmons
5,250,599 A 10/1993 Swartz
5,255,846 A 10/1993 Ortega
5,277,336 A 1/1994 Youel
5,288,024 A 2/1994 Vitale
5,297,704 A 3/1994 Stollmeyer
5,307,964 A 5/1994 Toth
5,310,095 A 5/1994 Stern et al.
5,312,888 A 5/1994 Nafziger et al.
5,314,097 A 5/1994 Smrt et al.
5,323,963 A 6/1994 Ballu
5,341,970 A 8/1994 Woods
5,342,597 A 8/1994 Tunison, III
5,360,127 A 11/1994 Barriac et al.
5,368,207 A 11/1994 Cruysberghs
5,374,434 A 12/1994 Clapp et al.
5,405,051 A 4/1995 Miskell
5,409,148 A 4/1995 Stern et al.

(56) References Cited

U.S. PATENT DOCUMENTS 5,415,351 A 5/1995 Otto et al.
5,417,357 A 5/1995 Yquel
D358,989 S 6/1995 Woods
5,421,519 A 6/1995 Woods
5,425,824 A 6/1995 Marwick
5,443,211 A 8/1995 Young et al.
5,450,983 A 9/1995 Stern et al.
5,467,902 A 11/1995 Yquel
5,476,879 A 12/1995 Woods et al.
5,489,048 A 2/1996 Stern et al.
5,498,282 A 3/1996 Miller et al.
5,501,375 A 3/1996 Nilson
5,505,344 A 4/1996 Woods
5,523,798 A 6/1996 Hagino et al.
5,524,798 A 6/1996 Stern et al.
5,544,783 A 8/1996 Conigliaro
5,548,010 A 8/1996 Franer
5,549,228 A 8/1996 Brown
5,558,247 A 9/1996 Caso
5,562,235 A 10/1996 Cruysberghs
5,570,813 A 11/1996 Clark, II
5,573,137 A 11/1996 Pauls
5,577,851 A 11/1996 Koptis
5,583,178 A 12/1996 Oxman et al.
5,597,095 A 1/1997 Ferrara, Jr.
5,615,804 A 4/1997 Brown
5,638,990 A 6/1997 Kastberg
5,639,026 A 6/1997 Woods
5,641,095 A 6/1997 de Laforcade
5,645,198 A 7/1997 Stern et al.
5,655,691 A 8/1997 Stern et al.
5,695,788 A 12/1997 Woods
5,715,975 A 2/1998 Stern et al.
5,727,736 A 3/1998 Tryon
5,752,631 A 5/1998 Yabuno et al.
5,775,432 A 7/1998 Burns et al.
5,792,465 A 8/1998 Hagarty
5,799,879 A 9/1998 Ottl et al.
5,865,351 A 2/1999 De Laforcade
5,868,286 A 2/1999 Mascitelli
5,887,756 A 3/1999 Brown
5,894,964 A 4/1999 Barnes et al.
D409,487 S 5/1999 Wadsworth et al.
D409,917 S 5/1999 Wadsworth et al.
D409,918 S 5/1999 Wadsworth et al.
5,915,598 A 6/1999 Yazawa et al.
5,921,446 A 7/1999 Stern
5,934,518 A 8/1999 Stern et al.
5,941,462 A 8/1999 Sandor
5,957,333 A 9/1999 Losenno et al.
5,975,356 A 11/1999 Yquel et al.
5,979,797 A 11/1999 Castellano
5,988,575 A 11/1999 Lesko
5,988,923 A 11/1999 Arai
6,000,583 A 12/1999 Stern et al.
6,027,042 A 2/2000 Smith
6,032,830 A 3/2000 Brown
6,039,306 A 3/2000 Pericard et al.
6,062,494 A 5/2000 Mills
6,070,770 A 6/2000 Tada et al.
6,092,698 A 7/2000 Bayer
6,095,377 A 8/2000 Sweeton et al.
6,095,435 A 8/2000 Greer, Jr. et al.
6,112,945 A 9/2000 Woods
6,113,070 A 9/2000 Holzboog
6,116,473 A 9/2000 Stern et al.
6,126,090 A 10/2000 Wadsworth et al.
6,129,247 A 10/2000 Thomas et al.
6,131,777 A 10/2000 Warby
6,131,820 A 10/2000 Dodd
6,139,821 A 10/2000 Fuerst et al.
6,152,335 A 11/2000 Stern et al.
6,161,735 A 12/2000 Uchiyama et al.
6,168,093 B1 1/2001 Greer, Jr. et al.
6,170,717 B1 1/2001 Di Giovanni et al.
D438,111 S 2/2001 Woods
D438,786 S 3/2001 Ghali
6,225,393 B1 5/2001 Woods
6,227,411 B1 5/2001 Good
6,254,015 B1 7/2001 Abplanalp
6,257,503 B1 7/2001 Baudin
6,261,631 B1 7/2001 Lomasney et al.
6,265,459 B1 7/2001 Mahoney et al.
6,276,570 B1 8/2001 Stern et al.
6,283,171 B1 9/2001 Blake
6,290,104 B1 9/2001 Bougamont et al.
6,296,155 B1 10/2001 Smith
6,296,156 B1 10/2001 Lasserre et al.
6,299,679 B1 10/2001 Montoya
6,299,686 B1 10/2001 Mills
6,315,152 B1 11/2001 Kalisz
6,325,256 B1 12/2001 Liljeqvist et al.
6,328,185 B1 12/2001 Stern et al.
6,328,197 B1 12/2001 Gapihan
6,334,727 B1 1/2002 Gueret
6,352,184 B1 3/2002 Stern et al.
6,362,302 B1 3/2002 Boddie
6,375,036 B1 4/2002 Woods
6,382,474 B1 5/2002 Woods et al.
6,386,402 B1 5/2002 Woods
6,394,321 B1 5/2002 Bayer
6,394,364 B1 5/2002 Abplanalp
6,395,794 B2 5/2002 Lucas et al.
6,398,082 B2 6/2002 Clark et al.
6,399,687 B2 6/2002 Woods
6,415,964 B2 7/2002 Woods
6,439,430 B1 8/2002 Gilroy, Sr. et al.
6,446,842 B2 9/2002 Stern et al.
D464,395 S 10/2002 Huang
6,474,513 B2 11/2002 Burt
6,478,198 B2 11/2002 Haroian
6,478,561 B2 11/2002 Braun et al.
6,482,392 B1 11/2002 Zhou et al.
6,510,969 B2 1/2003 Di Giovanni et al.
6,520,377 B2 2/2003 Yquel
6,531,528 B1 3/2003 Kurp
6,536,633 B2 3/2003 Stern et al.
6,581,807 B1 6/2003 Mekata
6,588,628 B2 7/2003 Abplanalp et al.
6,595,393 B1 7/2003 Loghman-Adham et al.
6,615,827 B2 9/2003 Greenwood et al.
6,637,627 B1 10/2003 Liljeqvist et al.
6,641,005 B1 11/2003 Stern et al.
6,641,864 B2 11/2003 Woods
6,652,704 B2 11/2003 Green
6,659,312 B1 12/2003 Stern et al.
6,666,352 B1 12/2003 Woods
6,688,492 B2 2/2004 Jaworski et al.
6,712,238 B1 3/2004 Mills
6,726,066 B2 4/2004 Woods
6,736,288 B1 5/2004 Green
6,758,373 B2 7/2004 Jackson et al.
6,797,051 B2 9/2004 Woods
6,802,461 B2 10/2004 Schneider
6,831,110 B2 12/2004 Ingold et al.
6,832,704 B2 12/2004 Smith
6,837,396 B2 1/2005 Jaworski et al.
6,843,392 B1 1/2005 Walker
D501,538 S 2/2005 Zeng
D501,914 S 2/2005 Chen
6,848,601 B2 2/2005 Greer, Jr.
6,851,575 B2 2/2005 van't Hoff
D502,533 S 3/2005 Chen
6,880,733 B2 4/2005 Park
6,883,688 B1 4/2005 Stern et al.
6,894,095 B2 5/2005 Russo et al.
6,905,050 B1 6/2005 Stern et al.
6,910,608 B2 6/2005 Greer, Jr. et al.
6,913,407 B2 7/2005 Greer et al.
6,926,178 B1 8/2005 Anderson
6,929,154 B2 8/2005 Grey et al.
6,932,244 B2 8/2005 Meshberg
6,966,467 B2 11/2005 Di Giovanni et al.
D512,309 S 12/2005 Geier

(56) References Cited

U.S. PATENT DOCUMENTS

| | | | |
|---|---|---|---|
| 6,971,353 | B2 | 12/2005 | Heinze et al. |
| 6,971,553 | B2 | 12/2005 | Brennan et al. |
| 6,978,916 | B2 | 12/2005 | Smith |
| 6,978,947 | B2 | 12/2005 | Jin |
| 6,981,616 | B2 | 1/2006 | Loghman-Adham et al. |
| 7,014,073 | B1 | 3/2006 | Stern et al. |
| 7,014,127 | B2 | 3/2006 | Valpey, III et al. |
| 7,036,685 | B1 | 5/2006 | Green |
| 7,059,497 | B2 | 6/2006 | Woods |
| 7,059,546 | B2 | 6/2006 | Ogata et al. |
| 7,063,236 | B2 | 6/2006 | Greer, Jr. et al. |
| 7,104,424 | B2 | 9/2006 | Kolanus |
| 7,104,427 | B2 | 9/2006 | Pericard et al. |
| 7,121,434 | B1 | 10/2006 | Caruso |
| 7,163,962 | B2 | 1/2007 | Woods |
| 7,182,227 | B2 | 2/2007 | Poile et al. |
| 7,189,022 | B1 | 3/2007 | Greer, Jr. et al. |
| 7,192,985 | B2 | 3/2007 | Woods |
| 7,204,393 | B2 | 4/2007 | Strand |
| 7,226,001 | B1 | 6/2007 | Stern et al. |
| 7,226,232 | B2 | 6/2007 | Greer, Jr. et al. |
| 7,232,047 | B2 | 6/2007 | Greer, Jr. et al. |
| 7,237,697 | B2 | 7/2007 | Dunne |
| 7,240,857 | B1 | 7/2007 | Stern et al. |
| 7,249,692 | B2 | 7/2007 | Walters et al. |
| 7,261,225 | B2 | 8/2007 | Rueschhoff et al. |
| 7,267,248 | B2 | 9/2007 | Yerby et al. |
| 7,278,590 | B1 | 10/2007 | Greer, Jr. et al. |
| 7,303,152 | B2 | 12/2007 | Woods |
| 7,307,053 | B2 | 12/2007 | Tasz et al. |
| 7,337,985 | B1 | 3/2008 | Greer, Jr. et al. |
| 7,341,169 | B2 | 3/2008 | Bayer |
| 7,350,676 | B2 | 4/2008 | Di Giovanni et al. |
| 7,374,068 | B2 | 5/2008 | Greer, Jr. |
| 7,383,968 | B2 | 6/2008 | Greer, Jr. et al. |
| 7,383,970 | B2 | 6/2008 | Anderson |
| 7,445,166 | B2 | 11/2008 | Williams |
| 7,448,517 | B2 | 11/2008 | Shieh et al. |
| 7,481,338 | B1 | 1/2009 | Stern et al. |
| 7,487,891 | B2 | 2/2009 | Yerby et al. |
| 7,487,893 | B1 | 2/2009 | Greer, Jr. et al. |
| 7,494,075 | B2 | 2/2009 | Schneider |
| 7,500,621 | B2 | 3/2009 | Tryon et al. |
| 7,510,102 | B2 | 3/2009 | Schmitt |
| 7,556,841 | B2 | 7/2009 | Kimball et al. |
| D600,119 | S | 9/2009 | Sweeton |
| 7,588,171 | B2 | 9/2009 | Reedy et al. |
| 7,597,274 | B1 | 10/2009 | Stern et al. |
| 7,600,659 | B1 | 10/2009 | Greer, Jr. et al. |
| 7,624,932 | B1 | 12/2009 | Greer, Jr. et al. |
| 7,631,785 | B2 | 12/2009 | Paas et al. |
| 7,641,079 | B2 | 1/2010 | Lott et al. |
| 7,673,816 | B1 | 3/2010 | Stern et al. |
| 7,677,420 | B1 | 3/2010 | Greer, Jr. et al. |
| 7,699,190 | B2 | 4/2010 | Hygema |
| 7,721,920 | B2 | 5/2010 | Ruiz De Gopegui et al. |
| 7,744,299 | B1 | 6/2010 | Greer, Jr. et al. |
| 7,748,572 | B2 | 7/2010 | Althoff et al. |
| 7,757,905 | B2 | 7/2010 | Strand et al. |
| 7,766,196 | B2 | 8/2010 | Sugano et al. |
| 7,775,408 | B2 | 8/2010 | Yamamoto et al. |
| 7,784,647 | B2 | 8/2010 | Tourigny |
| 7,784,649 | B2 | 8/2010 | Greer, Jr. |
| 7,789,278 | B2 | 9/2010 | Ruiz de Gopegui et al. |
| 7,845,523 | B1 | 12/2010 | Greer, Jr. et al. |
| 7,854,356 | B2 | 12/2010 | Eberhardt |
| 7,886,995 | B2 | 2/2011 | Togashi |
| 7,891,529 | B2 | 2/2011 | Paas et al. |
| 7,913,877 | B2 | 3/2011 | Neuhalfen |
| 7,922,041 | B2 | 4/2011 | Gurrisi et al. |
| 7,926,741 | B2 | 4/2011 | Laidler et al. |
| 7,947,753 | B2 | 5/2011 | Greer, Jr. |
| 7,980,487 | B2 | 7/2011 | Mirazita et al. |
| 7,984,827 | B2 | 7/2011 | Hygema |
| 7,984,834 | B2 | 7/2011 | McBroom et al. |
| 8,128,008 | B2 | 3/2012 | Chevalier |
| 8,328,053 | B2 | 12/2012 | Bargo |
| 8,328,120 | B2 | 12/2012 | Vanblaere et al. |
| 8,356,734 | B2 | 1/2013 | Oshimo et al. |
| 8,360,280 | B2 | 1/2013 | Tournier |
| 8,371,481 | B2 | 2/2013 | Kopp |
| 8,840,038 | B2 | 9/2014 | Lehr |
| 2001/0002676 | A1 | 6/2001 | Woods |
| 2002/0003147 | A1 | 1/2002 | Corba |
| 2002/0100769 | A1 | 8/2002 | McKune |
| 2002/0119256 | A1 | 8/2002 | Woods |
| 2003/0102328 | A1 | 6/2003 | Abplanalp et al. |
| 2003/0134973 | A1 | 7/2003 | Chen et al. |
| 2003/0183651 | A1 | 10/2003 | Greer, Jr. |
| 2003/0205580 | A1 | 11/2003 | Yahav |
| 2004/0012622 | A1 | 1/2004 | Russo et al. |
| 2004/0099697 | A1 | 5/2004 | Woods |
| 2004/0141797 | A1 | 7/2004 | Garabedian et al. |
| 2004/0157960 | A1 | 8/2004 | Rowe |
| 2004/0195277 | A1 | 10/2004 | Woods |
| 2005/0121474 | A1 | 6/2005 | Lasserre et al. |
| 2005/0161531 | A1 | 7/2005 | Greer, Jr. et al. |
| 2005/0236436 | A1 | 10/2005 | Woods |
| 2005/0256257 | A1 | 11/2005 | Betremieux et al. |
| 2006/0049205 | A1 | 3/2006 | Green |
| 2006/0079588 | A1 | 4/2006 | Greer, Jr. |
| 2006/0180616 | A1 | 8/2006 | Woods |
| 2006/0219808 | A1 | 10/2006 | Woods |
| 2006/0219811 | A1 | 10/2006 | Woods |
| 2006/0273207 | A1 | 12/2006 | Woods |
| 2007/0117916 | A1 | 5/2007 | Anderson et al. |
| 2007/0119984 | A1 | 5/2007 | Woods |
| 2007/0125879 | A1 | 6/2007 | Khamenian |
| 2007/0142260 | A1 | 6/2007 | Tasz et al. |
| 2007/0155892 | A1 | 7/2007 | Gharapetian et al. |
| 2007/0178243 | A1 | 8/2007 | Houck et al. |
| 2007/0194040 | A1 | 8/2007 | Tasz et al. |
| 2007/0219310 | A1 | 9/2007 | Woods |
| 2007/0228086 | A1 | 10/2007 | Delande et al. |
| 2007/0235563 | A1 | 10/2007 | Woods |
| 2007/0260011 | A1 | 11/2007 | Woods |
| 2007/0272765 | A1 | 11/2007 | Kwasny |
| 2007/0272768 | A1 | 11/2007 | Williams et al. |
| 2008/0008678 | A1 | 1/2008 | Wyers |
| 2008/0017671 | A1 | 1/2008 | Shieh et al. |
| 2008/0029551 | A1 | 2/2008 | Lombardi |
| 2008/0033099 | A1 | 2/2008 | Bosway |
| 2008/0041887 | A1 | 2/2008 | Scheindel |
| 2008/0128203 | A1 | 6/2008 | Greer |
| 2008/0164347 | A1 | 7/2008 | Leuliet et al. |
| 2008/0229535 | A1 | 9/2008 | Walter |
| 2009/0020621 | A1 | 1/2009 | Clark et al. |
| 2009/0283545 | A1 | 11/2009 | Kimball |
| 2010/0108716 | A1 | 5/2010 | Bilko |
| 2010/0155432 | A1 | 6/2010 | Christianson |
| 2010/0200612 | A1 | 8/2010 | Smith |
| 2010/0322892 | A1 | 12/2010 | Burke |
| 2011/0021675 | A1 | 1/2011 | Shigemori et al. |
| 2011/0036872 | A1 | 2/2011 | Greer, Jr. et al. |
| 2011/0101025 | A1 | 5/2011 | Walters et al. |
| 2011/0127300 | A1 | 6/2011 | Ghavami-Nasr et al. |

FOREIGN PATENT DOCUMENTS

| | | |
|---|---|---|
| CA | 1191493 | 8/1985 |
| CA | 1210371 | 8/1986 |
| CA | 2145129 | 9/1995 |
| CA | 2090185 | 10/1998 |
| CA | 2291599 | 6/2000 |
| CA | 2381994 | 2/2001 |
| CA | 2327903 | 6/2001 |
| CA | 2065534 | 8/2003 |
| CA | 2448794 | 5/2004 |
| CA | 2504509 | 10/2005 |
| CA | 2504513 | 10/2005 |
| CH | 680849 | 11/1992 |
| DE | 210449 | 5/1909 |
| DE | 250831 | 9/1912 |
| DE | 634230 | 8/1936 |

(56) References Cited

FOREIGN PATENT DOCUMENTS

| | | |
|---|---|---|
| DE | 1047686 | 10/1957 |
| DE | 1926796 | 3/1970 |
| DE | 3527922 | 8/1985 |
| DE | 3808438 | 4/1989 |
| DE | 3806991 | 9/1989 |
| EP | 2130788 | 12/2009 |
| FR | 463476 | 2/1914 |
| FR | 84727 | 4/1964 |
| FR | 1586067 | 2/1970 |
| FR | 2336186 | 7/1977 |
| FR | 2659847 | 9/1991 |
| FR | 2792296 | 10/2000 |
| GB | 470488 | 11/1935 |
| GB | 491396 | 5/1937 |
| GB | 494134 | 1/1938 |
| GB | 508734 | 3/1939 |
| GB | 534349 | 2/1940 |
| GB | 675664 | 2/1949 |
| GB | 726455 | 4/1953 |
| GB | 867713 | 5/1961 |
| GB | 970766 | 9/1964 |
| GB | 977860 | 12/1964 |
| GB | 1144385 | 5/1969 |
| GB | 1536312 | 12/1978 |
| GB | 2418959 | 12/2006 |
| JP | 461392 | 1/1971 |
| JP | 55142073 | 11/1980 |
| JP | 8332414 | 6/1995 |
| NL | 8000344 | 8/1981 |
| WO | 8904796 | 6/1989 |
| WO | 9418094 | 8/1994 |
| WO | 2005087617 | 9/2005 |
| WO | 2005108240 | 11/2005 |
| WO | 2006090229 | 8/2006 |
| WO | 2008060157 | 5/2008 |

OTHER PUBLICATIONS

Chinese document disclosing a trigger spray assembly for a spray bottle; Jun. 4, 2004; 1 page.

Chinese document disclosing a trigger spray assembly for a spray bottle; Jun. 5, 2004; 1 page.

Saint-Gobain Calmar; "Mixor HP Trigger Sprayer Brochure", Dec. 2001; 2 pages.

ASTM, "Standard Test Method for Conducting Cyclic Potentiodynamic Polarization Measurements for Localized Corrosion Susceptibility of Iron—Nickel, or Cobalt-Based Alloys," 1993, 5 pages.

Tait, "An Introduction to Electrochemical Corrosion Testing for Practicing Engineers and Scientists," 1994, 17 pages.

Homax Products, Inc., "Easy Touch Spray Texture" brochure, Mar. 1992, 1 page.

Chadwick, "Controlling Particle Size in Self-Pressurized Aerosol Packages", Metal Finishing, Jul./Aug. 2004, vol. 102 No. 7/8.

Newman-Green, Inc., "Aerosol Valves, Sprayheads & Accessories Catalog", Apr. 1, 1992, pp. 14, 20, and 22.

* cited by examiner

SYSTEMS AND METHODS FOR DISPENSING TEXTURE MATERIAL USING DUAL FLOW ADJUSTMENT

RELATED APPLICATIONS

This application, U.S. patent application Ser. No. 13/560,949 filed Jul. 27, 2012, claims benefit of U.S. Provisional Application Ser. Nos. 61/513,401 filed Jul. 29, 2011, and 61/664,678 filed Jun. 26, 2012, the contents of which are incorporated herein by reference.

TECHNICAL FIELD

This application relates to the dispensing of texture material and, more particularly, to systems and methods for dispensing small amounts of texture material to an un-textured portion of a target surface such that an applied texture pattern of the texture material substantially matches a preexisting texture pattern on a textured portion of the target surface.

BACKGROUND

The present invention generally relates to systems and methods for applying texture material to an interior surface such as a wall or ceiling. In particular, buildings are typically constructed with a wood or metal framework. To form interior wall and ceiling surfaces, drywall material is attached to the framework. Typically, at least one primer layer and at least one paint layer is applied to the surface of the drywall material to form a finished wall surface.

For aesthetic and other reasons, a bumpy or irregular texture layer is often formed on the drywall material after the drywall material has been primed and before it has been painted. The appearance of the texture layer can take a number of patterns. As its name suggests, an "orange peel" texture pattern generally has the appearance of the surface of an orange and is formed by a spray of relatively small droplets of texture material applied in a dense, overlapping pattern. A "splatter" texture pattern is formed by larger, more spaced out droplets of texture material. A "knockdown" texture patter is formed by spraying texture material in larger droplets (like a "splatter" texture pattern) and then lightly working the surfaces of the applied droplets with a knife or scraper so that the highest points of the applied droplets are flattened. In some situations, a visible aggregate material such as polystyrene chips is added to the texture material to form what is commonly referred to as an "acoustic" or "popcorn" texture pattern. The principles of the present invention are of primary significance when applied to a texture material without visible aggregate material.

For larger applications, such as a whole room or structure, the texture layer is typically initially formed using a commercial texture sprayer. Commercial texture sprayers typically comprise a spray gun, a hopper or other source of texture material, and a source of pressurized air. The texture material is mixed with a stream of pressurized air within the texture gun, and the stream of pressurized air carries the texture material in droplets onto the target surface to be textured. Commercial texture sprayers contain numerous points of adjustment (e.g., amount of texture material, pressure of pressurized air, size of outlet opening, etc.) and thus allow precise control of the texture pattern and facilitate the quick application of texture material to large surface areas. However, commercial texture sprayers are expensive and can be difficult to set up, operate, and clean up, especially for small jobs where overspray may be a problem.

For smaller jobs and repairs, especially those performed by non-professionals, a number of "do-it-yourself" (DIY) products for applying texture material are currently available in the market. Perhaps the most common type of DIY texturing products includes aerosol systems that contain texture material and a propellant. Aerosol systems typically include a container, a valve, and an actuator. The container contains the texture material and propellant under pressure. The valve is mounted to the container selectively to allow the pressurized propellant to force the texture material out of the container. The actuator defines an outlet opening, and, when the actuator is depressed to place the valve in an open configuration, the pressurized propellant forces the texture material out of the outlet opening in a spray. The spray typically approximates only one texture pattern, so it was difficult to match a variety of perhaps unknown preexisting texture patterns with original aerosol texturing products.

A relatively crude work around for using an aerosol texturing system to apply more than one texture pattern is to reduce the pressure of the propellant material within the container prior to operating the valve. In particular, when maintained under pressure within the container, typical propellant materials exist in both a gas phase and in a liquid phase. The propellant material in the liquid phase is mixed with the texture material, and the texture material in the gas state pressurizes the mixture of texture material and liquid propellant material. When the container is held upright, the liquid contents of the container are at the bottom of the container chamber, while the gas contents of the container collect at the top of the container chamber. A dip tube extends from the valve to the bottom of the container chamber to allow the propellant in the gas phase to force the texture material up from the bottom of the container chamber and out of the outlet opening when the valve is opened. To increase the size of the droplets sprayed out of the aerosol system, the container can be inverted, the valve opened, and the gas phase propellant material allowed to flow out of the aerosol system, reducing pressure within the container chamber. The container is then returned upright and the valve operated again before the pressure of the propellant recovers such that the liquid contents are forced out in a coarser texture pattern. This technique of adjusting the applied texture pattern result in only a limited number of texture patterns that are not highly repeatable and can drain the can of propellant before the texture material is fully dispensed.

A more refined method of varying the applied texture pattern created by aerosol texturing patterns involved adjusting the size of the outlet opening formed by the actuator structure. Initially, it was discovered that the applied texture pattern could be varied by attaching one of a plurality of straws or tubes to the actuator member, where each tube defined an internal bore of a different diameter. The straws or tubes were sized and dimensioned to obtain fine, medium, and coarse texture patterns appropriate for matching a relatively wide range of pre-existing texture patterns. Additional structures such as caps and plates defining a plurality of openings each having a different cross-sectional area could be rotatably attached relative to the actuator member to change the size of the outlet opening. More recently, a class of products has been developed using a resilient member that is deformed to alter the size of the outlet opening and thus the applied texture pattern.

Existing aerosol texturing products are acceptable for many situations, especially by DIY users who do not expect perfect or professional results. Professional users and more demanding DIY users, however, will sometimes forego aerosol texturing products in favor of commercial texture sprayers because of the control provided by commercial texture sprayers.

The need thus exists for improved aerosol texturing systems and methods that can more closely approximate the results obtained by commercial texture sprayers.

SUMMARY

An aerosol dispenser for dispensing stored material in a spray comprises a container, a conduit, and first and second adjustment systems. The container defines a chamber containing the stored material and pressurized material. The conduit defines a conduit passageway having a conduit inlet and a conduit outlet. The conduit inlet is arranged within the chamber and the conduit outlet is arranged outside of the chamber. The first adjustment system is arranged to vary a flow of stored material along the conduit passageway and is arranged between the conduit inlet and the conduit outlet. The second adjustment system arranged to vary a flow of stored material along the conduit passageway and is arranged between the first adjustment system and the conduit outlet.

The present invention may also be embodied as a method of dispensing stored material in a spray comprising the following steps. The stored material and pressurized material are arranged in a chamber. A conduit is arranged such that a conduit inlet is arranged within the chamber and a conduit outlet is arranged outside of the chamber. A flow of stored material is varied at a first location along the conduit passageway. The first location is arranged between a conduit inlet defined by the conduit passageway and a conduit outlet defined by the conduit passageway. The flow of stored material is varied at a second location along the conduit passageway. The third location is arranged between the first location and the conduit outlet.

The present invention may also be embodied as an aerosol dispensing system for dispensing stored material in a spray comprising a container, a conduit, a valve assembly, and first and second adjustment members. The container defines a chamber containing the stored material and pressurized material. The conduit defines a conduit passageway having a conduit inlet and a conduit outlet. The conduit inlet is arranged within the chamber, and the conduit outlet is arranged outside of the chamber. The valve assembly is arranged selectively to allow and prevent flow of stored material along the conduit passageway. The first adjustment member arranged to vary a flow of stored material along the conduit passageway and is arranged between the conduit inlet and the conduit outlet. The second adjustment member arranged to vary a flow of stored material along the conduit passageway and is arranged between the first adjustment member and the conduit outlet.

DESCRIPTION OF THE DRAWINGS

FIG. 19 is a side elevation section view of the actuator member and first and second adjustment systems of the fourth example aerosol texturing system, with the first adjustment system in a fully open configuration and the actuator member in a closed position;

DETAILED DESCRIPTION

The present invention may be embodied in many forms, and several examples of aerosol dispensing systems of the present invention will be discussed below. In particular, the Applicant will initially describe a first example class of aerosol systems and a number of example aerosol dispensing systems within the first class. The Applicant will then describe a second example class of aerosol systems and a number of example aerosol dispensing systems within that second class.

I. First Example Class of Aerosol Dispensing Systems

Figure 1:
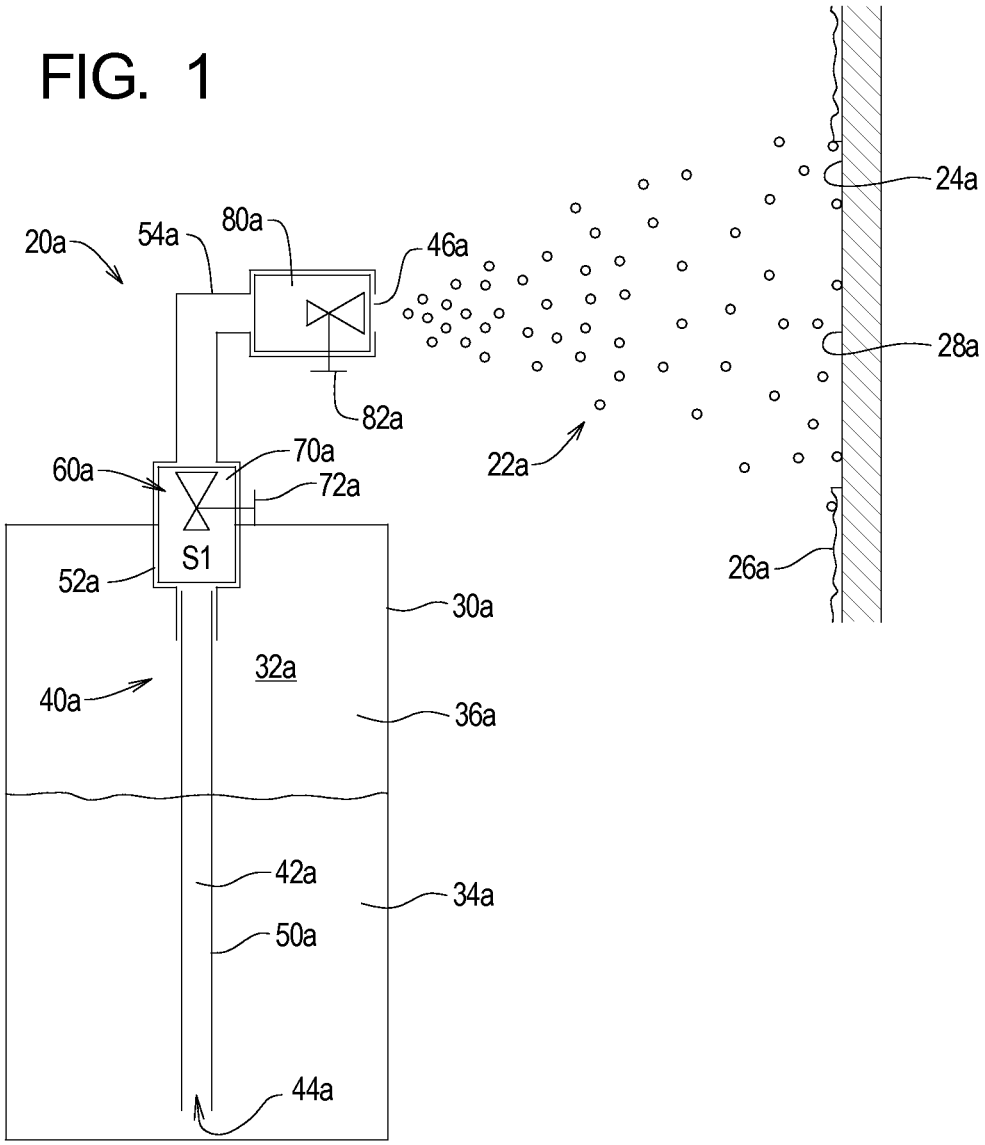
FIG. 1 schematically represents a first example general class of aerosol texturing system of the present invention.

Referring initially to FIG. 1 of the drawing, depicted at 20*a* therein is a first example aerosol dispensing system constructed in accordance with, and embodying, the principles of the present invention. The first example dispensing system is adapted to spray droplets of dispensed material 22*a* onto a target surface 24*a*. The example target surface 24*a* has a textured portion 26*a* and an un-textured portion 28*a*. Accordingly, in the example use of the dispensing system 20*a* depicted in FIG. 1, the dispensed material 22*a* is or contains texture material, and the dispensing system 20*a* is being used to form a coating on the un-textured portion 28*a* having a desired texture pattern that substantially matches a pre-existing texture pattern of the textured portion 26*a*.

FIG. 1 further illustrates that the example dispensing system 20*a* comprises a container 30*a* defining a chamber 32*a* in which stored material 34*a* and pressurized material 36*a* are contained. The stored material 34*a* is a mixture of texture material and propellant material in liquid phase, while the pressurized material is propellant material in gas phase.

A typical texture material forming a part of the dispensed material 22*a* and/or stored material 34*a* will comprise a base or carrier, a binder, a filler, and, optionally, one or more additives such as surfactants, biocides and thickeners. Examples of the base or carrier include water, solvent (oil-based texture material) such as xylene, toluene, acetone, methyl ethyl ketone, and combinations of water and water soluble solvents. Examples of binders include starch, polyvinyl alcohol and latex resins (water-based systems) and a wide variety of polymers such as ethylene vinyl acetate, thermoplastic acrylics, styrenated alkyds, etc. (solvent-based systems). Examples of fillers include calcium carbonate, titanium dioxide, attapulgite clay, talc, magnesium aluminum silicate, etc.

The stored material 34*a* will also comprise a liquid phase propellant material, and the pressurized material will typically comprise a gas phase propellant material. The following propellant materials are appropriate for use as the propellant material forming the stored material 34*a* and the pressurized material 36*a*: dimethyl ether, propane, butane, isobutene, difluoroethane, and tetrafluoroethane.

The following Tables A-1, A-2, and A-3 and Tables A-4 and A-5 attached hereto as Exhibit A contain example formulations of the texture material that may be used to form the dispensed material 22*a* and stored material 34*a* of the first example aerosol dispensing 20*a*.

TABLE A-1

(Solvent Based)

| Material | Purpose | First Example | Second Example | Third Example |
|---|---|---|---|---|
| Solvent | Base | 35% | 30-40% | 20-60% |
| Pigment | Filler | 60% | 55-65% | 40-80% |
| Resin | Binder | 2.5% | 1-5% | 0.5-15% |

To the example texture material described in Table A-1 is added propellant material in the form of a propane/butane/isobutane blend. A first range of approximately 10-20% by weight of the propellant material is added to the example texture material of Table A-1, but the propellant material should in any event be within a second range of approximately 5-25% by weight of the propellant material.

TABLE A-2

(Knockdown)

| Material | Purpose | First Example | Second Example | Third Example |
|---|---|---|---|---|
| Water | Base | 48% | 45-55% | 40-60% |
| Pigment | Filler | 50% | 45-55% | 40-60% |
| Resin | Binder | 2% | 1-5% | 0.5-10% |

To the example texture material described in Table A-2 is added propellant material in the form of DME. A first range of approximately 7-15% by weight of the propellant material is added to the example texture material of Table A-2, but the propellant material should in any event be within a second range of approximately 5-25% by weight of the propellant material.

TABLE A-3

(No Prime)

| Material | Purpose | First Example | Second Example | Third Example |
|---|---|---|---|---|
| Water | Base | 42% | 40-50% | 30-60% |
| Pigment | Filler | 47% | 40-50% | 30-60% |
| Resin | Binder | 10% | 5-15% | 2.5-20% |

To the example texture material described in Table A-3 is added propellant material in the form of DME. A first range of approximately 10-15% by weight of the propellant material is added to the example texture material of Table A-3, but the propellant material should in any event be within a second range of approximately 5-25% by weight of the propellant material.

With reference to Tables A-4 and A-5 in Exhibit A, that table contains examples of a texture material composition adapted to be combined with an aerosol and dispensed using an aerosol dispensing system in accordance with the principles of the present invention. Each value or range of values in Tables A-4 and A-5 represents the percentage of the overall weight of the example texture material composition formed by each material of the texture material composition for a specific example, a first example range, and a second example range. The composition described in Table A-5 is similar to that of Table A-4, but Table A-5 contains a number of additional materials that may optionally be added to the example texture material composition of Table A-4.

One example of a method of combining the materials set forth in Table A-4 is as follows. Materials A, B, C, and D are combined to form a first sub-composition. The first sub-composition is mixed until material D is dissolved (e.g., 30-40 minutes). Materials E and F are then added to the first sub-composition to form a second sub-composition. The second sub-composition is mixed until materials E and F are well-dispersed (e.g., at high speed for 15-20 minutes). Material G is then added to the second sub-composition to form a third sub-composition. The third sub-composition is mixed well (e.g., 10 minutes). Typically, the speed at which the third sub-composition is mixed is reduced relative to the speed at which the second sub-composition is mixed. Next, materials H, I, and J are added to the third sub-composition to form the example texture material composition of the present invention. The example texture material composition is agitated. Material K may be added as necessary to adjust (e.g., reduce) the viscosity of the example texture material composition.

The example texture material composition of the present invention may be combined with an aerosol propellant in any of the aerosol dispensing systems described herein to facilitate application of the example texture material composition to a surface to be textured.

FIG. 1 further illustrates that the first example aerosol dispensing system 20*a* comprises a conduit 40*a* defining a conduit passageway 42*a*. The conduit 40*a* is supported by the container 30*a* such that the conduit passageway 42*a* defines a conduit inlet 44*a* arranged within the chamber 32*a* and a conduit outlet 46*a* arranged outside of the chamber 32*a*. The conduit outlet 46*a* may alternatively be referred to herein as an outlet opening 46*a*. The example conduit 40*a* is formed by an inlet tube 50*a*, a valve housing 52*a*, and an actuator structure 54*a*. The conduit passageway 42*a* extends through the inlet tube 50*a*, the valve housing 52*a*, and the actuator structure Ma such that the valve housing 52*a* is arranged between the conduit inlet 44*a* and the actuator structure 54*a* and the actuator structure 54*a* is arranged between the valve housing 52*a* and the conduit outlet 46*a*.

Arranged within the valve housing 52*a* is a valve system 60*a*. A first flow adjustment system 70*a* having a first adjustment member 72*a* is arranged to interface with the valve system 60*a*. A second flow adjustment system 80*a* having a second adjustment member 82*a* is arranged in the conduit passageway 42*a* to form at least a portion of the conduit outlet 46*a*.

The valve system 60*a* operates in a closed configuration, a fully open configuration, and at least one of a continuum or plurality of partially open intermediate configurations. In the closed configuration, the valve system 60*a* substantially prevents flow of fluid along the conduit passageway 42*a*. In the open configuration and the at least one intermediate configuration, the valve system 60*a* allows flow of fluid along the conduit passageway 42*a*. The valve system 60*a* is normally in the closed configuration. The valve system 60*a* engages the actuator member structure 54*a* and is placed into the open configuration by applying deliberate manual force on the actuator structure 54*a* towards the container 30*a*.

The first flow adjustment system 70*a* is supported by the container 30*a* to engage the actuator structure such that manual operation of the first adjustment member 72*a* affects operation of the valve system 60*a* to control the flow of fluid material along the conduit passageway 42*a*. In particular, the first adjustment system 70*a* and the valve system 60*a* function as a flow restrictor, where operation of the first adjustment member 72*a* results in a variation in the size of the conduit passageway 42*a* within the valve system 60*a* such that a pressure of the fluid material upstream of the first flow adjustment system 70*a* is relatively higher than the pressure of the fluid material downstream of the first flow adjustment system 70*a*.

In general, a primary purpose of the first flow adjustment system 70*a* is to alter a distance of travel of the dispensed material 22*a*. The first flow adjustment system 70*a* may also have a secondary affect on the pattern in which the dispensed material 22*a* is sprayed.

The second adjustment system 80*a* is supported by the actuator structure 54*a* downstream of the first adjustment system 70*a*. Manual operation of the second adjustment member 82*a* affects the flow of fluid material flowing out of the conduit passageway 42*a* through the conduit outlet 46*a*. In particular, the second adjustment system 80*a* functions as a variable orifice, where operation of the second adjustment member 82*a* variably reduces the size of the conduit outlet 46*a* relative to the size of the conduit passageway 42*a* upstream of the second adjustment system 80*a*.

A primary purpose of the second flow adjustment system 80*a* is to alter a pattern in which the dispensed material 22*a* is sprayed. The first flow adjustment system 70*a* may also have a secondary affect on the distance of travel of the dispensed material 22*a*.

To operate the first example aerosol dispensing system 20, the container 30*a* is grasped such that the finger can depress the actuator structure 54*a*. The conduit outlet or outlet opening 46*a* is initially aimed at a test surface and the actuator structure 54*a* is depressed to place the valve system 60*a* in the open configuration such that the pressurized material 36*a* forces some of the stored material 34*a* out of the container 30*a* and onto the test surface to form a test texture pattern. The test texture pattern is compared to the pre-existing texture pattern defined by the textured portion 26*a* of the target surface 24*a*. If the test texture pattern does not match the pre-existing texture pattern, one or both of the first and second adjustment systems 70*a* and 80*a* are adjusted to alter the spray pattern of the droplets of dispensed material 22*a*.

The process of spraying a test pattern and comparing it to the pre-existing pattern and adjusting the first and second adjustment members 72*a* and 82*a* is repeated until the dispensed material forms a desired texture pattern that substantially matches the pre-existing texture pattern.

Leaving the first and second adjustment systems 70*a* and 80*a* as they were when the test texture pattern matched the pre-existing texture pattern, the aerosol dispensing system 20*a* is then arranged such that the conduit outlet or outlet opening 46*a* is aimed at the un-textured portion 28*a* of the target surface 24*a*. The actuator structure 54*a* is again depressed to operate the valve system 60*a* such that the pressurized material 36*a* forces the stored material 34*a* out of the container 30*a* and onto the un-textured portion 28*a* of the target surface to form the desired texture pattern.

A. Second Example Aerosol Dispensing System

Referring now to FIGS. 2-5 of the drawing, depicted at 120 therein is a second example aerosol dispensing system constructed in accordance with, and embodying, the principles of the present invention. Like the first example aerosol dispensing system 20, the second example dispensing system 120 is adapted to spray droplets of dispensed material 122 onto a target surface (not shown). In the example use of the dispensing system 120 depicted in FIGS. 2-5, the dispensed material 122 is or contains texture material, and the dispensing system 120 is being used to form a coating on an un-textured portion of the target surface having a desired texture pattern that substantially matches a pre-existing texture pattern of a textured portion of the target surface.

Figure 2:
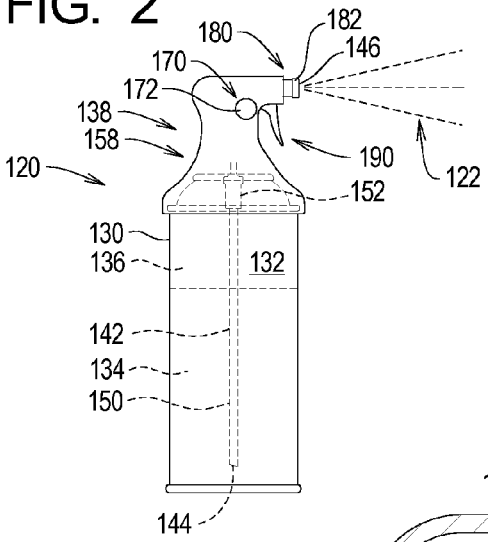
FIG. 2 is a side elevation view of a second example aerosol texturing system of the present invention.

FIG. 2 further illustrates that the example dispensing system 120 comprises a container 130 defining a chamber 132 in which stored material 134 and pressurized material 136 are contained. Like the stored material 34 described above, the stored material 134 is a mixture of texture material and propellant material in liquid phase, while the pressurized material is propellant material in gas phase. An actuator assembly 138 is mounted on the container assembly 130 to facilitate the dispensing of the dispensed material 122 as will be described in further detail below.

Figure 3A:
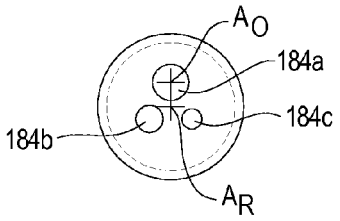
FIG. 3A is a front elevation view of a second adjustment member of the second example aerosol texturing system.
Figure 3:
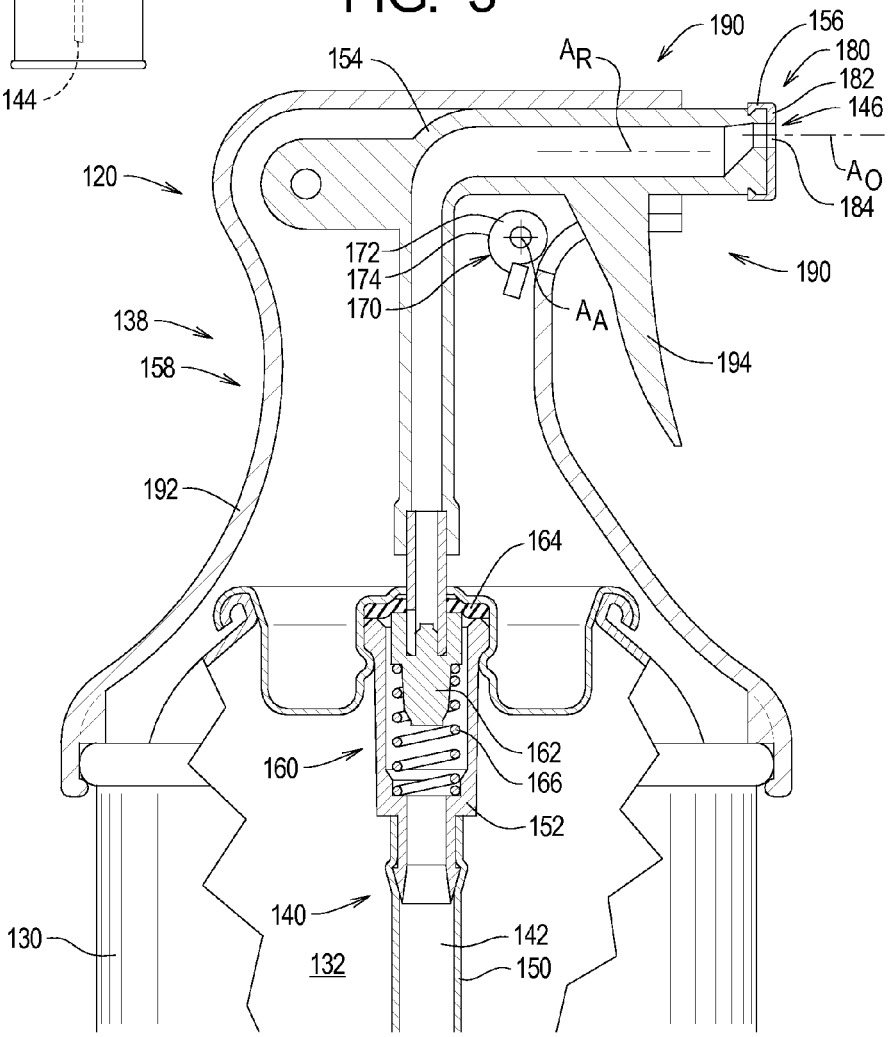
FIG. 3 is a side elevation, partial section view a first adjustment system of the second example aerosol texturing system in a closed configuration.

FIG. 3 illustrates that the second example aerosol dispensing system 120 comprises a conduit 140 defining a conduit passageway 142. The conduit 140 is supported by the container 130 such that the conduit passageway 142 defines a conduit inlet 144 arranged within the chamber 132 and a conduit outlet or outlet opening 146 arranged outside of the chamber 132. The example conduit 140 is formed by an inlet tube 150, a valve housing 152, and an actuator member 154. The conduit passageway 142 extends through the inlet tube 150, the valve housing 152, the actuator member 154, and the outlet member 156. The valve housing 152 is arranged between the conduit inlet 144 and the actuator member 154, and the actuator member 154 is arranged between the valve housing 152 and the conduit outlet 146. The outlet member 156 is supported by the actuator member 154 to define the conduit outlet 146. A grip assembly 158 is supported by the container assembly 130, and the grip assembly 158 in turn supports the actuator member 154 for movement relative to the container assembly 130.

Arranged within the valve housing 152 is a valve assembly 160. The example valve assembly 160 comprises a valve member 162, a valve seat 164, and a valve spring 166. The valve assembly 160 operates in a closed configuration and an open configuration. In the closed configuration, the valve spring 166 forces the valve member 162 against the valve seat 164 such that the valve assembly 160 substantially prevents flow of fluid along the conduit passageway 142. In the open configuration, the valve member 162 is displaced away from the valve seat 164 against the force of the valve spring 166 such that the valve assembly 160 allows flow of fluid along the conduit passageway 142 between the valve member 162 and the valve seat 164. Because the valve spring 166 biases the valve member 162 towards the valve seat 164, the example valve assembly 160 is normally closed. The valve assembly 160 engages the actuator member structure 154 such that the application of deliberate manual force on the actuator member 154 towards the container 130 moves the valve member 162 away from the valve seat 164 and thus places the valve system 160 in the open configuration.

A first flow adjustment system 170 comprising a first adjustment member 172 is arranged selectively to limit movement of the actuator member 154 relative to the container assembly 130. In particular, the first adjustment member defines an adjustment axis $A_A$ and a stop surface 174. The stop surface 174 extends along a varying or substantially helical path relative to the adjustment axis $A_A$.

Figure 4:
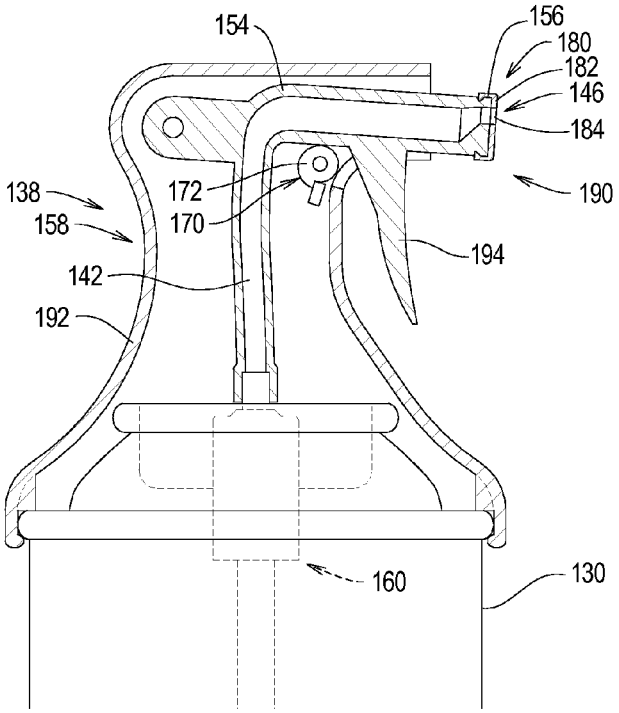
FIG. 4 is a partial section view of the first adjustment system of the second example aerosol texturing system in an intermediate configuration.
Figure 5:
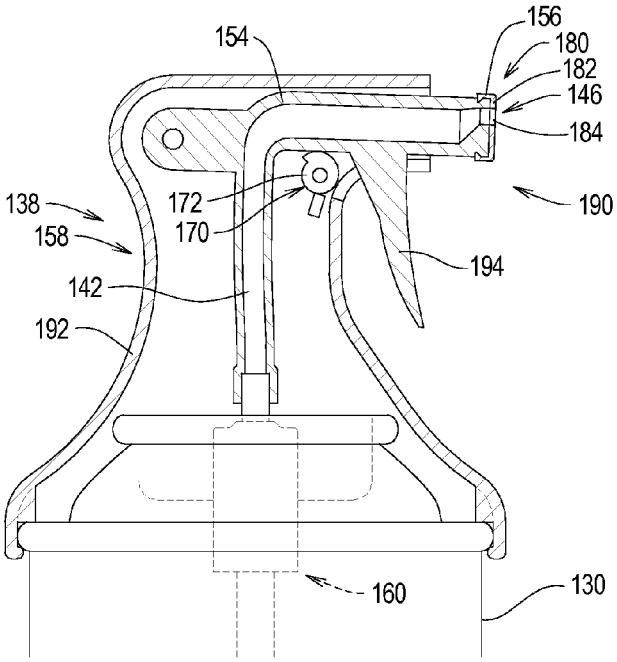
FIG. 5 is a partial section view of the first adjustment system of the second example aerosol texturing system in a fully open configuration.

Rotation of the first adjustment member 172 relative to the grip assembly 158 thus alters a position of the stop surface 174 relative to the actuator member 154. With the first adjustment member 172 in a first angular position as shown in FIGS. 3 and 4, the actuator member 154 travels a first distance relative to the valve assembly 160. With the first adjustment member 172 in a second angular position as shown in FIG. 5, the actuator member 154 travels a second distance relative to the valve assembly 160. The first distance is longer than the first distance as can be seen by a close inspection of FIGS. 4 and 5, so the valve system 160, in cooperation with the first adjustment system 170, thus forms a bigger restriction in the conduit passageway 142 when the first adjustment member 172 is in the second angular position than when the first adjustment member 172 is in the first angular position.

Further, the first adjustment member 172 is configurable in any one of a plurality or continuum of angular positions between the first and second positions shown. The first adjustment system 170 thus allows the user to obtain a range of restrictions in the conduit passageway as necessary for a particular desired texture pattern.

A second flow adjustment system 180 having a second adjustment member 182 is arranged in the conduit passageway 142 to form at least a portion of the conduit outlet or outlet opening 146. In particular, the second adjustment member 182 defines a plurality of adjustment openings 184*a*, 184*b*, and 184*c* (FIG. 3A). The second adjustment member 182 is further rotatably supported by the actuator member 154 such that an axis of rotation $A_R$ of the second adjustment member 182 is offset from an outlet axis $A_O$ defined by the conduit outlet 146. Accordingly, rotating the second adjustment member 182 relative to the actuator member 154 allows any selected one of the outlet openings 184*a*, 184*b*, and 184*c* to be arranged to define a cross-sectional area of the outlet opening defined by the conduit outlet 146.

Manual operation of the first adjustment member 172 affects the flow of fluid material along the conduit passageway 142 upstream of the second adjustment system 180. In particular, the first adjustment system 170 functions as a flow restrictor, where operation of the first adjustment member 172 variably reduces the size of the conduit passageway 142 such that a pressure of the fluid material upstream of the first flow adjustment system 170 is relatively higher than the pressure of the fluid material downstream of the first flow adjustment system 170 (towards the second adjustment system 180).

The second adjustment system 180 is supported by the actuator member 154 downstream of the first adjustment system 170. The selected one of the adjustment openings 184*a*, 184*b*, and 184*c* thereby affects the flow of fluid material flowing out of the conduit passageway 142. The second adjustment system 180 thus functions as a variable orifice system. Operation of the second adjustment member 172 variably reduces the size of the conduit outlet or outlet opening 146 relative to the size of the conduit passageway 142 upstream of the second adjustment system 180.

The first adjustment member 172 and second adjustment member 182 are supported as described above to define a control system 190. FIG. 3 further shows that the grip assembly 158 comprises a grip housing 192 and that the actuator member 154 defines a trigger portion 194. Additionally, the grip assembly 158 is combined with the control system 190 to form the actuator assembly 138, and the actuator assembly 138 is supported by the container assembly 130 as generally described above. In the example actuator assembly 138, the actuator assembly 138 is pivotably connected to the grip housing 192. Accordingly, to operate the second example aerosol dispensing system 120, the container 130 and grip housing 192 are grasped such that the user's fingers can squeeze the trigger portion 194, thereby allowing the actuator member 154 to be depressed.

In use, the conduit outlet or outlet opening 146 is initially aimed at a test surface and the actuator member 154 is depressed to place the valve assembly 160 in the open configuration such that the pressurized material 136 forces some of the stored material 134 out of the container 130 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 122.

The process of spraying a test pattern and adjusting the first and second adjustment members 172 and 182 is repeated until the test pattern formed by the dispensed material 122 corresponds to a desired texture pattern that substantially matches the pre-existing texture pattern.

Leaving the first and second adjustment members 172 and 182 as they were when the test texture pattern corresponded to the desired texture pattern, the aerosol dispensing system 120 is then arranged such that the conduit outlet or outlet opening 146 is aimed at the un-textured portion of the target surface. The trigger member 194 is again squeezed to place the valve assembly 160 in the open configuration such that the pressurized material 136 forces the stored material 134 out of the container 130 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface in a desired texture pattern that substantially matches a physical appearance of the textured portion. One or more layers of primer and/or paint may next be applied over the cured layer of dispensed material on the target surface.

The following Table B represents example ranges and dimensions for constructing a physical embodiment of a flow adjustment system that may be used as the example first flow adjustment system 170:

TABLE B

| Config. | Units | Example | First Range | Second Range |
|---|---|---|---|---|
| First Angular Position | % Passageway | 100 | 95-100 | 90-100 |
| | Square Inches | .00385 | 0.00424-0.00347 | 0.00578-0.00193 |
| Second Angular Position | % Passageway | 12 | 8-16 | 5-20 |
| | Square Inches | .00045 | 0.00050-0.00041 | 0.00068-0.00023 |

B. Third Example Aerosol Dispensing System

Referring now to FIGS. 6-17 of the drawing, depicted at 220 therein is a third example aerosol dispensing system constructed in accordance with, and embodying, the principles of the present invention. Like the first example aerosol dispensing system 20, the third example dispensing system 220 is adapted to spray droplets of dispensed material 222 onto a target surface (not shown). In the example use of the dispensing system 220 depicted in FIGS. 6-17, the dispensed material 222 is or contains texture material, and the dispensing system 220 is being used to form a coating on an un-textured portion of the target surface having a desired texture pattern that substantially matches a pre-existing texture pattern of a textured portion of the target surface.

Figure 6:
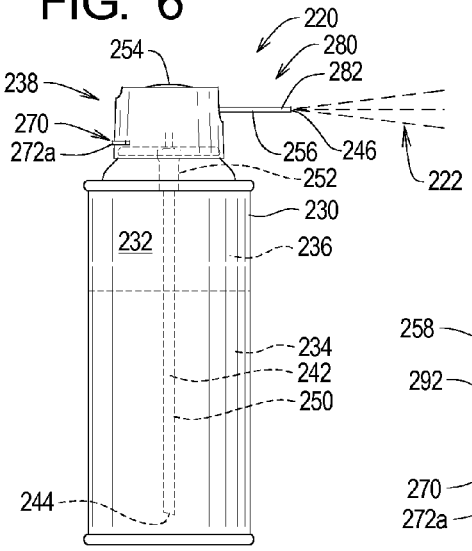
FIG. 6 is a side elevation view of a third example aerosol texturing system of the present invention.
Figure 8:
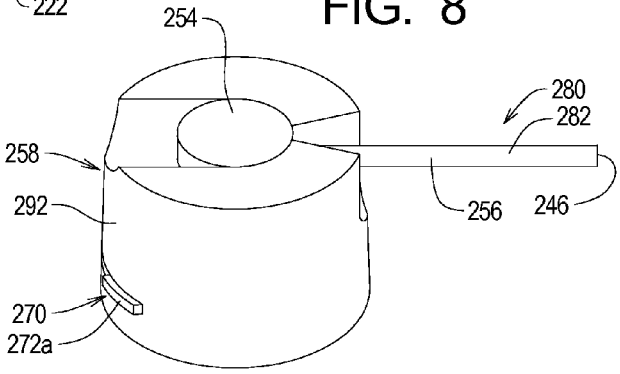
FIG. 8 is top perspective view illustrating an example actuator assembly of the third example aerosol texturing system.

FIG. 6 further illustrates that the example dispensing system 220 comprises a container 230 defining a chamber 232 in which stored material 234 and pressurized material 236 are contained. Like the stored material 34 described above, the stored material 234 is a mixture of texture material and propellant material in liquid phase, while the pressurized material is propellant material in gas phase. An actuator assembly 238 is mounted on the container assembly 230 to facilitate the dispensing of the dispensed material 222 as will be described in further detail below.

Figure 7:
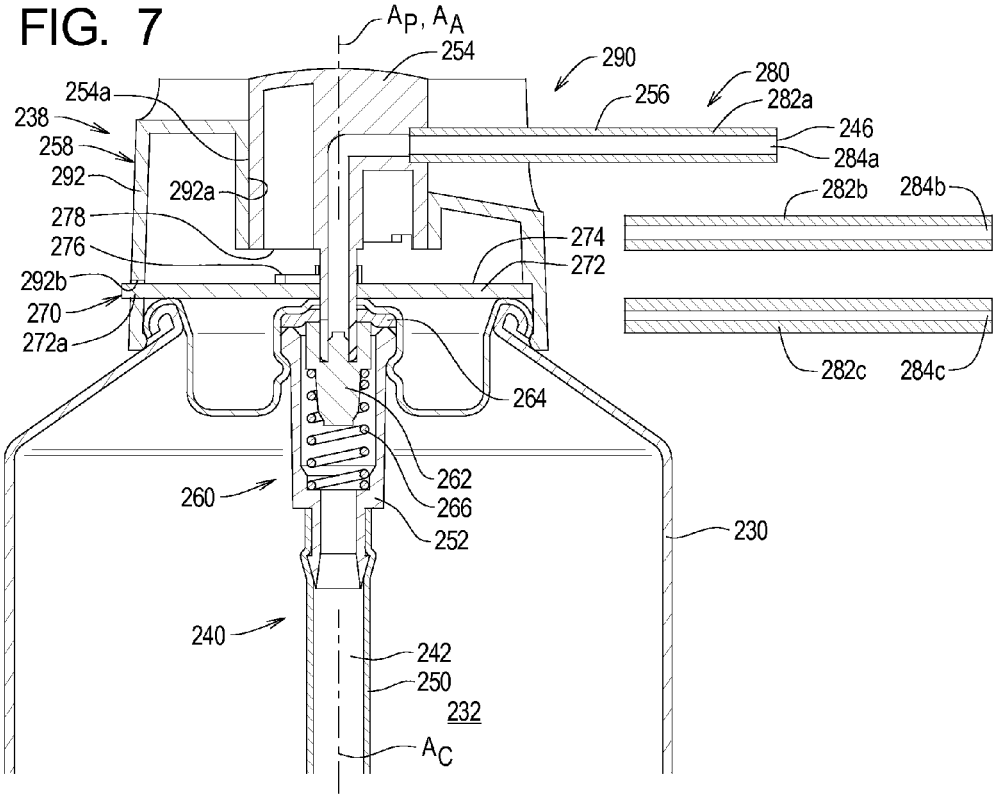
FIG. 7 is a side elevation, section view of an actuator member and first and second adjustment systems of the third example aerosol texturing system, with the second adjustment system including a plurality of straw members.
Figure 9:
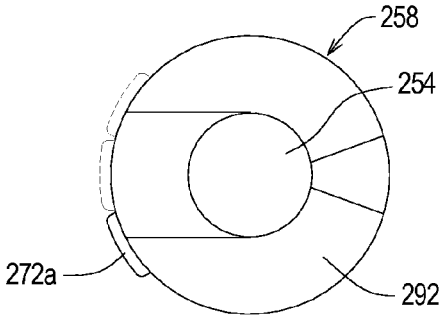
FIG. 9 is a top plan view of the example actuator assembly of the third example aerosol texturing system.
Figure 10:
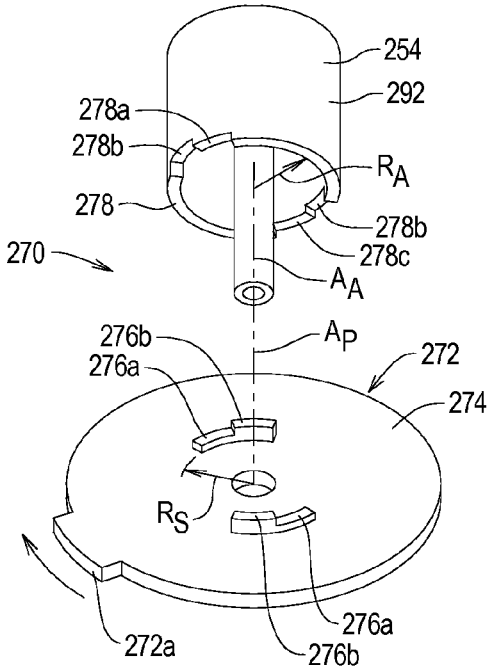
FIG. 10 is a top perspective, assembly view illustrating a portion of the first example adjustment system of the third example aerosol texturing system.
Figure 11:
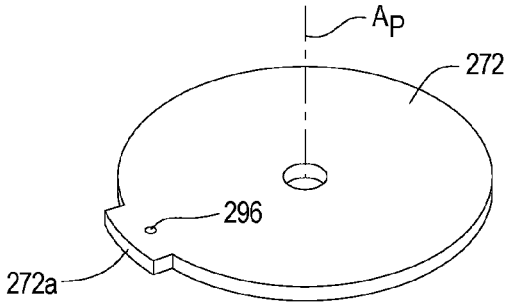
FIG. 11 is a bottom perspective view illustrating an adjustment plate of the first example adjustment system of the third example aerosol texturing system.
Figure 12:
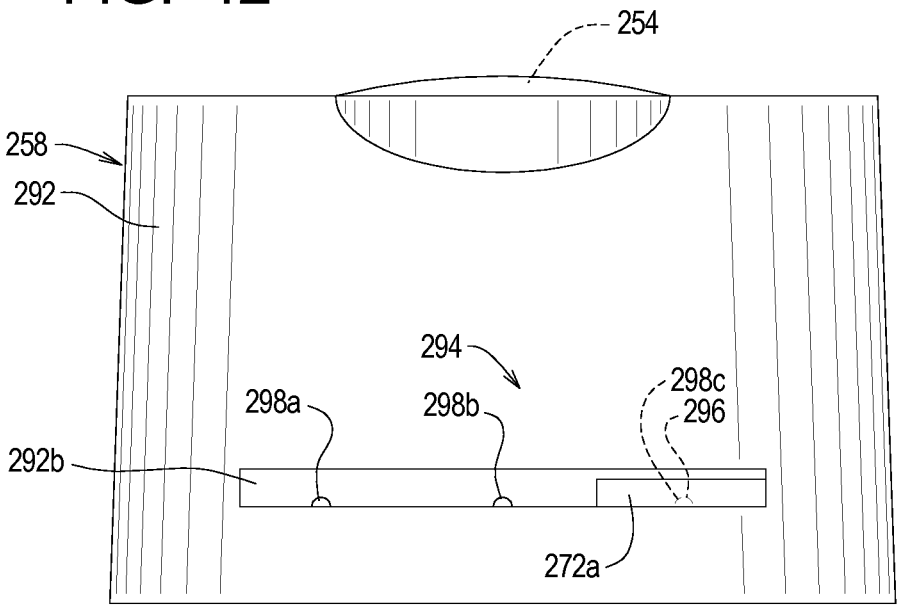
FIG. 12 is a rear elevation view of a portion of the actuator assembly of the third example aerosol texturing system.
Figure 13:
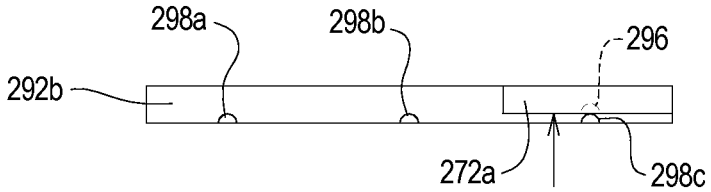
FIGS. 13 and 14 are a rear elevation view of a portion of FIG. 12 illustrating the movement of the adjustment plate.
Figure 14:
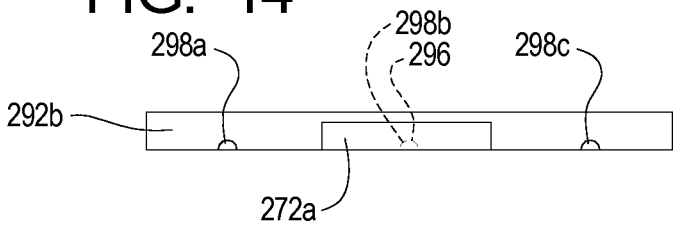

FIG. 7 illustrates that the second example aerosol dispensing system 220 comprises a conduit 240 defining a conduit passageway 242. The conduit 240 is supported by the container 230 such that the conduit passageway 242 defines a conduit inlet 244 arranged within the chamber 232 and a conduit outlet or outlet opening 246 arranged outside of the chamber 232. The example conduit 240 is formed by an inlet tube 250, a valve housing 252, and an actuator member 254. The conduit passageway 242 extends through the inlet tube 250, the valve housing 252, the actuator member 254, and the outlet member 256. The valve housing 252 is arranged between the conduit inlet 244 and the actuator member 254, and the actuator member 254 is arranged between the valve housing 252 and the conduit outlet 246. The outlet member 256 is supported by the actuator member 254 to define the conduit outlet 246. A grip assembly 258 is supported by the container assembly 230, and the grip assembly 258 in turn supports the actuator member 254 for movement relative to the container assembly 230.

Arranged within the valve housing 252 is a valve assembly 260. The example valve assembly 260 comprises a valve member 262, a valve seat 264, and a valve spring 266. The valve assembly 260 operates in a closed configuration and an open configuration. In the closed configuration, the valve spring 266 forces the valve member 262 against the valve seat 264 such that the valve assembly 260 substantially prevents flow of fluid along the conduit passageway 242. In the open configuration, the valve member 262 is displaced away from the valve seat 264 against the force of the valve spring 266 such that the valve assembly 260 allows flow of fluid along the conduit passageway 242 between the valve member 262 and the valve seat 264. Because the valve spring 266 biases the valve member 262 towards the valve seat 264, the example valve assembly 260 is normally closed. The valve assembly 260 engages the actuator member structure 254 such that the application of deliberate manual force on the actuator member 254 towards the container 230 moves the valve member 262 away from the valve seat 264 and thus places the valve system 260 in the open configuration.

A first flow adjustment system 270 comprising a first adjustment member 272 is arranged selectively to limit movement of the actuator member 254 relative to the container assembly 230. In particular, the first adjustment member 272 is a plate or disc defining an upper surface 274 and a plate axis $A_p$, and, optionally, comprises at least one stop surface 276. The at least one example stop surface 276 is arranged in an arcuate segment on the upper surface 274 and define a stop radius $R_S$ relative to the plate axis A. In the example first adjustment member 272, two pairs of stop surfaces 276*a* and 276*b* are formed in opposing locations relative to the plate axis A.

The example flow adjustment system 270 further comprises at least one engaging surface 278 formed on the actuator member 254. The example actuator member 254 defines an actuator axis $A_A$, and the at least one engaging surface 278 is arranged in an arcuate segment on the lower edge of the actuator member 254 and defines an actuator radius $R_A$ relative to the actuator axis $A_A$. The actuator radius $R_A$ and the stop radius $R_S$ are substantially the same in the example flow adjustment system 270.

In general, the actuator member 254 is arranged relative to the first adjustment member 272 such that rotation of the first adjustment member 272 relative to the grip assembly 258 alters an angular position of the at least one stop surface 276 relative to the at least one engaging surface 278 of actuator member 254. The angular relationship of the at least one stop surface 274 relative to the at least one engaging surface 278 determines an amount of travel of the actuator member 254 relative to the container assembly 230 and the valve system 260 supported thereby.

Figure 15A:
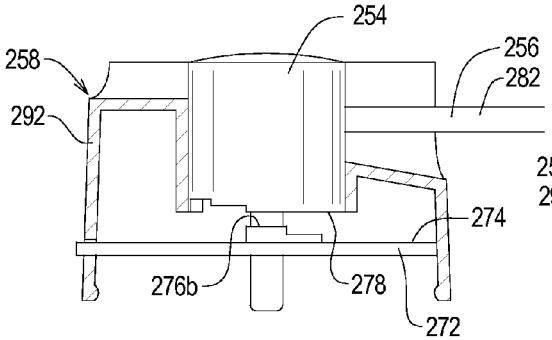
FIGS. 15A and 15B are partial section views illustrating movement of an actuator member from a closed position to a first intermediate position.
Figure 15B:
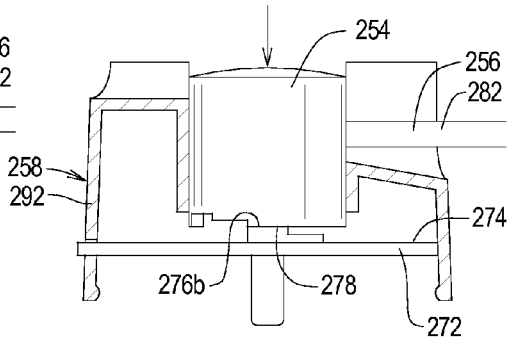
Figure 16A:
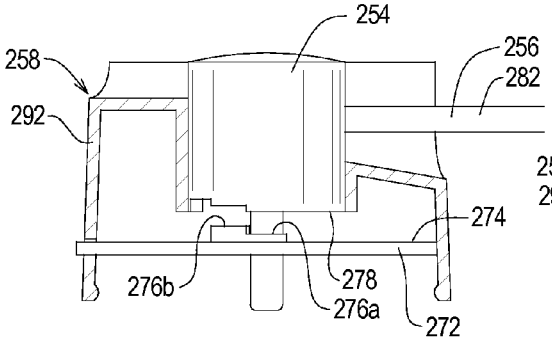
FIGS. 16A and 16B are partial section views illustrating movement of the actuator member from a closed position to a second intermediate position.
Figure 16B:
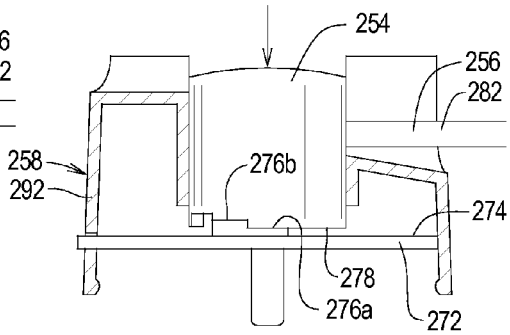
Figure 17A:
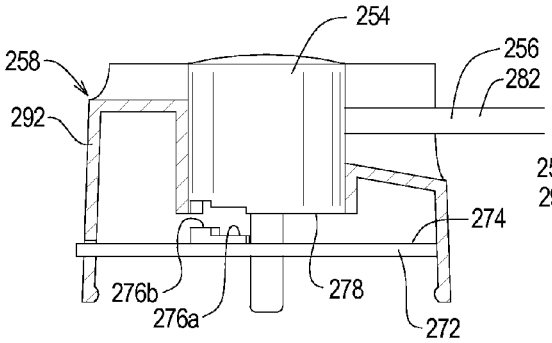
FIGS. 17A and 17B are partial section views illustrating movement of the actuator member from a closed position to a fully open position.
Figure 17B:
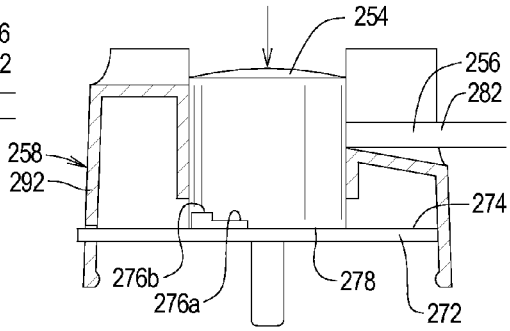

In particular, with the first adjustment member 272 in a first angular position relative to the actuator member 254 as shown in FIGS. 15A and 15B, the actuator member 254 travels a first distance relative to the valve assembly 260. With the first adjustment member 272 in a second angular position as shown in FIGS. 16A and 16B, the actuator member 254 travels a second distance relative to the valve assembly 260. With the first adjustment member 272 in a third angular position as shown in FIGS. 17A and 17B, the actuator member 254 travels a second distance relative to the valve assembly 260. The third distance is longer than the second distance and the second distance is longer than the first distance, as can be seen by a close inspection of FIGS. 15B, 16B, and 17B. Travel of the actuator member 254 determines the size of the opening defined by the valve system 260. The example valve system 260, in cooperation with the first adjustment system 270, thus allows the size of the restriction in the conduit passageway 242 formed by the valve system to be varied depending upon the angular position of the first adjustment member 272.

Further, the first adjustment member 272 may configurable in any one of a plurality or continuum of angular positions by using slanted stop and engaging surfaces rather than the arrangement of stop surfaces 276 and engaging surfaces 278 of the example first adjustment system 260. The first adjustment system 270 thus allows the user to obtain a range of restrictions in the conduit passageway as necessary for a particular desired texture pattern.

A second flow adjustment system 280 having a second adjustment member 282 is arranged in the conduit passageway 242 to form at least a portion of the conduit outlet or outlet opening 246. In particular, the second adjustment member 282 of the example second flow adjustment system 280 takes the form of at least one adjustment straw or tube (FIG. 7). Each second adjustment member 282 defines an outlet orifice 284. The example second flow adjustment system 280 comprises three second adjustment members 282*a*, 282*b*, and 282*c* defining outlet orifices 284*a*, 284*b*, and 284*c*, respectively. Each of the outlet orifices 284*a*, 284*b*, and 284*c* defines a different cross-sectional area.

A selected one of the second adjustment members 282*a*, 282*b*, and 284*c* is detachably attached to the actuator member 254 such that the outlet orifice 284*a*, 284*b*, or 284*c* associated with the selected second adjustment member 282*a*, 282*b*, or 282*c* is aligned with the conduit outlet 246. Accordingly, any selected one of the outlet orifices 284*a*, 284*b*, and 284*c* may be selected and arranged to define a cross-sectional area of the outlet opening defined by the conduit outlet 246.

Manual operation of the first adjustment member 272 affects the flow of fluid material along the conduit passageway 242 upstream of the second adjustment system 280. In particular, the first adjustment system 270 functions as a flow restrictor, where operation of the first adjustment member 272 variably reduces the size of the conduit passageway 242 such that a pressure of the fluid material upstream of the first flow adjustment system 270 is relatively higher than the pressure of the fluid material downstream of the first flow adjustment system 270 (towards the second adjustment system 280).

The second adjustment system 280 is supported by the actuator member 254 downstream of the first adjustment system 270. The selected one of the outlet orifices 284*a*, 284*b*, and 284*c* thereby affects the flow of fluid material flowing out of the conduit passageway 242. The second adjustment system 280 thus functions as a variable orifice system. Operation of the second adjustment member 272 variably reduces the size of the conduit outlet or outlet opening 246 relative to the size of the conduit passageway 242 upstream of the second adjustment system 280.

The actuator member 254, the first adjustment member 272, and the selected one of the second adjustment members 282 supported to define a control system 290. FIG. 7 further shows that the grip assembly 258 comprises a grip housing 292. Additionally, the grip assembly 258 is combined with the control system 290 to form the actuator assembly 238, and the actuator assembly 238 is supported by the container assembly 230 as generally described above.

In the example actuator assembly 238, grip housing 292 defines a cylindrical interior surface 292*a* and the actuator member 254 defines a cylindrical outer surface 254*a*. The outer surface 254*a* is sized and dimensioned to allow the actuator member 254 to fit within a grip chamber defined by the interior surface 292*a* such that the grip housing 292 supports the actuator member 254 for substantially linear movement along a container axis $A_C$ defined by the container assembly 230.

Accordingly, to operate the second example aerosol dispensing system 220, the container 230 and grip housing 292 are grasped such that the user's fingers can depress an upper surface of the actuator member 254, thereby allowing the actuator member 254 to be depressed.

Further, FIGS. 11-14 illustrate a locator system 294 that may be used to locate the first adjustment member 272 in the plurality of angular positions represented by FIGS. 15A and 15B, 16A and 16B, and 17A and 17B. In particular, the example lock system 294 comprises at least one locator recess 296 formed on the first adjustment member 172 and at least one locator projection 298 formed on the grip housing 292. In particular, the grip housing 292 defines a housing slot 292*b* through which a grip portion 272*a* of the first adjustment member 272 extends. By pushing on the grip portion 272*a*, the first adjustment member 272 may be rotated through the plurality of angular positions. The locator recess(es) 296 receives a locator projection 298 to positively hold the first adjustment member 272 in one of the plurality of angular positions. The shapes, locations, and relative positions of the locator recess(es) 296 and the locator projection(s) 298 may be altered. One locator recess 296 and three locator projections 298*a*, 298*b*, and 298*c* are employed by the example locator system 294.

In use, the conduit outlet or outlet opening 246 is initially aimed at a test surface and the actuator member 254 is depressed to place the valve assembly 260 in the open configuration to allow the pressurized material 236 to force some of the stored material 234 out of the container 230 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 222.

The process of spraying a test pattern and adjusting the first and second adjustment members 272 and 282 is repeated until the test pattern formed by the dispensed material 222 corresponds to a desired texture pattern that substantially matches the pre-existing texture pattern.

Leaving the first and second adjustment members 272 and 282 as they were when the test texture pattern corresponded to the desired texture pattern, the aerosol dispensing system 220 is then arranged such that the conduit outlet or outlet opening 246 is aimed at the un-textured portion of the target surface. The actuator member 254 is again depressed to place the valve assembly 260 in the open configuration such that the pressurized material 236 forces the stored material 234 out of the container 230 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface in a desired texture pattern that substantially matches a physical appearance of the textured portion. One or more layers of primer and/or paint may next be applied over the cured layer of dispensed material on the target surface.

The following Table C represents example ranges and dimensions for constructing a physical embodiment of a flow adjustment system that may be used as the example first flow adjustment system 270:

TABLE C

| Config. | Units | Example | First Range | Second Range |
|---|---|---|---|---|
| First Angular Position | % Passageway | 100 | 95-100 | 90-100 |
| | Square Inches | .00385 | 0.00424-0.00347 | 0.00578-0.00193 |
| Second Angular Position. | % Passageway | 60 | 55-65 | 40-70 |
| | Square Inches | .00230 | 0.00253-0.00207 | 0.00345-0.00115 |
| Third Angular Position | % Passageway | 12 | 8-16 | 5-20 |
| | Square Inches | .00045 | 0.00050-0.00041 | 0.00068-0.00023 |

C. Fourth Example Aerosol Dispensing System

Referring now to FIGS. 18-22 of the drawing, depicted at 320 therein is a fourth example aerosol dispensing system constructed in accordance with, and embodying, the principles of the present invention. Like the first example aerosol dispensing system 20, the fourth example dispensing system 320 is adapted to spray droplets of dispensed material 322 onto a target surface (not shown). In the example use of the dispensing system 320 depicted in FIGS. 18-22, the dispensed material 322 is or contains texture material, and the dispensing system 320 is being used to form a coating on an un-textured portion of the target surface having a desired texture pattern that substantially matches a pre-existing texture pattern of a textured portion of the target surface.

Figure 18:
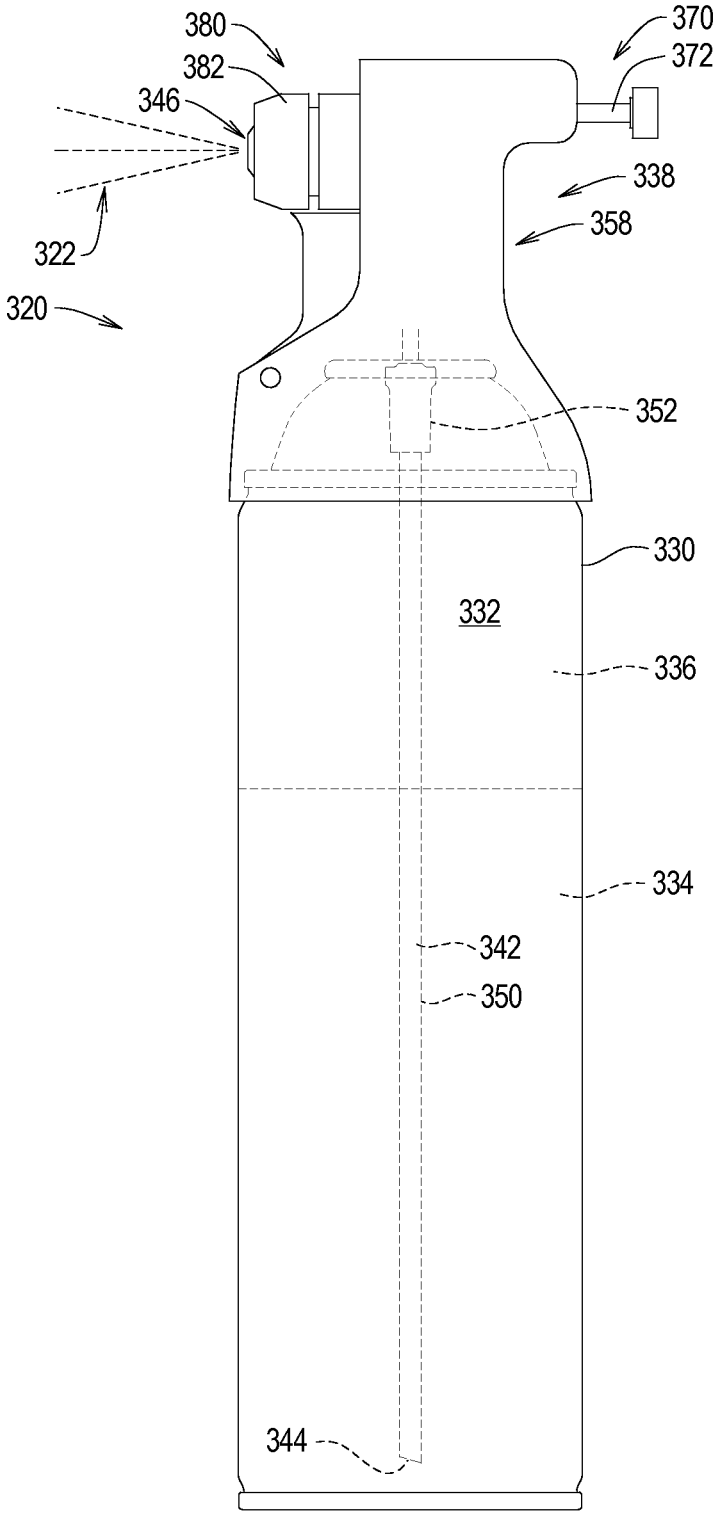
FIG. 18 is a side elevation view of a fourth example aerosol texturing system of the present invention.

FIG. 18 illustrates that the example dispensing system 320 comprises a container 330 defining a chamber 332 in which stored material 334 and pressurized material 336 are contained. Like the stored material 34 described above, the stored material 334 is a mixture of texture material and propellant material in liquid phase, while the pressurized material is propellant material in gas phase. An actuator assembly 338 is mounted on the container assembly 330 to facilitate the dispensing of the dispensed material 322 as will be described in further detail below.

Figure 19:
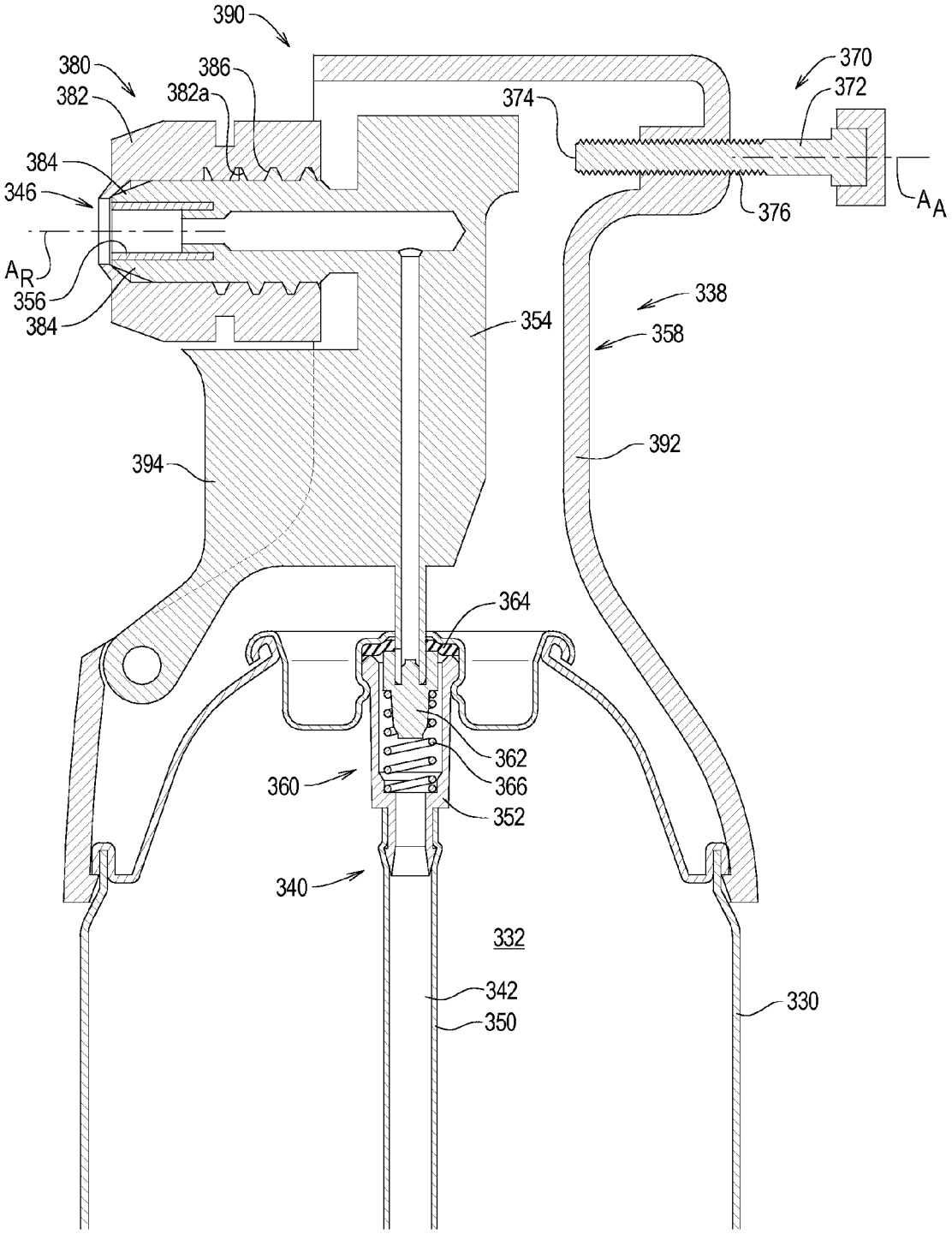
FIG. 19 is a side elevation section view of an actuator member and first and second adjustment systems of the fourth example aerosol texturing system, with the actuator member in a closed position.

FIG. 19 illustrates that the second example aerosol dispensing system 320 comprises a conduit 340 defining a conduit passageway 342. The conduit 340 is supported by the container 330 such that the conduit passageway 342 defines a conduit inlet 344 arranged within the chamber 332 and a conduit outlet or outlet opening 346 arranged outside of the chamber 332. The example conduit 340 is formed by an inlet tube 350, a valve housing 352, an actuator member 354, and an outlet member 356. The conduit passageway 342 extends through the inlet tube 350, the valve housing 352, the actuator member 354, and the outlet member 356. The valve housing 352 is arranged between the conduit inlet 344 and the actuator member 354, and the actuator member 354 is arranged between the valve housing 352 and the conduit outlet 346. The outlet member 356 is supported by the actuator member 354 to define the conduit outlet 346. A grip assembly 358 is supported by the container assembly 330, and the grip assembly 358 in turn supports the actuator member 354 for movement relative to the container assembly 330.

Arranged within the valve housing 352 is a valve assembly 360. The example valve assembly 360 comprises a valve member 362, a valve seat 364, and a valve spring 366. The valve assembly 360 operates in a closed configuration and an open configuration. In the closed configuration, the valve spring 366 forces the valve member 362 against the valve seat 364 such that the valve assembly 360 substantially prevents flow of fluid along the conduit passageway 342. In the open configuration, the valve member 362 is displaced away from the valve seat 364 against the force of the valve spring 366 such that the valve assembly 360 allows flow of fluid along the conduit passageway 342 between the valve member 362 and the valve seat 364. Because the valve spring 366 biases the valve member 362 towards the valve seat 364, the example valve assembly 360 is normally closed. The valve assembly 360 engages the actuator member structure 354 such that the application of deliberate manual force on the actuator member 354 towards the container 330 moves the valve member 362 away from the valve seat 364 and thus places the valve system 360 in the open configuration.

A first flow adjustment system 370 comprising a first adjustment member 372 is arranged selectively to limit movement of the actuator member 354 relative to the container assembly 330. In particular, the first adjustment member defines an adjustment axis $A_A$ and a stop surface 374.

Figure 20:
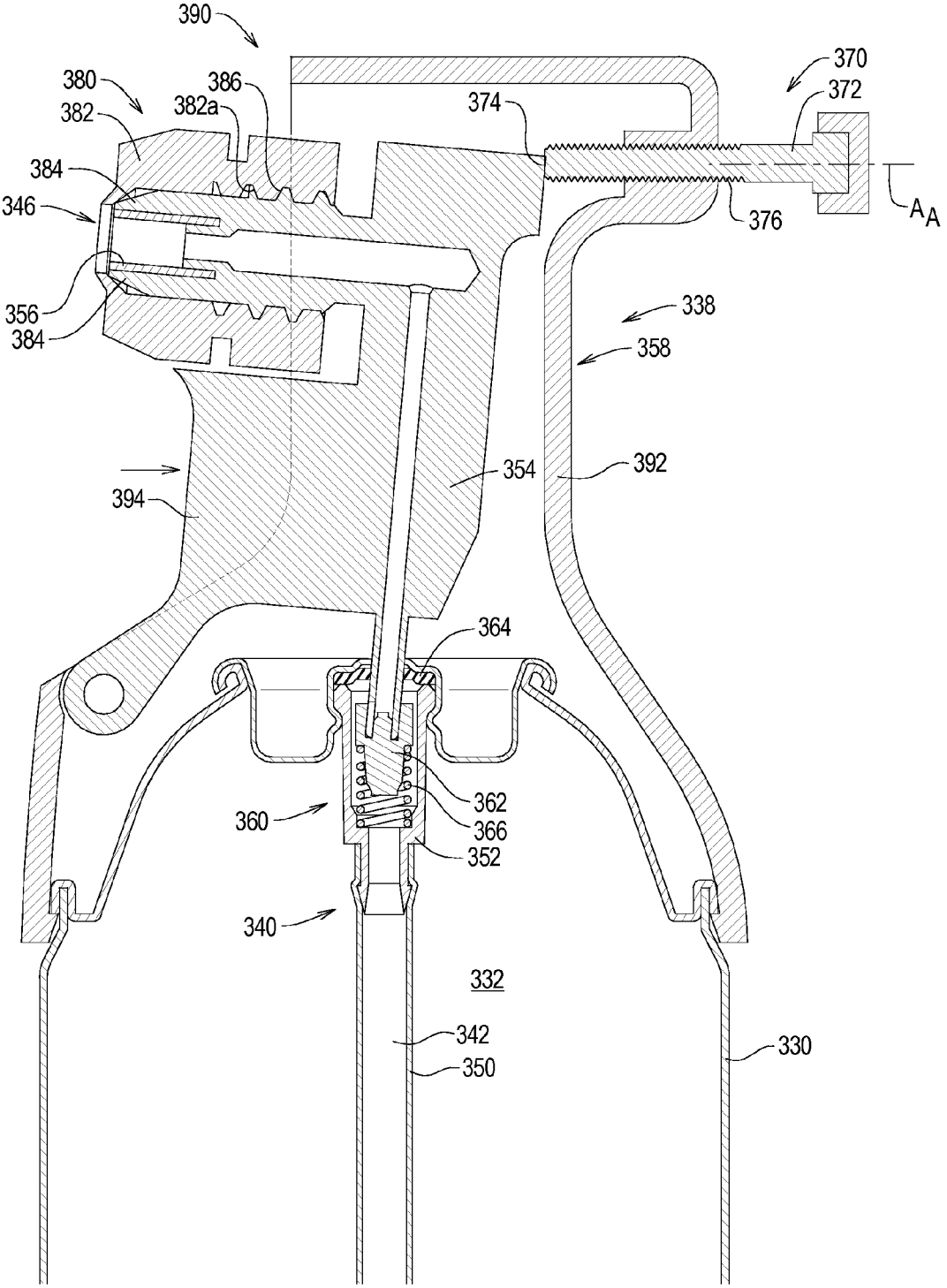
FIG. 20 is a side elevation section view of the actuator member and first and second adjustment systems of the fourth example aerosol texturing system, with the first adjustment system in a fully open configuration and the actuator member in a fully open position.
Figure 21:
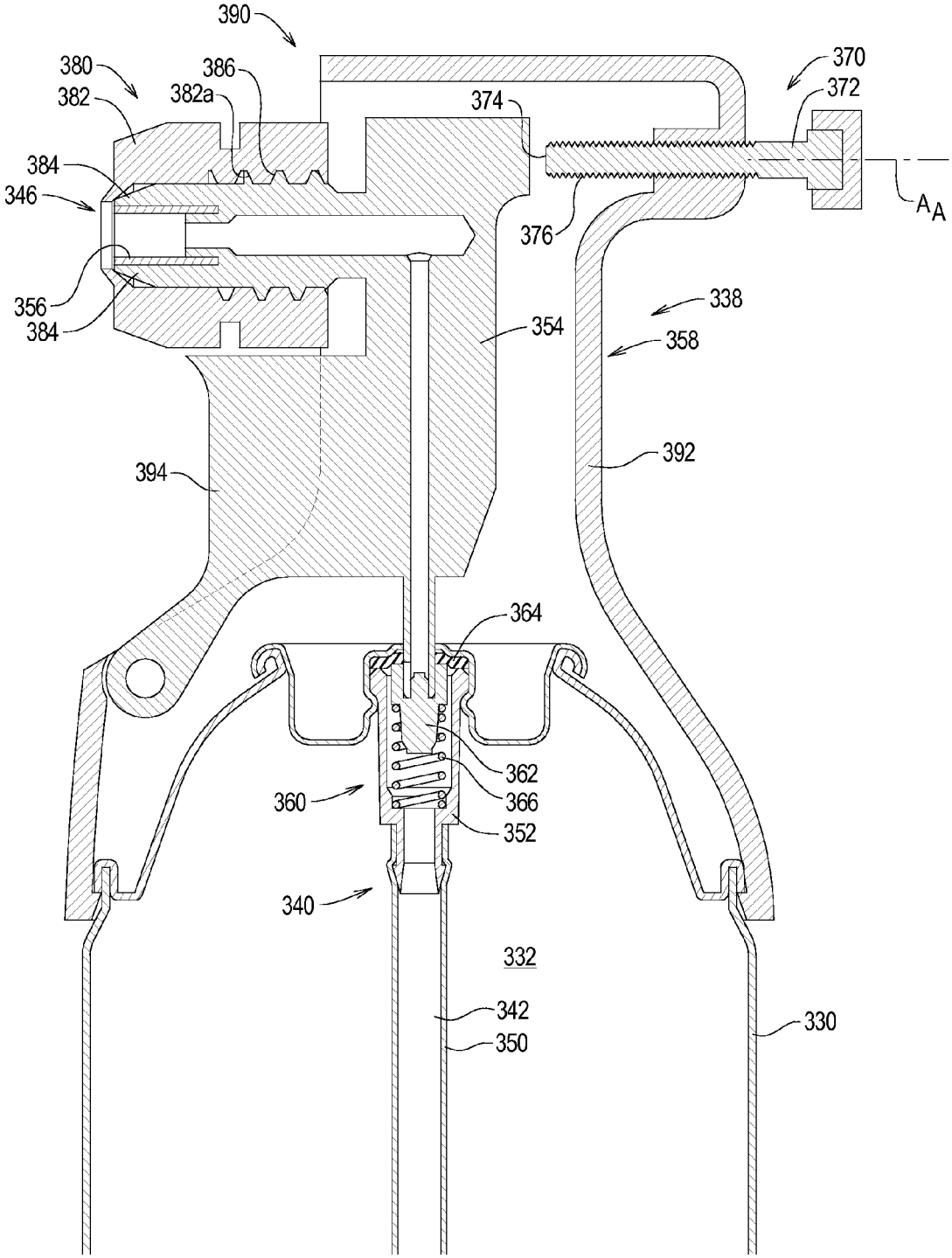
FIG. 21 is a side elevation section view of the actuator member and first and second adjustment systems of the fourth example aerosol texturing system, with the first adjustment system in an intermediate configuration and the actuator member in a closed position.
Figure 22:
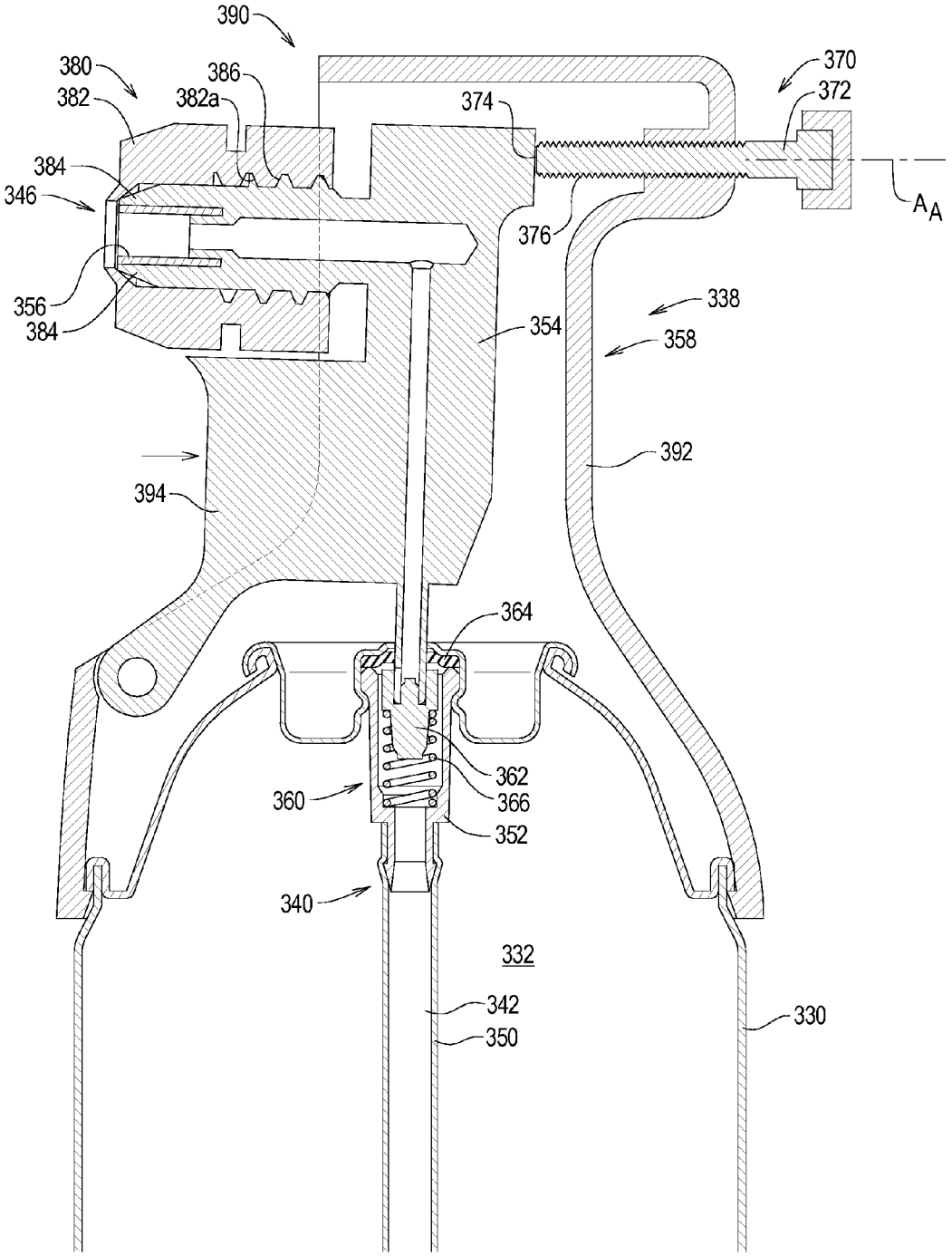
FIG. 22 is a side elevation section view of the actuator member and first and second adjustment systems of the fourth example aerosol texturing system, with the first adjustment system in a fully open configuration and the actuator member in an intermediate position.

Rotation of the first adjustment member 372 about the adjustment axis $A_A$ relative to the grip assembly 358 thus alters a position of the stop surface 374 relative to the actuator member 354. In particular, the first adjustment member 372 defines an externally threaded surface 376 adapted to engage a similar internally threaded surface defined by the grip assembly 358. Rotating the first adjustment member 372 displaces the first adjustment member 372 towards and away from the actuator member 354 between a fully open position and a terminal position. In a first position as shown in FIGS. 19 and 20, the actuator member 354 travels a first distance relative to the valve assembly 360. With the first adjustment member 372 in a second position as shown in FIGS. 21 and 22, the actuator member 354 travels a second distance relative to the valve assembly 360. The first distance is longer than the second distance as can be seen by a close inspection of FIGS. 20 and 22, so the valve system 360, in cooperation with the first adjustment system 370, thus forms a smaller restriction in the conduit passageway 342 when the first adjustment member 372 is in the first position than when the first adjustment member 372 is in the second position.

Further, the first adjustment member 372 is configurable in any one of a plurality or continuum of positions between the first and second positions shown. The first adjustment system 370 thus allows the user to obtain a range of restrictions in the conduit passageway as necessary for a particular desired texture pattern.

A second flow adjustment system 380 having a second adjustment member 382 is arranged in the conduit passageway 342 to form at least a portion of the conduit outlet or outlet opening 346. In particular, the second adjustment system 380 comprises, in addition, a plurality of fingers 384 extending from the actuator member 354 and an externally threaded surface 386 formed on the actuator member 354. The second adjustment member 382 defines an internally threaded surface 382*a* that is adapted to engage the externally threaded surface 386 such that rotation of the second adjustment member 382 about an axis of rotation $A_R$ displaces the adjustment member in both directions along the axis of rotation $A_R$. As the second adjustment member 382 is displaced along the axis of rotation $A_R$, the second adjustment member 382 engages the fingers 284 to deform the outlet member 356. Deformation of the outlet member 356 alters a cross-sectional area of the conduit outlet or outlet opening 346. Accordingly, rotation of the second adjustment member 382 relative to the actuator member 354 allows any the cross-sectional area of the outlet opening defined by the conduit outlet 346 to be made larger and/or smaller within a predetermined range of cross-sectional areas.

Manual operation of the first adjustment member 372 affects the flow of fluid material along the conduit passageway 342 upstream of the second adjustment system 380. In particular, the first adjustment system 370 functions as a flow restrictor, where operation of the first adjustment member 372 variably reduces the size of the conduit passageway 342 such that a pressure of the fluid material upstream of the first flow adjustment system 370 is relatively higher than the pressure of the fluid material downstream of the first flow adjustment system 370 (towards the second adjustment system 380).

The second adjustment system 380 is supported by the actuator member 354 downstream of the first adjustment system 370. Adjustment of the first adjustment system 370 (e.g., selecting one of the adjustment openings 384*a*, 384*b*, and 384*c*) thereby affects the flow of fluid material flowing out of the conduit passageway 342. The second adjustment system 380 thus functions as a variable orifice system. Operation of the second adjustment member 372 variably reduces the size of the conduit outlet or outlet opening 346 relative to the size of the conduit passageway 342 upstream of the second adjustment system 380.

The first adjustment member 372 and second adjustment member 382 are supported as described above to define a control system 390. FIG. 19 further shows that the grip assembly 358 comprises a grip housing 392 and that the actuator member 354 defines a trigger portion 394. Additionally, the grip assembly 358 is combined with the control system 390 to form the actuator assembly 338, and the actuator assembly 338 is supported by the container assembly 330 as generally described above. In the example actuator assembly 338, the actuator assembly 338 is pivotably connected to the grip housing 392. Accordingly, to operate the second example aerosol dispensing system 320, the container 330 and grip housing 392 are grasped such that the user's fingers can squeeze the trigger portion 394, thereby allowing the actuator member 354 to be depressed.

In use, the conduit outlet or outlet opening 346 is initially aimed at a test surface and the actuator member 354 is depressed to place the valve assembly 360 in the open configuration such that the pressurized material 336 forces some of the stored material 334 out of the container 330 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 322.

The process of spraying a test pattern and adjusting the first and second adjustment members 372 and 382 is repeated until the test pattern formed by the dispensed material 322 corresponds to a desired texture pattern that substantially matches the pre-existing texture pattern.

Leaving the first and second adjustment members 372 and 382 as they were when the test texture pattern corresponded to the desired texture pattern, the aerosol dispensing system 320 is then arranged such that the conduit outlet or outlet opening 346 is aimed at the un-textured portion of the target surface. The trigger member 394 is again squeezed to place the valve assembly 360 in the open configuration such that the pressurized material 336 forces the stored material 334 out of the container 330 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface in a desired texture pattern that substantially matches a physical appearance of the textured portion. One or more layers of primer and/or paint may next be applied over the cured layer of dispensed material on the target surface.

The following Table D represents example ranges and dimensions for constructing a physical embodiment of a flow adjustment system that may be used as the example first flow adjustment system 370:

TABLE D

| Config. | Units | Example | First Range | Second Range |
|---|---|---|---|---|
| Fully Open Position | % Passageway | 100 | 95-100 | 90-100 |
| | Square Inches | .00385 | 0.00424-0.00347 | 0.00578-0.00193 |
| Terminal Position | % Passageway | 12 | 8-16 | 5-20 |
| | Square Inches | .00045 | 0.00050-0.00041 | 0.00068-0.00023 |

II. Second Example Class of Aerosol Dispensing Systems

Figure 23:
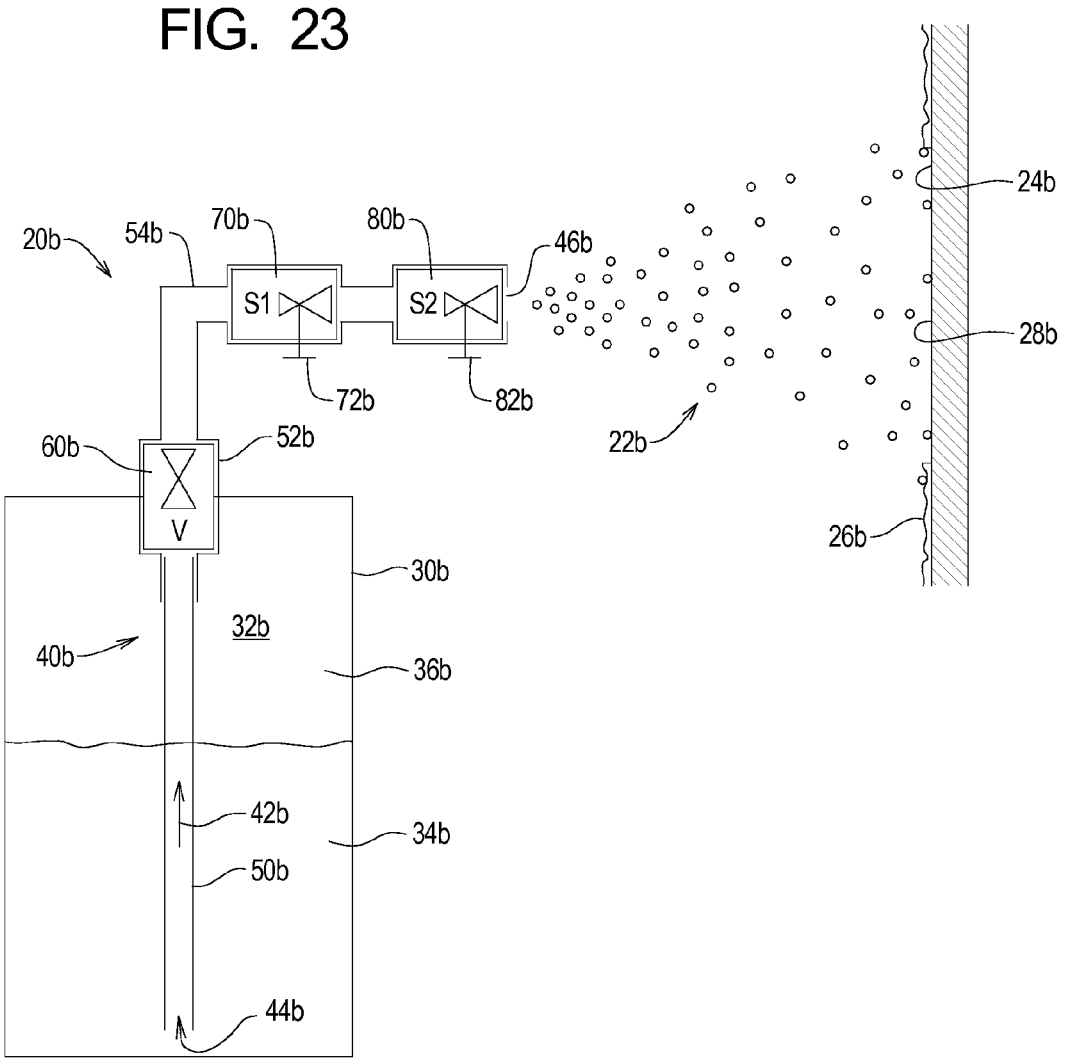
FIG. 23 schematically represents a second example general class of aerosol texturing system of the present invention.

Referring now to FIG. 23 of the drawing, depicted at 20*b* therein is a fifth example aerosol dispensing system constructed in accordance with, and embodying, the principles of the present invention. The fifth example dispensing system is adapted to spray droplets of dispensed material 22*b* onto a target surface 24*b*. The example target surface 24*b* has a textured portion 26*b* and an un-textured portion 28*b*. Accordingly, in the example use of the dispensing system 20*b* depicted in FIG. 23, the dispensed material 22*b* is or contains texture material, and the dispensing system 20*b* is being used to form a coating on the un-textured portion 28*b* having a desired texture pattern that substantially matches a pre-existing texture pattern of the textured portion 26*b*.

FIG. 23 further illustrates that the example dispensing system 20*b* comprises a container 30*b* defining a chamber 32*b* in which stored material 34*b* and pressurized material 36*b* are contained. The stored material 34*b* is a mixture of texture material and propellant material in liquid phase, while the pressurized material is propellant material in gas phase.

A typical texture material forming a part of the dispensed material 22*b* and/or stored material 34*b* will comprise a base or carrier, a binder, a filler, and, optionally, one or more additives such as surfactants, biocides and thickeners. Examples of the base or carrier include water, solvent (oil-based texture material) such as xylene, toluene, acetone, methyl ethyl ketone, and combinations of water and water soluble solvents. Examples of binders include starch, polyvinyl alcohol and latex resins (water-based systems) and a wide variety of polymers such as ethylene vinyl acetate, thermoplastic acrylics, styrenated alkyds, etc. (solvent-based systems). Examples of fillers include calcium carbonate, titanium dioxide, attapulgite clay, talc, magnesium aluminum silicate, etc.

The stored material 34*b* will also comprise a liquid phase propellant material, and the pressurized material will typically comprise a gas phase propellant material. The following propellant materials are appropriate for use as the propellant material forming the stored material 34*b* and the pressurized material 36*b*: dimethyl ether, propane, butane, isobutene, difluoroethane, and tetrafluoroethane.

The following Tables E-1, E-2, and E-3 contain example formulations of the texture material that may be used to form the dispensed material 22*b* and stored material 34*b* of the second example aerosol dispensing 20*b*:

TABLE E-1

(Solvent Based)

| Material | Purpose | First Example | Second Example | Third Example |
|---|---|---|---|---|
| Solvent | Base | 35% | 30-40% | 20-60% |
| Pigment | Filler | 60% | 55-65% | 40-80% |
| Resin | Binder | 2.5% | 1-5% | 0.5-15% |

To the example texture material described in Table E-1 is added 10-20% by weight of propellant material in the form of a propane/butane/isobutane blend.

TABLE E-2

(Knockdown)

| Material | Purpose | First Example | Second Example | Third Example |
|---|---|---|---|---|
| Water | Base | 48% | 45-55% | 40-60% |
| Pigment | Filler | 50% | 45-55% | 40-60% |
| Resin | Binder | 2% | 1-5% | 0.5-10% |

To the example texture material described in Table E-2 is added 7-15% by weight of propellant material in the form of DME.

TABLE E-3

(No Prime)

| Material | Purpose | First Example | Second Example | Third Example |
|---|---|---|---|---|
| Water | Base | 42% | 40-50% | 30-60% |
| Pigment | Filler | 47% | 40-50% | 30-60% |
| Resin | Binder | 10% | 5-15% | 2.5-20% |

To the example texture material described in Table E-3 is added 10-15% by weight of propellant material in the form of DME.

FIG. 23 further illustrates that the first example aerosol dispensing system 20*b* comprises a conduit 40*b* defining a conduit passageway 42*b*. The conduit 40*b* is supported by the container 30*b* such that the conduit passageway 42*b* defines a conduit inlet 44*b* arranged within the chamber 32*b* and a conduit outlet 46*b* arranged outside of the chamber 32*b*. The conduit outlet 46*b* may alternatively be referred to herein as an outlet opening 46*b*. The example conduit 40*b* is formed by an inlet tube 50*b*, a valve housing 52*b*, and an actuator structure 54*b*. The conduit passageway 42*b* extends through the inlet tube 50*b*, the valve housing 52*b*, and the actuator structure 54*b* such that the valve housing 52*b* is arranged between the conduit inlet 44*b* and the actuator structure 54*b* and the actuator structure 54*b* is arranged between the valve housing 52*b* and the conduit outlet 46*b*.

Arranged within the valve housing 52*b* is a valve system 60*b*. A first flow adjustment system 70*b* having a first adjustment member 72*b* is arranged to interface with the valve system 60*b*. A second flow adjustment system 80*b* having a second adjustment member 82*b* is arranged in the conduit passageway 42*b* to form at least a portion of the conduit outlet 46*b*.

The valve system 60*b* operates in a closed configuration, a fully open configuration, and at least one of a continuum or plurality of partially open intermediate configurations. In the closed configuration, the valve system 60*b* substantially prevents flow of fluid along the conduit passageway 42*b*. In the open configuration and the at least one intermediate configuration, the valve system 60*b* allows flow of fluid along the conduit passageway 42*b*. The valve system 60*b* is normally in the closed configuration. The valve system 60*b* engages the actuator member structure 54*b* and is placed into the open configuration by applying deliberate manual force on the actuator structure 54*b* towards the container 30*b*.

The first flow adjustment system 70*b* is supported by the container 30*b* to engage the actuator structure such that manual operation of the first adjustment member 72*b* controls the flow of fluid material along the conduit passageway 42*b*. In particular, the first adjustment system 70*b* functions as a flow restrictor, where operation of the first adjustment member 72*b* results in a variation in the size of a portion of the conduit passageway 42*b* such that a pressure of the fluid material upstream of the first flow adjustment system 70*b* is relatively higher than the pressure of the fluid material downstream of the first flow adjustment system 70*b*.

In general, a primary purpose of the first flow adjustment system 70*b* is to alter a distance of travel of the dispensed material 22*b*. The first flow adjustment system 70*b* may also have a secondary affect on the pattern in which the dispensed material 22*b* is sprayed.

The second adjustment system 80*b* is supported by the actuator structure 54*b* downstream of the first adjustment system 70*b*. Manual operation of the second adjustment member 82*b* affects the flow of fluid material flowing out of the conduit passageway 42*b* through the conduit outlet 46*b*. In particular, the second adjustment system 80*b* functions as a variable orifice, where operation of the second adjustment member 72*b* variably reduces the size of the conduit outlet 46*b* relative to the size of the conduit passageway 42*b* upstream of the second adjustment system 80*b*.

A primary purpose of the second flow adjustment system 80*b* is to alter a pattern in which the dispensed material 22*b* is sprayed. The first flow adjustment system 70*b* may also have a secondary affect on the distance of travel of the dispensed material 22*b*.

To operate the fifth example aerosol dispensing system 20*b* (of the second example class of dispensing systems), the container 30*b* is grasped such that the finger can depress the actuator structure 54*b*. The conduit outlet or outlet opening 46*b* is initially aimed at a test surface and the actuator structure 54*b* is depressed to place the valve system 60*b* in the open configuration such that the pressurized material 36*b* forces some of the stored material 34*b* out of the container 30*b* and onto the test surface to form a test texture pattern. The test texture pattern is compared to the pre-existing texture pattern defined by the textured portion 26*b* of the target surface 24*b*. If the test texture pattern does not match the pre-existing texture pattern, one or both of the first and second adjustment systems 70*b* and 80*b* are adjusted to alter the spray pattern of the droplets of dispensed material 22*b*.

The process of spraying a test pattern and comparing it to the pre-existing pattern and adjusting the first and second adjustment members 72*b* and 82*b* is repeated until the dispensed material forms a desired texture pattern that substantially matches the pre-existing texture pattern.

Leaving the first and second adjustment systems 70*b* and 80*b* as they were when the test texture pattern matched the pre-existing texture pattern, the aerosol dispensing system 20*b* is then arranged such that the conduit outlet or outlet opening 46*b* is aimed at the un-textured portion 28*b* of the target surface 24*b*. The actuator structure 54*b* is again depressed to operate the valve system 60*b* such that the pressurized material 36*b* forces the stored material 34*b* out of the container 30*b* and onto the un-textured portion 28*b* of the target surface to form the desired texture pattern.

A. Sixth Example Aerosol Dispensing System

Referring now to FIGS. 24-27 of the drawing, depicted at 420 therein is a sixth example aerosol dispensing system constructed in accordance with, and embodying, the principles of the present invention. Like the fifth example aerosol dispensing system 20*b*, the sixth example dispensing system is adapted to spray droplets of dispensed material 422 onto a target surface (not shown). In the example use of the dispensing system 420 depicted in FIG. 24, the dispensed material 422 is or contains texture material, and the dispensing system 420 is being used to form a coating on an un-textured portion of the target surface having a desired texture pattern that substantially matches a pre-existing texture pattern of a textured portion of the target surface.

Figure 24:
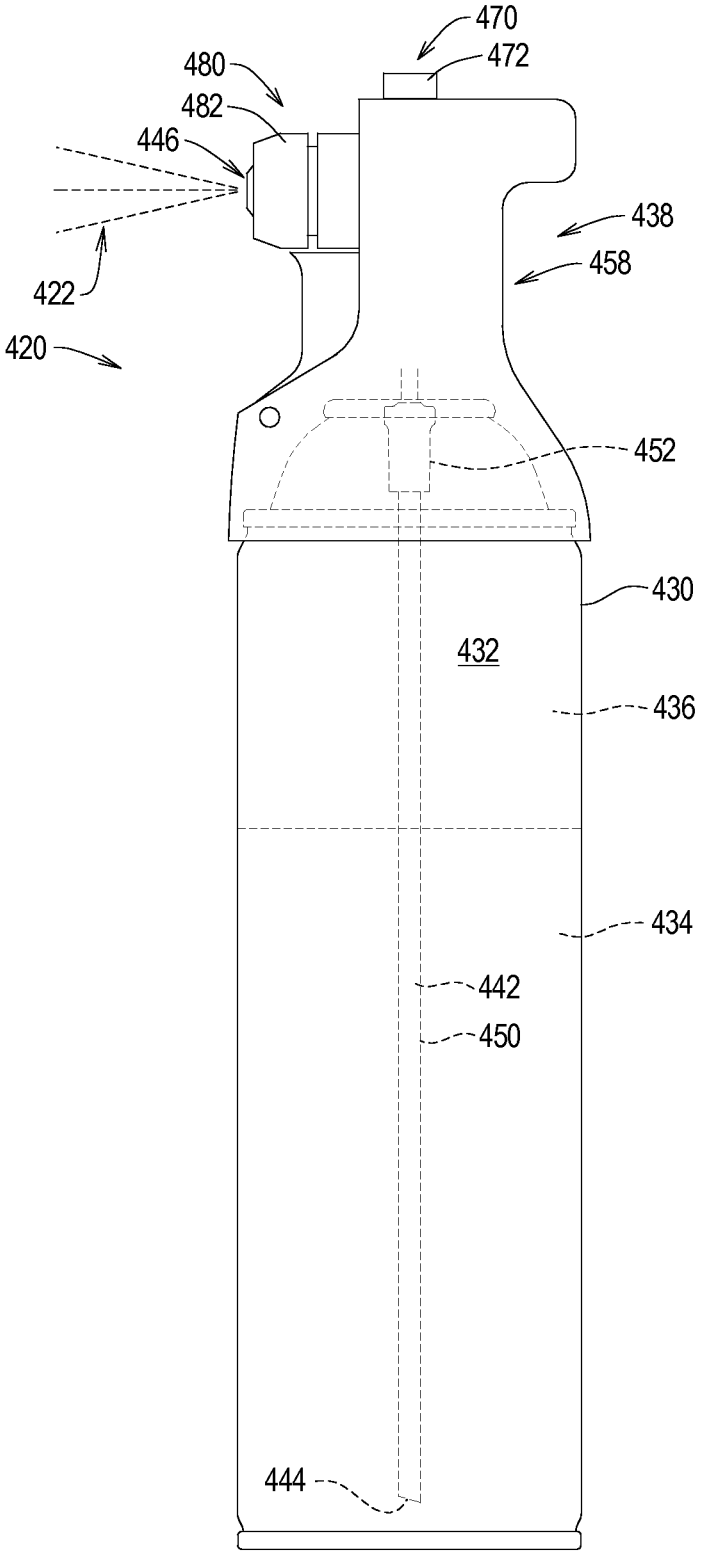
FIG. 24 is a side elevation view of a fifth example aerosol texturing system of the present invention.

FIG. 24 further illustrates that the example dispensing system 420 comprises a container 430 defining a chamber 432 in which stored material 434 and pressurized material 436 are contained. Like the stored materials (e.g., stored materials 34*a* and 34*b*) described above, the stored material 434 is a mixture of texture material and propellant material in liquid phase, while the pressurized material is propellant material in gas phase. An actuator assembly 438 is mounted on the container assembly 430 to facilitate the dispensing of the dispensed material 422 as will be described in further detail below.

Figure 25:
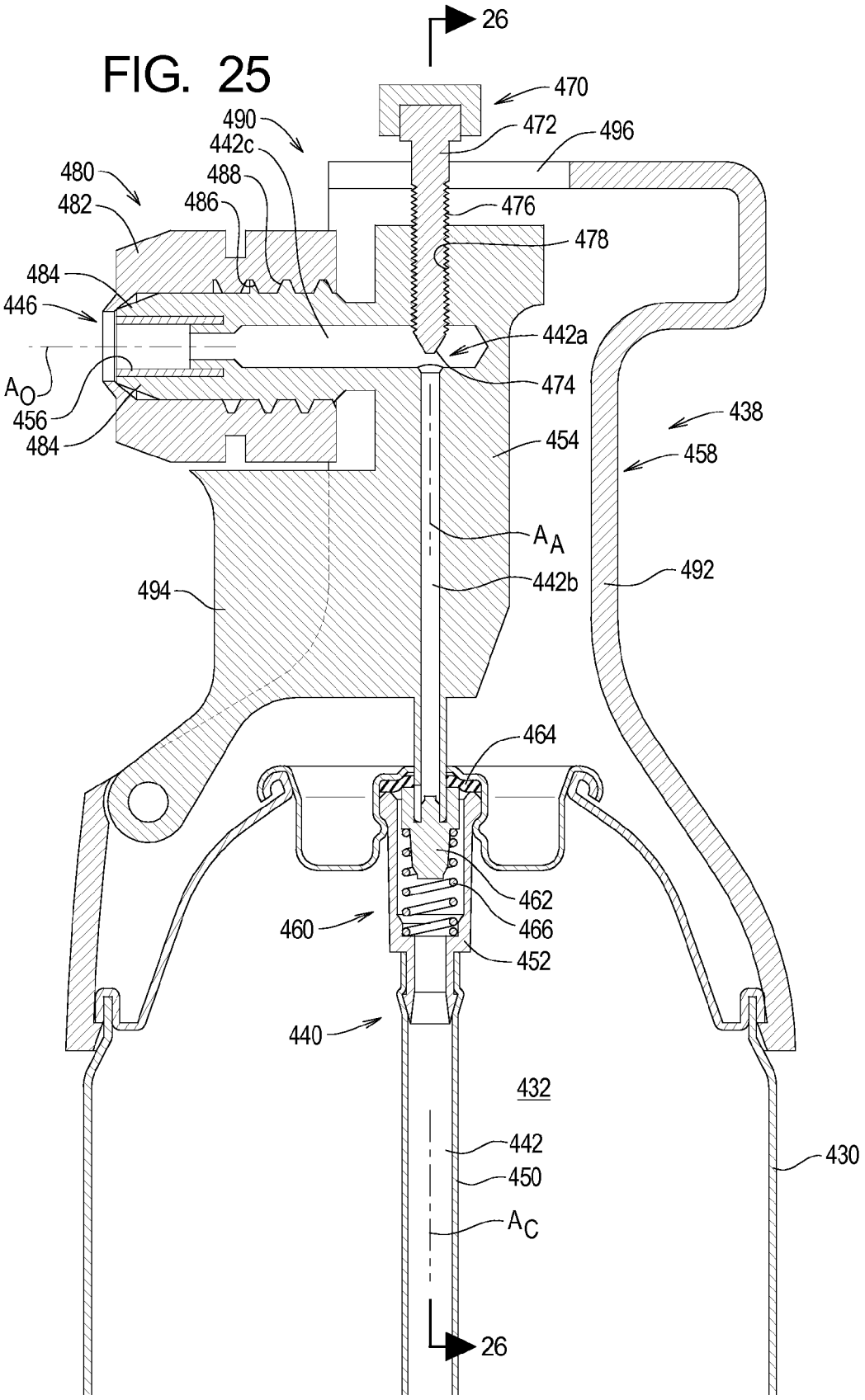
FIG. 25 is a side elevation section view of an actuator member and first and second adjustment systems of the fifth example aerosol texturing system taken along lines 25-25 in FIG. 26, with the actuator member in a closed position.
Figure 26:
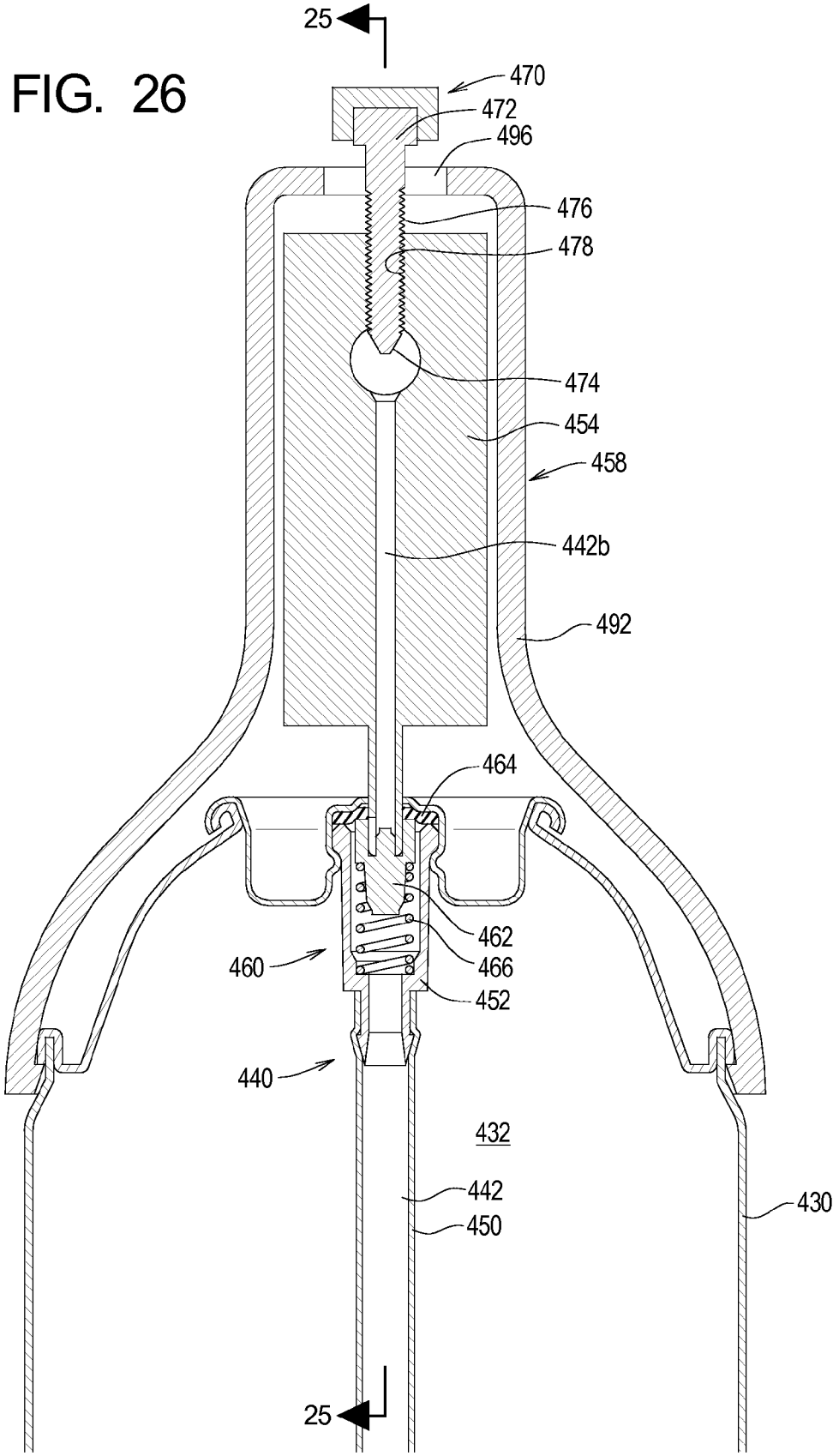
FIG. 26 is a front elevation section view of an actuator member and first adjustment system of the fifth example aerosol texturing system taken along lines 26-26 in FIG. 25, with the actuator member in a closed position and the first example adjustment system in an intermediate configuration.

FIG. 25 illustrates that the sixth example aerosol dispensing system 420 comprises a conduit 440 defining a conduit passageway 442. The conduit 440 is supported by the container 430 such that the conduit passageway 442 defines a conduit inlet 444 arranged within the chamber 432 and a conduit outlet or outlet opening 446 arranged outside of the chamber 432. The example conduit 440 is formed by an inlet tube 450, a valve housing 452, an actuator member 454, and an outlet member 456. The conduit passageway 442 extends through the inlet tube 450, the valve housing 452, the actuator member 454, and the outlet member 456. The valve housing 452 is arranged between the conduit inlet 444 and the actuator member 454, and the actuator member 454 is arranged between the valve housing 452 and the conduit outlet 446. The outlet member 456 is supported by the actuator member 454 to define the conduit outlet 446.

FIG. 25 further shows that a valve assembly 460 is formed within the valve housing 452. The example valve assembly 460 comprises a valve member 462, a valve seat 464, and a valve spring 466. The valve assembly 460 operates in a closed configuration and an open configuration. In the closed configuration, the valve spring 466 forces the valve member 462 against the valve seat 464 such that the valve assembly 460 substantially prevents flow of fluid along the conduit passageway 442. In the open configuration, the valve member 462 is displaced away from the valve seat 464 against the force of the valve spring 466 such that the valve assembly 460 allows flow of fluid along the conduit passageway 442 between the valve member 462 and the valve seat 464. Because the valve spring 466 biases the valve member 462 towards the valve seat 464, the example valve assembly 460 is normally closed. As will be described in further detail below, the valve assembly 460 engages the actuator member structure 454 such that the application of deliberate manual force on the actuator member 454 towards the container 430 moves the valve member 462 away from the valve seat 464 and thus places the valve system 460 in the open configuration.

A first flow adjustment system 470 having a first adjustment member 472 having a valve surface 474 and an externally threaded surface 476 is arranged to intersect the conduit passageway 442 at an intermediate location 442*a* between the valve assembly 460 and the conduit outlet 446. The conduit passageway has a first portion 442*b* and a second portion 442*c*. The first passageway portion 442*b* defines an actuator axis $A_A$ aligned with a container axis $A_C$ defined by the container assembly 430, and the second actuator passageway portion is aligned with an outlet axis $A_O$ defined by the outlet member 456. The example intermediate location 442*a* is located in the second passageway portion 442*c*.

An internally threaded surface 478 is formed in the actuator member 454. The threaded surfaces 476 and 478 are adapted to engage each other such that rotation of the first adjustment member 472 relative to the actuator member 454 causes the valve surface 474 to enter the conduit passageway and thus alter a cross-sectional area of the conduit passageway 442 between the valve system 460 and the second flow adjustment system 480.

A second flow adjustment system 480 comprises a second adjustment member 482 and a plurality of fingers 484 extending from the actuator member 454. The second flow adjustment system 480 is arranged relative to the conduit passageway 442 to form at least a portion of the conduit outlet (or outlet opening) 446. The second adjustment member 482 defines an internal threaded surface 486 that engages an external threaded surface 488 of the actuator member 454 such that rotation of the second adjustment member 482 relative to the actuator member 454 deforms the fingers and thus the outlet member 456, thereby altering a cross-sectional area of the conduit outlet or outlet opening 446.

The first flow adjustment system 470 is supported by the actuator member 454 between the valve assembly 460 and the second adjustment system 480 such that manual operation of the first adjustment member 472 affects the flow of fluid material along the conduit passageway 442. In particular, the second adjustment system 480 functions as a flow restrictor, where operation of the first adjustment member 472 variably reduces the size of the conduit passageway 442 such that a pressure of the fluid material upstream of the first flow adjustment system 470 is relatively higher than the pressure of the fluid material downstream of the first flow adjustment system 470. The example first adjustment member 472 is movable between a fully open configuration (smallest amount of restriction) and a terminal configuration (largest amount of restriction).

The second adjustment system 480 is supported by the actuator member 454 downstream of the first adjustment system 470. The outlet member 456 is a resiliently deformable tube, and manual operation of the second adjustment member 482 deforms the walls of the outlet member 456 and thereby affects the flow of fluid material flowing out of the conduit passageway 442 through the conduit outlet or outlet opening 446. The second adjustment system 480 thus functions as a variable orifice. Operation of the second adjustment member 482 variably reduces the size of the conduit outlet or outlet opening 446 relative to the size of the conduit passageway 442 upstream of the second adjustment system 480.

The outlet member 456, first adjustment member 472, and second adjustment member 482 are supported by the actuator member 454 to define a control assembly 490. FIG. 25 further shows that the grip assembly 458 comprises a grip housing 492 and that the actuator member 454 defines a trigger portion 494. To form the actuator assembly 438, the grip assembly 458 is combined with the control assembly 490 by pivotably attaching the actuator member 454 to the grip housing 492. The actuator assembly 438 is supported by the container assembly 430 as generally described above. An elongated slot 496 is formed in the grip housing 492 to allow the second adjustment member 482 to extend through the grip housing 492 without interfering with operation of the actuator member 454 as described herein.

To operate the sixth example aerosol dispensing system 420, the container 430 and grip housing 492 are grasped such that the user's fingers can squeeze the trigger portion 494, thereby depressing the actuator member 454. The conduit outlet or outlet opening 446 is initially aimed at a test surface and the actuator member 454 is depressed to place the valve assembly 460 in the open configuration such that the pressurized material 436 forces some of the stored material 434 out of the container 430 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 422.

The process of spraying a test pattern and adjusting the first and second adjustment members 472 and 482 is repeated until the test pattern formed by the dispensed material 422 corresponds to a desired texture pattern that substantially matches the pre-existing texture pattern.

Leaving the first and second adjustment members 472 and 482 as they were when the test texture pattern corresponded to the desired texture pattern, the aerosol dispensing system 420 is then arranged such that the conduit outlet or outlet opening 446 is aimed at the un-textured portion of the target surface. The trigger member 494 is again squeezed to place the valve assembly 460 in the open configuration such that the pressurized material 436 forces the stored material 434 out of the container 430 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface in a desired texture pattern that substantially matches a physical appearance of the textured portion. One or more layers of primer and/or paint may next be applied over the cured layer of dispensed material.

The following Table F represents example ranges and dimensions for constructing a physical embodiment of a flow adjustment system that may be used as the example first flow adjustment system 470:

TABLE F

| Config. | Units | Example | First Range | Second Range |
|---|---|---|---|---|
| Fully Open | % Passageway | 100 | 95-100 | 90-100 |
| | Square Inches | .00385 | 0.00424-0.00347 | 0.00578-0.00193 |
| Terminal | % Passageway | 12 | 8-16 | 5-20 |
| | Square Inches | .00045 | 0.00050-0.00041 | 0.00068-0.00023 |

B. Seventh Example Aerosol Dispensing System

Referring now to FIGS. 28-31 of the drawing, depicted at 520 therein is a seventh example aerosol dispensing system constructed in accordance with, and embodying, the principles of the present invention. Like the fifth example aerosol dispensing system 20*b*, the seventh example dispensing system is adapted to spray droplets of dispensed material 522 onto a target surface (not shown). In the example use of the dispensing system 520 depicted in FIG. 28, the dispensed material 522 is or contains texture material, and the dispensing system 520 is being used to form a coating on an untextured portion of the target surface having a desired texture pattern that substantially matches a pre-existing texture pattern of a textured portion of the target surface.

Figure 28:
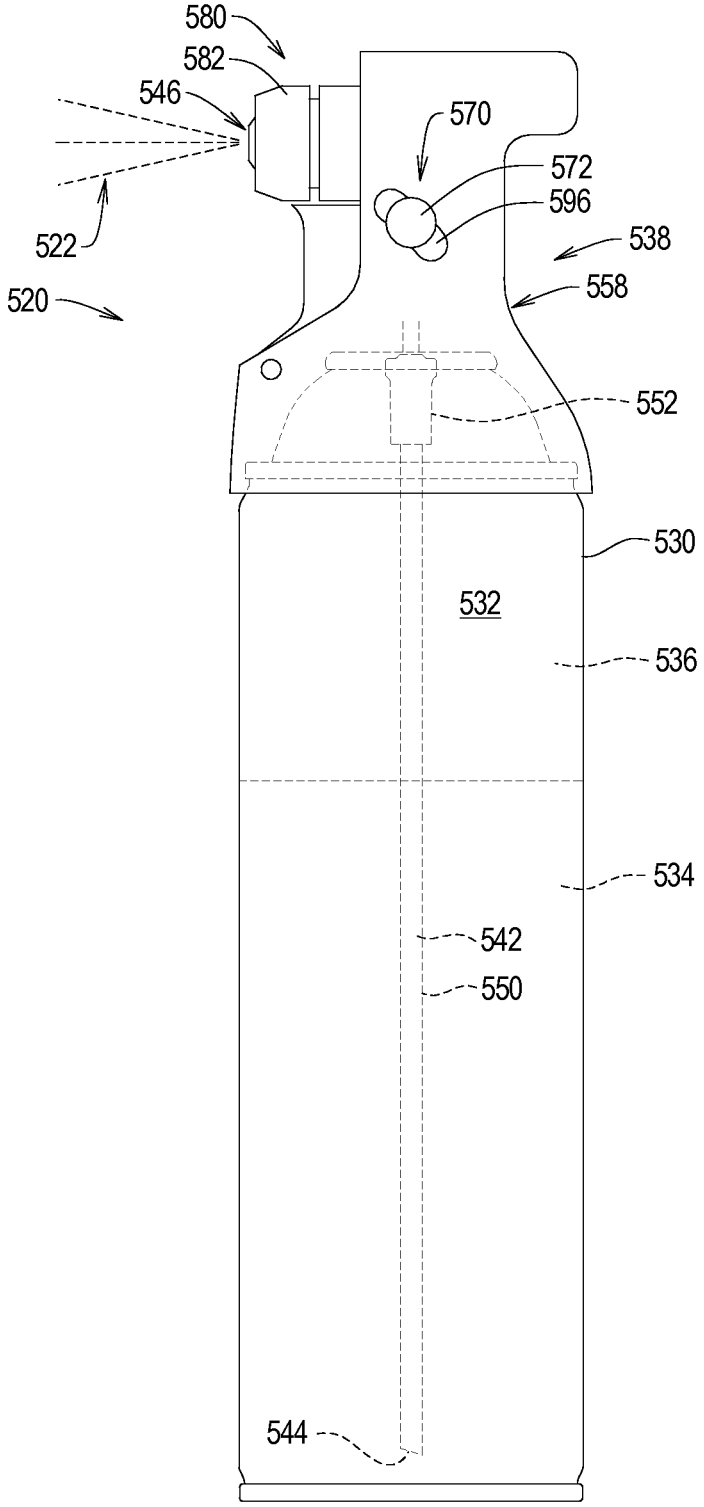
FIG. 28 is a side elevation view of a sixth example aerosol texturing system of the present invention.

FIG. 28 further illustrates that the example dispensing system 520 comprises a container 530 defining a chamber 532 in which stored material 534 and pressurized material 536 are contained. Like the stored materials (e.g. 34*a* and 34*b*) described above, the stored material 534 is a mixture of texture material and propellant material in liquid phase, while the pressurized material is propellant material in gas phase. An actuator assembly 538 is mounted on the container assembly 530 to facilitate the dispensing of the dispensed material 522 as will be described in further detail below.

Figure 29:
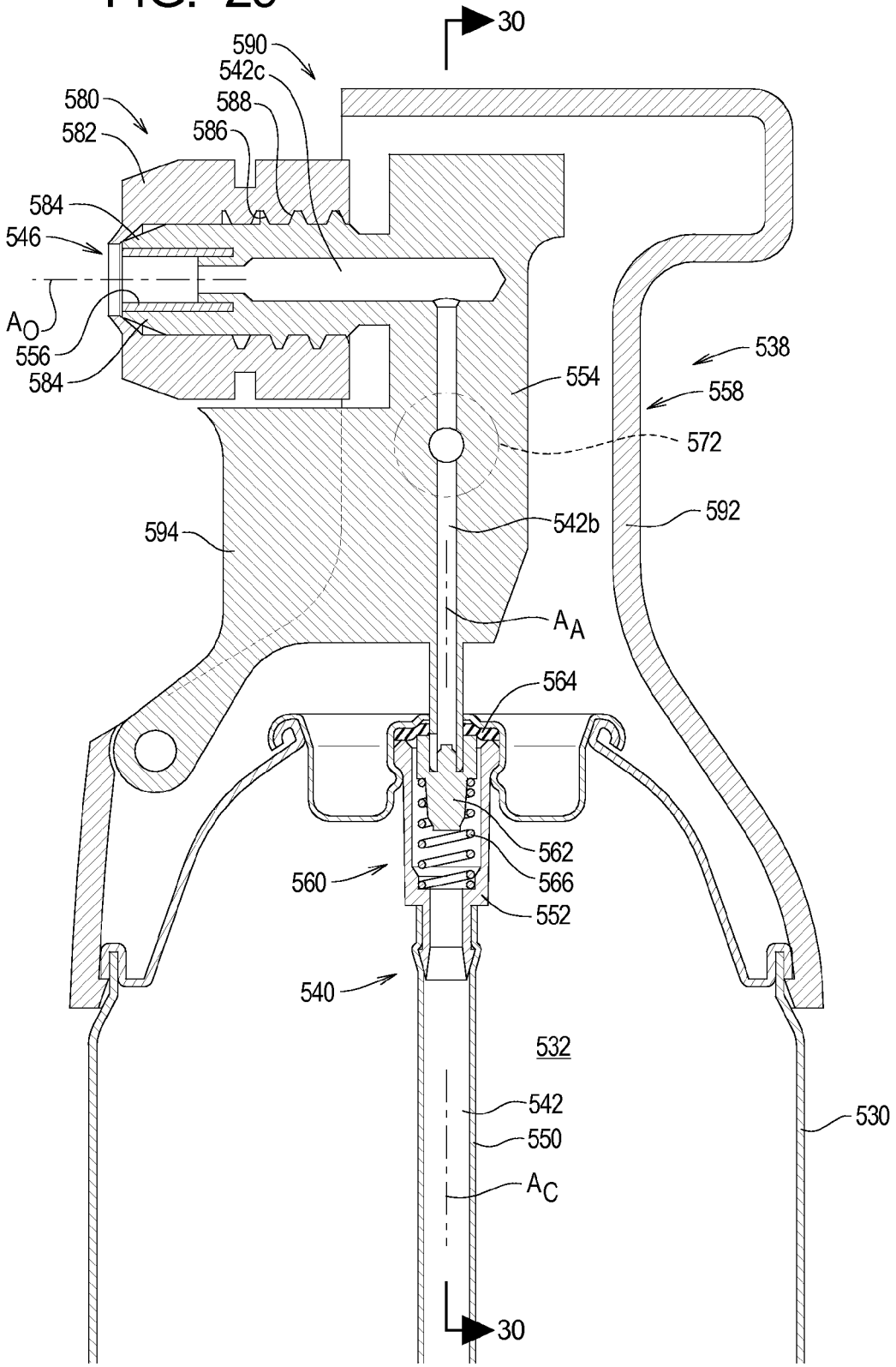
FIG. 29 is a side elevation section view of an actuator member and first and second adjustment systems of the sixth example aerosol texturing system taken along lines 29-29 in FIG. 30, with the actuator member in a closed position.
Figure 30:
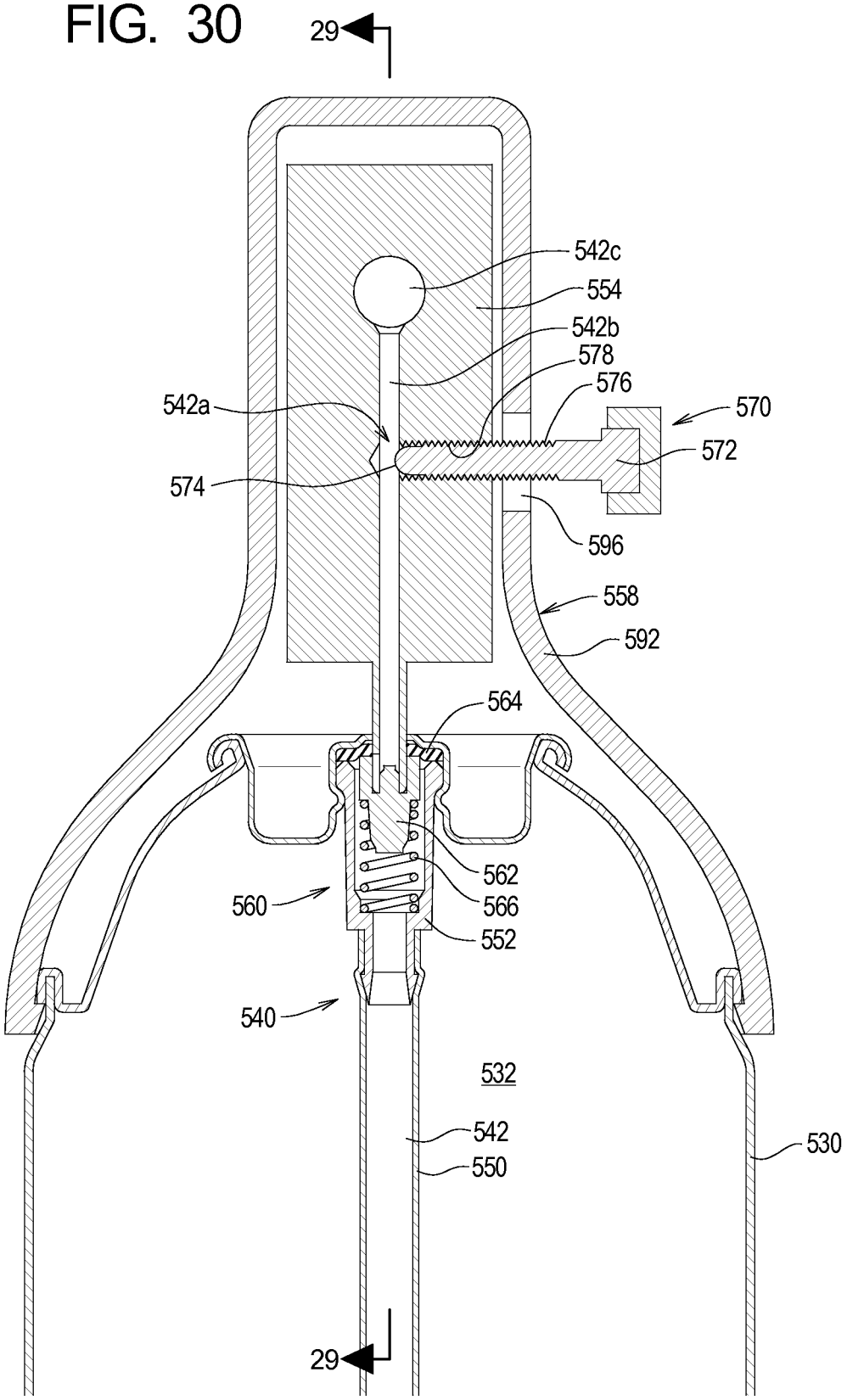
FIG. 30 is a front elevation section view of an actuator member and first adjustment system of the sixth example aerosol texturing system taken along lines 26-26 in FIG. 25, with the actuator member in a closed position and the first example adjustment system in an intermediate configuration.
Figure 31:
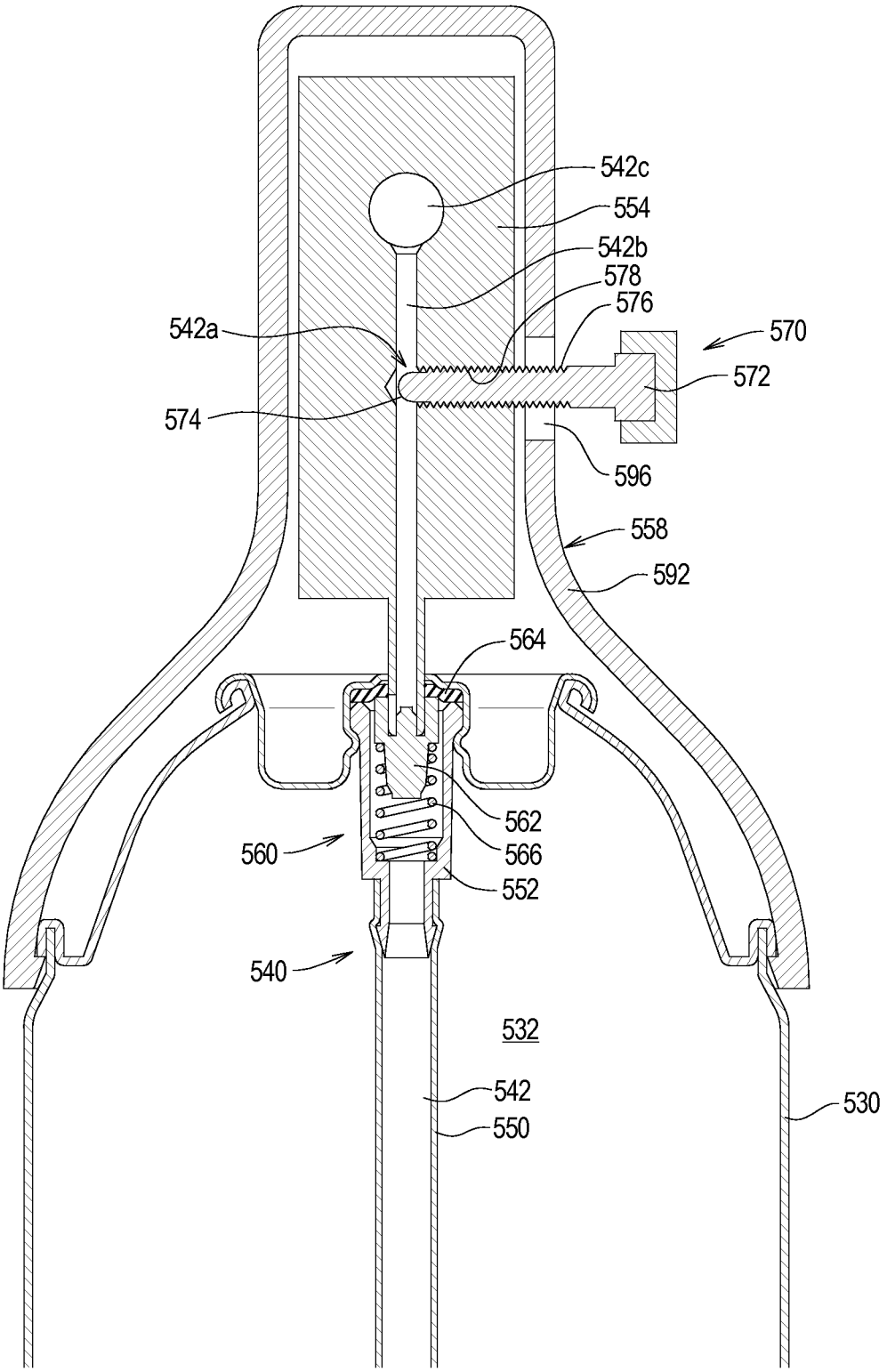
FIG. 31 is a side elevation section view of an actuator member and first adjustment systems of the sixth example aerosol texturing system, with the actuator member in a closed position and the first example adjustment system in a terminal configuration.

FIG. 29 illustrates that the seventh example aerosol dispensing system 520 comprises a conduit 540 defining a conduit passageway 542. The conduit 540 is supported by the container 530 such that the conduit passageway 542 defines a conduit inlet 544 arranged within the chamber 532 and a conduit outlet or outlet opening 546 arranged outside of the chamber 532. The example conduit 540 is formed by an inlet tube 550, a valve housing 552, an actuator member 554, and an outlet member 556. The conduit passageway 542 extends through the inlet tube 550, the valve housing 552, the actuator member 554, and the outlet member 556. The valve housing 552 is arranged between the conduit inlet 544 and the actuator member 554, and the actuator member 554 is arranged between the valve housing 552 and the conduit outlet 546. The outlet member 556 is supported by the actuator member 554 to define the conduit outlet 546.

FIG. 29 further shows that a valve assembly 560 is formed within the valve housing 552. The example valve assembly 560 comprises a valve member 562, a valve seat 564, and a valve spring 566. The valve assembly 560 operates in a closed configuration and an open configuration. In the closed configuration, the valve spring 566 forces the valve member 562 against the valve seat 564 such that the valve assembly 560 substantially prevents flow of fluid along the conduit passageway 542. In the open configuration, the valve member 562 is displaced away from the valve seat 564 against the force of the valve spring 566 such that the valve assembly 560 allows flow of fluid along the conduit passageway 542 between the valve member 562 and the valve seat 564. Because the valve spring 566 biases the valve member 562 towards the valve seat 564, the example valve assembly 560 is normally closed. As will be described in further detail below, the valve assembly 560 engages the actuator member structure 554 such that the application of deliberate manual force on the actuator member 554 towards the container 530 moves the valve member 562 away from the valve seat 564 and thus places the valve system 560 in the open configuration.

A first flow adjustment system 570 having a first adjustment member 572 having a valve surface 574 and an externally threaded surface 576 is arranged to intersect the conduit passageway 542 at an intermediate location 542*a* between the valve assembly 560 and the conduit outlet 546. The conduit passageway has a first portion 542*b* and a second portion 542*c*. The first passageway portion 542*b* defines an actuator axis $A_A$ aligned with a container axis $A_C$ defined by the container assembly 530, and the second actuator passageway portion 542*c* is aligned with an outlet axis $A_O$ defined by the outlet member 556. The example intermediate location 542*a* is located in the first passageway portion 542*b*.

An internally threaded surface 578 is formed in the actuator member 554. The threaded surfaces 576 and 578 are adapted to engage each other such that rotation of the first adjustment member 572 relative to the actuator member 554 causes the valve surface 574 to enter the conduit passageway 542 and thus alter a cross-sectional area of the conduit passageway 542 between the valve system 560 and the second flow adjustment system 580.

A second flow adjustment system 580 comprises a second adjustment member 582 and a plurality of fingers 584 extending from the actuator member 554. The second flow adjustment system 580 is arranged relative to the conduit passageway 542 to form at least a portion of the conduit outlet (or outlet opening) 546. The second adjustment member 582 defines an internal threaded surface 586 that engages an external threaded surface 588 of the actuator member 554 such that rotation of the second adjustment member 582 relative to the actuator member 554 deforms the fingers and thus the outlet member 556, thereby altering a cross-sectional area of the conduit outlet or outlet opening 546.

The first flow adjustment system 570 is supported by the actuator member 554 between the valve assembly 560 and the second adjustment system 580 such that manual operation of the first adjustment member 572 affects the flow of fluid material along the conduit passageway 542 as generally described above. In particular, the second adjustment system 580 functions as a flow restrictor, where operation of the first adjustment member 572 variably reduces the size of the conduit passageway 542 such that a pressure of the fluid material upstream of the first flow adjustment system 570 is relatively higher than the pressure of the fluid material downstream of the first flow adjustment system 570. The least amount of restriction created by the first flow adjustment system 570 is associated with a fully open configuration, while the least amount of restriction created by the first flow adjustment system 570 is associated with a terminal configuration.

The second adjustment system 580 is supported by the actuator member 554 downstream of the first adjustment system 570. The outlet member 556 is a resiliently deformable tube, and manual operation of the second adjustment member 582 deforms the walls of the outlet member 556 and thereby affects the flow of fluid material flowing out of the conduit passageway 542 through the conduit outlet or outlet opening 546. The second adjustment system 580 thus functions as a variable orifice. Operation of the second adjustment member 582 variably reduces the size of the conduit outlet or outlet opening 546 relative to the size of the conduit passageway 542 upstream of the second adjustment system 580.

Figure 27:
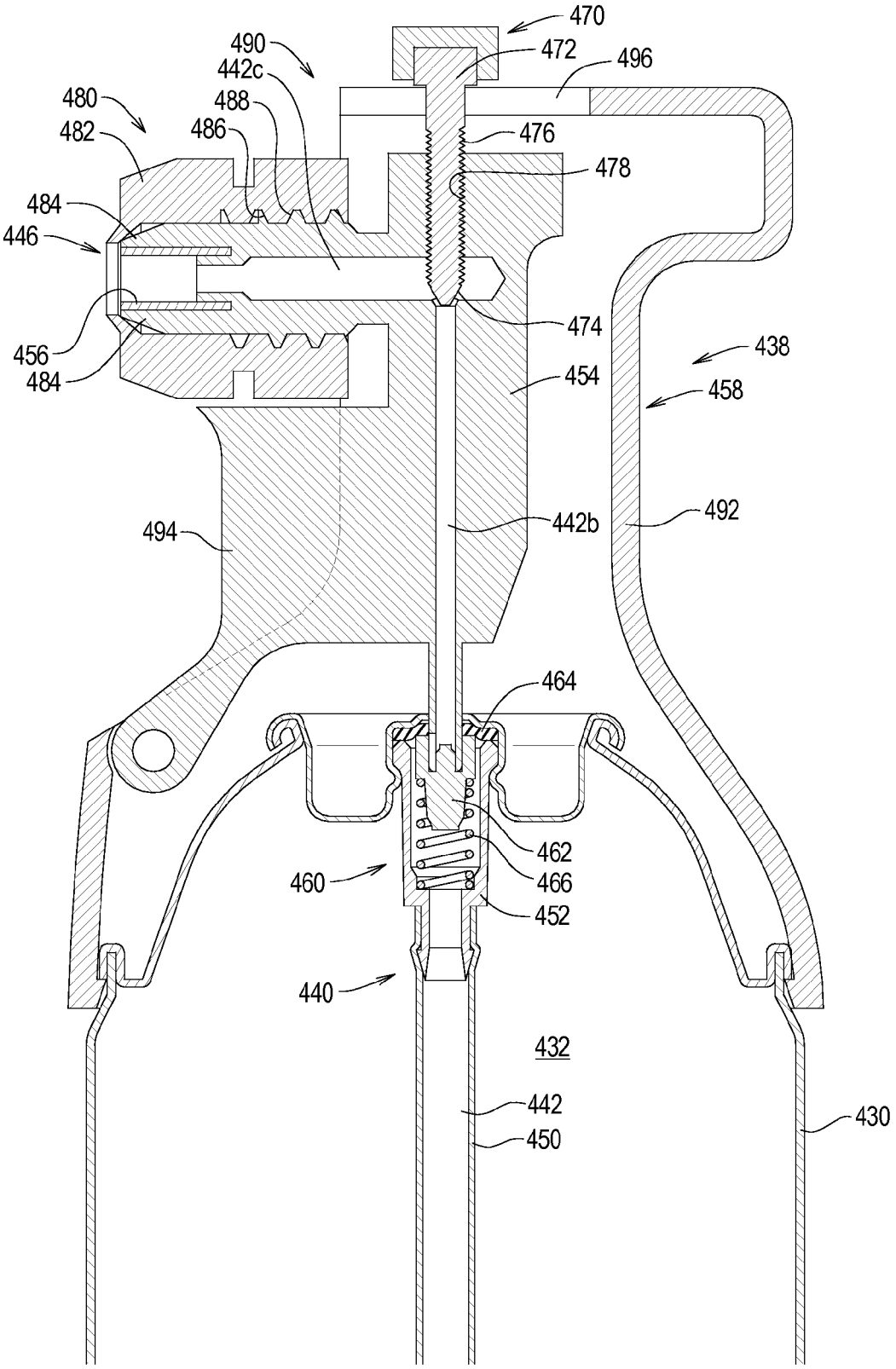
FIG. 27 is a side elevation section view of an actuator member and first and second adjustment systems of the fifth example aerosol texturing system, with the actuator member in a closed position and the first example adjustment system in a terminal configuration.

The outlet member 556, first adjustment member 572, and second adjustment member 582 are supported by the actuator member 554 to define a control assembly 590. FIG. 27 further shows that the grip assembly 558 comprises a grip housing 592 and that the actuator member 554 defines a trigger portion 594. To form the actuator assembly 538, the grip assembly 558 is combined with the control assembly 590 by pivotably attaching the actuator member 554 to the grip housing 592. The actuator assembly 538 is supported by the container assembly 530 as generally described above. An elongated slot 596 is formed in the grip housing 592 to allow the second adjustment member 582 to extend through the grip housing 592 without interfering with operation of the actuator member 554 as described herein.

To operate the seventh example aerosol dispensing system 520, the container 530 and grip housing 592 are grasped such that the user's fingers can squeeze the trigger portion 594, thereby depressing the actuator member 554. The conduit outlet or outlet opening 546 is initially aimed at a test surface and the actuator member 554 is depressed to place the valve assembly 560 in the open configuration such that the pressurized material 536 forces some of the stored material 534 out of the container 530 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 522.

The process of spraying a test pattern and adjusting the first and second adjustment members 572 and 582 is repeated until the test pattern formed by the dispensed material 522 corresponds to a desired texture pattern that substantially matches the pre-existing texture pattern.

Leaving the first and second adjustment members 572 and 582 as they were when the test texture pattern corresponded to the desired texture pattern, the aerosol dispensing system 520 is then arranged such that the conduit outlet or outlet opening 546 is aimed at the un-textured portion of the target surface. The trigger member 594 is again squeezed to place the valve assembly 560 in the open configuration such that the pressurized material 536 forces the stored material 534 out of the container 530 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface in a desired texture pattern that substantially matches a physical appearance of the textured portion. One or more layers of primer and/or paint may next be applied over the cured layer of dispensed material.

The following Table G represents example ranges and dimensions for constructing a physical embodiment of a flow adjustment system that may be used as the example first flow adjustment system 570:

TABLE G

| Config. | Units | Example | First Range | Second Range |
|---|---|---|---|---|
| Fully Open | % Passageway | 100 | 95-100 | 90-100 |
| | Square Inches | .00385 | 0.00424-0.00347 | 0.00578-0.00193 |
| Terminal | % Passageway | 12 | 8-16 | 5-20 |
| | Square Inches | .00045 | 0.00050-0.00041 | 0.00068-0.00023 |

C. Eighth Example Aerosol Dispensing System

Figure 32:
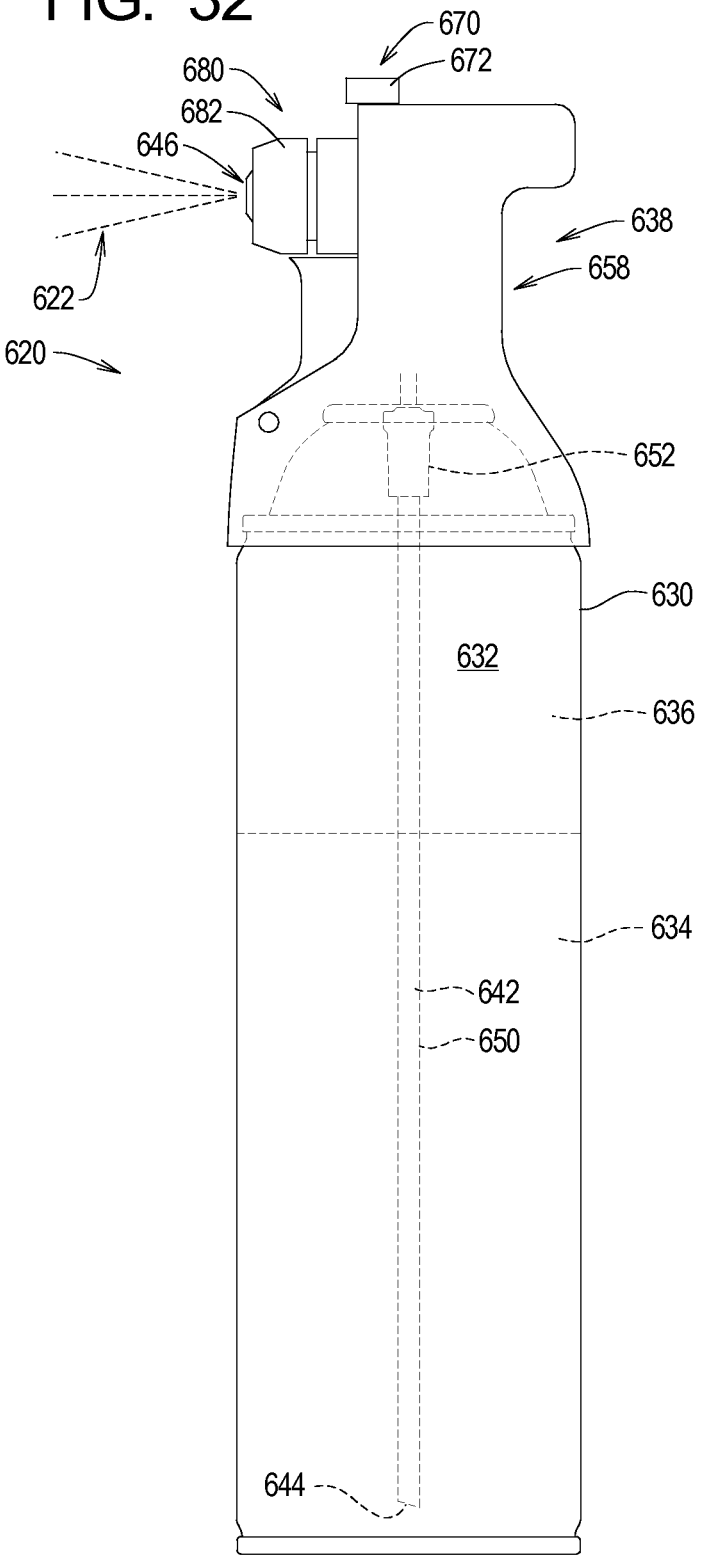
FIG. 32 is a side elevation view of a seventh example aerosol texturing system of the present invention.
Figure 33:
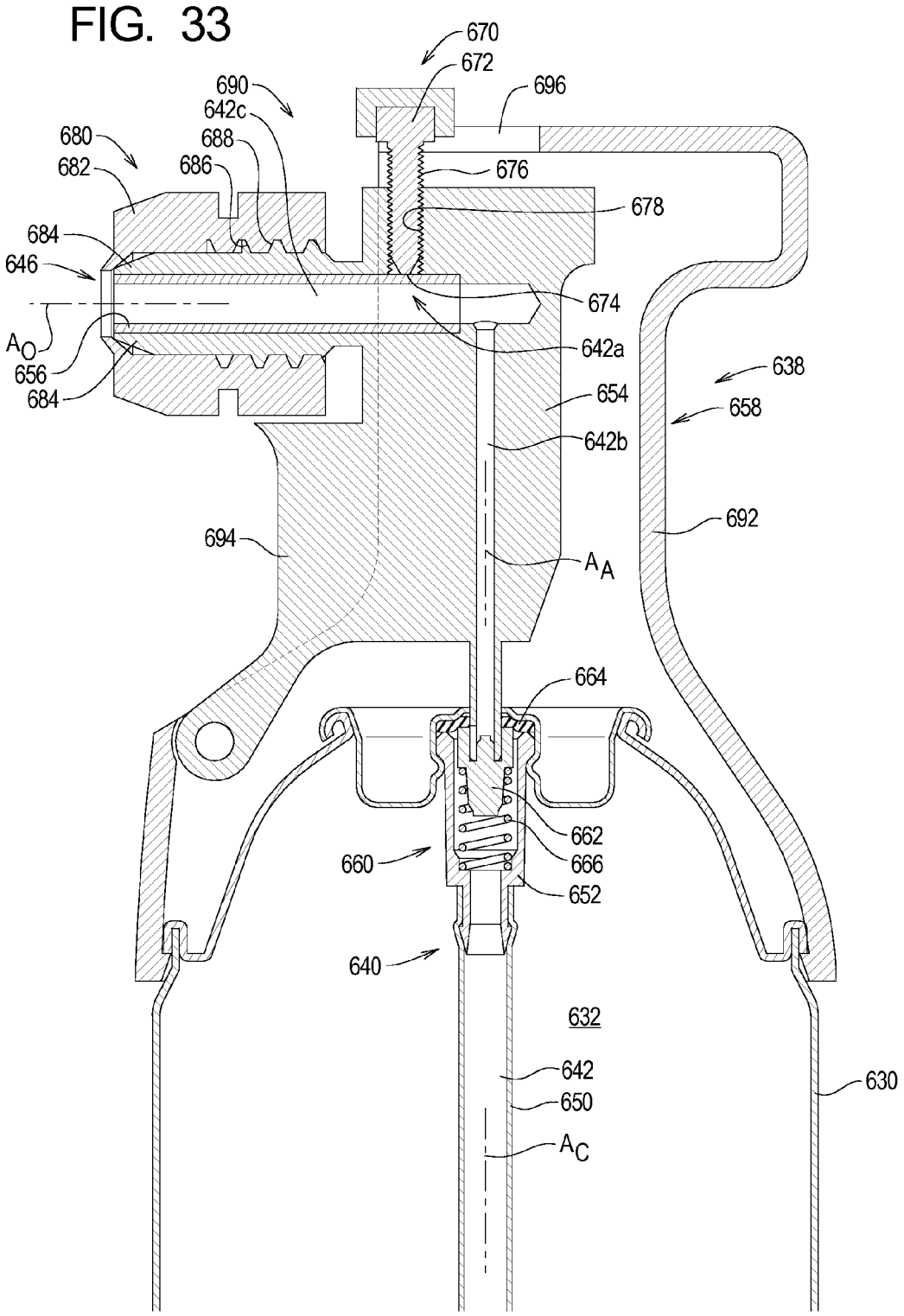
FIG. 33 is a side elevation section view of an actuator member and first and second adjustment systems of the seventh example aerosol texturing system, with the first adjustment system in a fully open configuration and the actuator member in a closed position.
Figure 34:
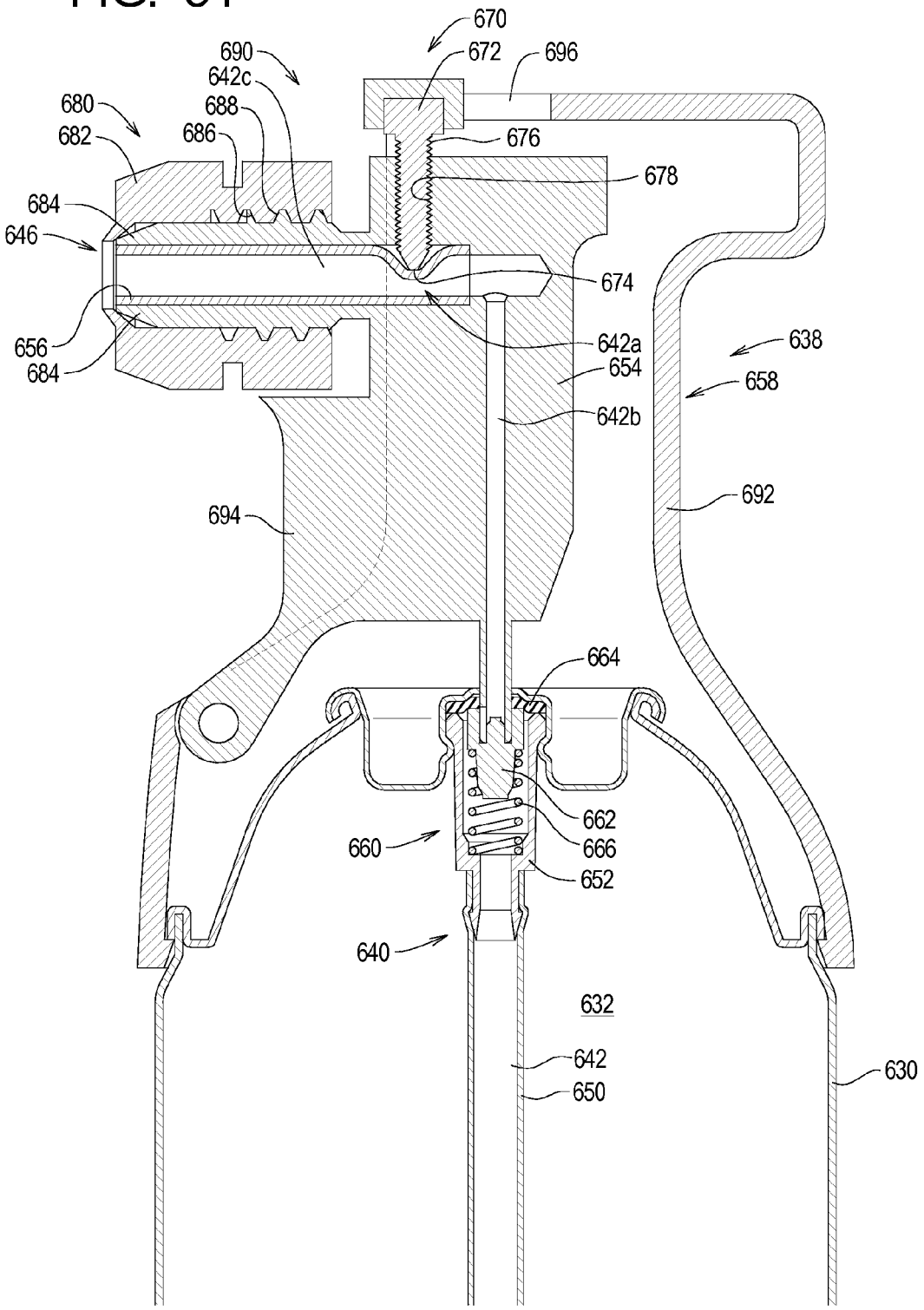
FIG. 34 is a side elevation section view of the actuator member and first and second adjustment systems of the seventh example aerosol texturing system, with the first adjustment system in an intermediate configuration and the actuator member in a closed position.

Referring now to FIGS. 32-34 of the drawing, depicted at 620 therein is a eighth example aerosol dispensing system constructed in accordance with, and embodying, the principles of the present invention. Like the fifth example aerosol dispensing system 20*b*, the eighth example dispensing system is adapted to spray droplets of dispensed material 622 onto a target surface (not shown). In the example use of the dispensing system 620 depicted in FIG. 32, the dispensed material 622 is or contains texture material, and the dispensing system 620 is being used to form a coating on an un-textured portion of the target surface having a desired texture pattern that substantially matches a pre-existing texture pattern of a textured portion of the target surface.

FIG. 32 further illustrates that the example dispensing system 620 comprises a container 630 defining a chamber 632 in which stored material 634 and pressurized material 636 are contained. Like the stored materials (e.g., 34*a* and 34*b*) described above, the stored material 634 is a mixture of texture material and propellant material in liquid phase, while the pressurized material is propellant material in gas phase. An actuator assembly 638 is mounted on the container assembly 630 to facilitate the dispensing of the dispensed material 622 as will be described in further detail below.

FIG. 33 illustrates that the eighth example aerosol dispensing system 620 comprises a conduit 640 defining a conduit passageway 642. The conduit 640 is supported by the container 630 such that the conduit passageway 642 defines a conduit inlet 644 arranged within the chamber 632 and a conduit outlet or outlet opening 646 arranged outside of the chamber 632. The example conduit 640 is formed by an inlet tube 650, a valve housing 652, an actuator member 654, and an outlet member 656. The conduit passageway 642 extends through the inlet tube 650, the valve housing 652, the actuator member 654, and the outlet member 656. The valve housing 652 is arranged between the conduit inlet 644 and the actuator member 654, and the actuator member 654 is arranged between the valve housing 652 and the conduit outlet 646. The outlet member 656 is supported by the actuator member 654 to define the conduit outlet 646.

FIG. 33 further shows that a valve assembly 660 is formed within the valve housing 652. The example valve assembly 660 comprises a valve member 662, a valve seat 664, and a valve spring 666. The valve assembly 660 operates in a closed configuration and an open configuration. In the closed configuration, the valve spring 666 forces the valve member 662 against the valve seat 664 such that the valve assembly 660 substantially prevents flow of fluid along the conduit passageway 642. In the open configuration, the valve member 662 is displaced away from the valve seat 664 against the force of the valve spring 666 such that the valve assembly 660 allows flow of fluid along the conduit passageway 642 between the valve member 662 and the valve seat 664. Because the valve spring 666 biases the valve member 662 towards the valve seat 664, the example valve assembly 660 is normally closed. As will be described in further detail below, the valve assembly 660 engages the actuator member structure 654 such that the application of deliberate manual force on the actuator member 654 towards the container 630 moves the valve member 662 away from the valve seat 664 and thus places the valve system 660 in the open configuration.

A first flow adjustment system 670 having a first adjustment member 672 having a valve surface 674 and an externally threaded surface 676 is arranged to intersect the conduit passageway 642 at an intermediate location 642*a* between the valve assembly 660 and the conduit outlet 646. The conduit passageway has a first portion 642*b* and a second portion 642*c*. The first passageway portion 642*b* defines an actuator axis $A_A$ aligned with a container axis $A_C$ defined by the container assembly 630, and the second actuator passageway portion 642*c* is aligned with an outlet axis $A_O$ defined by the outlet member 656. The example intermediate location 642*a* is located in the second passageway portion 642*c*.

An internally threaded surface 678 is formed in the actuator member 654. The threaded surfaces 676 and 678 are adapted to engage each other such that, as shown in FIG. 34, rotation of the first adjustment member 672 relative to the actuator member 654 causes the valve surface 674 to engage and deform the outlet member 656 and thus alter a cross-sectional area of the conduit passageway 642 between the valve system 660 and the second flow adjustment system 680.

A second flow adjustment system 680 comprises a second adjustment member 682 and a plurality of fingers 684 extending from the actuator member 654. The second flow adjustment system 680 is arranged relative to the conduit passageway 642 to form at least a portion of the conduit outlet (or outlet opening) 646. The second adjustment member 682 defines an internal threaded surface 686 that engages an external threaded surface 688 of the actuator member 654 such that rotation of the second adjustment member 682 relative to the actuator member 654 deforms the fingers and thus the outlet member 656, thereby altering a cross-sectional area of the conduit outlet or outlet opening 646.

The first flow adjustment system 670 is supported by the actuator member 654 between the valve assembly 660 and the second adjustment system 680 such that manual operation of the first adjustment member 672 affects the flow of fluid material along the conduit passageway 642 as generally described above. In particular, the second adjustment system 680 functions as a flow restrictor, where operation of the first adjustment member 672 variably reduces the size of the conduit passageway 642 such that a pressure of the fluid material upstream of the first flow adjustment system 670 is relatively higher than the pressure of the fluid material downstream of the first flow adjustment system 670. The first flow adjustment system 670 defines a fully open configuration (smallest restriction) and a terminal configuration (largest restriction).

The second adjustment system 680 is supported by the actuator member 654 downstream of the first adjustment system 670. The outlet member 656 is a resiliently deformable tube, and manual operation of the second adjustment member 682 deforms the walls of the outlet member 656 and thereby affects the flow of fluid material flowing out of the conduit passageway 642 through the conduit outlet or outlet opening 646. The second adjustment system 680 thus functions as a variable orifice. Operation of the second adjustment member 682 variably reduces the size of the conduit outlet or outlet opening 646 relative to the size of the conduit passageway 642 upstream of the second adjustment system 680.

The outlet member 656, first adjustment member 672, and second adjustment member 682 are supported by the actuator member 654 to define a control assembly 690. FIG. 33 further shows that the grip assembly 658 comprises a grip housing 692 and that the actuator member 654 defines a trigger portion 694. To form the actuator assembly 638, the grip assembly 658 is combined with the control assembly 690 by pivotably attaching the actuator member 654 to the grip housing 692. The actuator assembly 638 is supported by the container assembly 630 as generally described above. An elongated slot 696 is formed in the grip housing 692 to allow the first adjustment member 672 to extend through the grip housing 692 without interfering with operation of the actuator member 654 as described herein.

To operate the eighth example aerosol dispensing system 620, the container 630 and grip housing 692 are grasped such that the user's fingers can squeeze the trigger portion 694, thereby depressing the actuator member 654. The conduit outlet or outlet opening 646 is initially aimed at a test surface and the actuator member 654 is depressed to place the valve assembly 660 in the open configuration such that the pressurized material 636 forces some of the stored material 634 out of the container 630 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 622.

The process of spraying a test pattern and adjusting the first and second adjustment members 672 and 682 is repeated until the test pattern formed by the dispensed material 622 corresponds to a desired texture pattern that substantially matches the pre-existing texture pattern.

Leaving the first and second adjustment members 672 and 682 as they were when the test texture pattern corresponded to the desired texture pattern, the aerosol dispensing system 620 is then arranged such that the conduit outlet or outlet opening 646 is aimed at the un-textured portion of the target surface. The trigger member 694 is again squeezed to place the valve assembly 660 in the open configuration such that the pressurized material 636 forces the stored material 634 out of the container 630 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface in a desired texture pattern that substantially matches a physical appearance of the textured portion. One or more layers of primer and/or paint may next be applied over the cured layer of dispensed material.

The following Table H represents example ranges and dimensions for constructing a physical embodiment of a flow adjustment system that may be used as the example first flow adjustment system 670:

TABLE H

| Config. | Units | Example | First Range | Second Range |
|---|---|---|---|---|
| Fully Open | % Passageway | 100 | 95-100 | 90-100 |
| | Square Inches | .00385 | 0.00424-0.00347 | 0.00578-0.00193 |
| Terminal | % Passageway | 12 | 8-16 | 5-20 |
| | Square Inches | .00045 | 0.00050-0.00041 | 0.00068-0.00023 |

D. Ninth Example Aerosol Dispensing System

Referring now to FIGS. 35-38 of the drawing, depicted at 720 therein is a ninth example aerosol dispensing system constructed in accordance with, and embodying, the principles of the present invention. Like the fifth example aerosol dispensing system 20*b*, the ninth example dispensing system is adapted to spray droplets of dispensed material 722 onto a target surface (not shown). In the example use of the dispensing system 720 depicted in FIG. 35, the dispensed material 722 is or contains texture material, and the dispensing system 720 is being used to form a coating on an un-textured portion of the target surface having a desired texture pattern that substantially matches a pre-existing texture pattern of a textured portion of the target surface.

Figure 35:
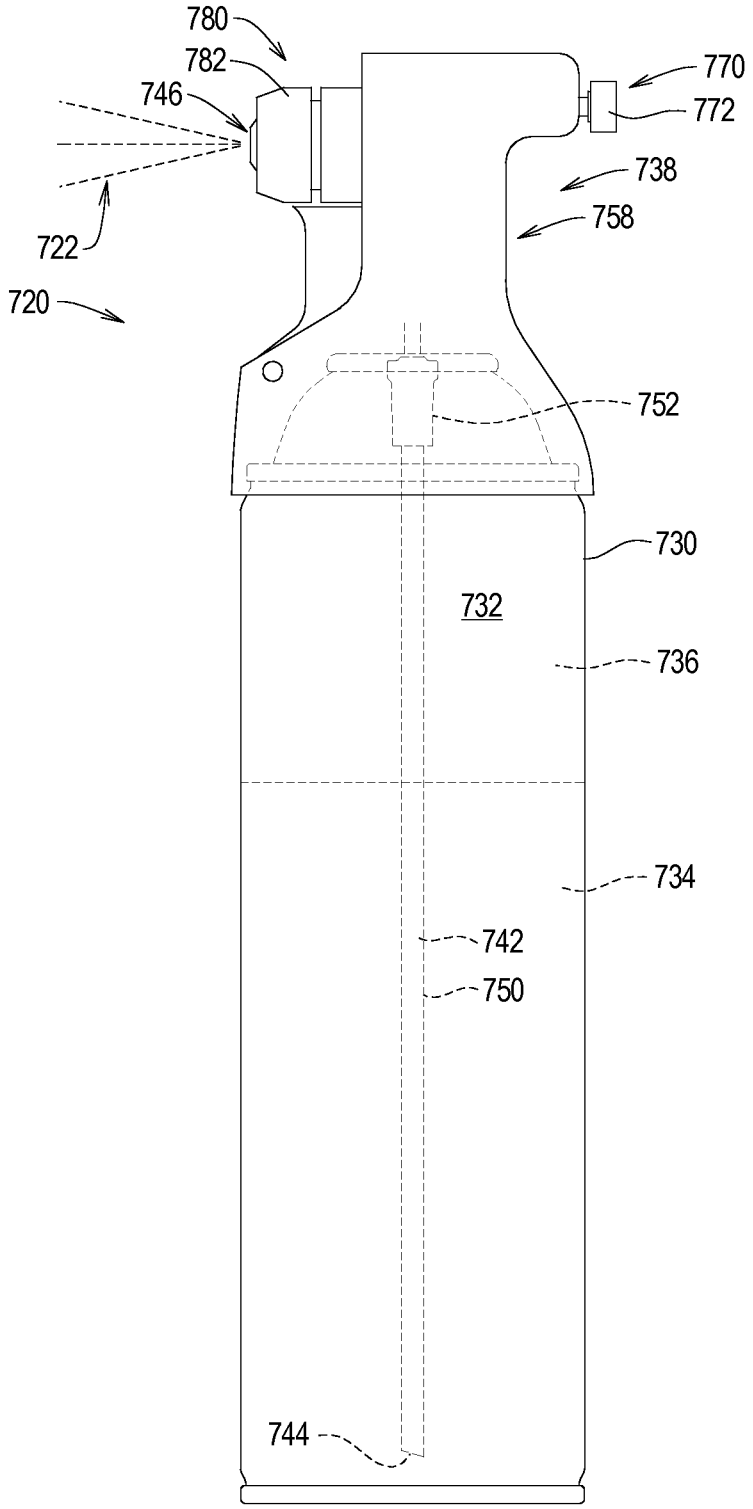
FIG. 35 is a side elevation view of a eighth example aerosol texturing system of the present invention.

FIG. 35 further illustrates that the example dispensing system 720 comprises a container 730 defining a chamber 732 in which stored material 734 and pressurized material 736 are contained. Like the stored materials (e.g., 34*a* and 34*b*) described above, the stored material 734 is a mixture of texture material and propellant material in liquid phase, while the pressurized material is propellant material in gas phase. An actuator assembly 738 is mounted on the container assembly 730 to facilitate the dispensing of the dispensed material 722 as will be described in further detail below.

Figure 36:
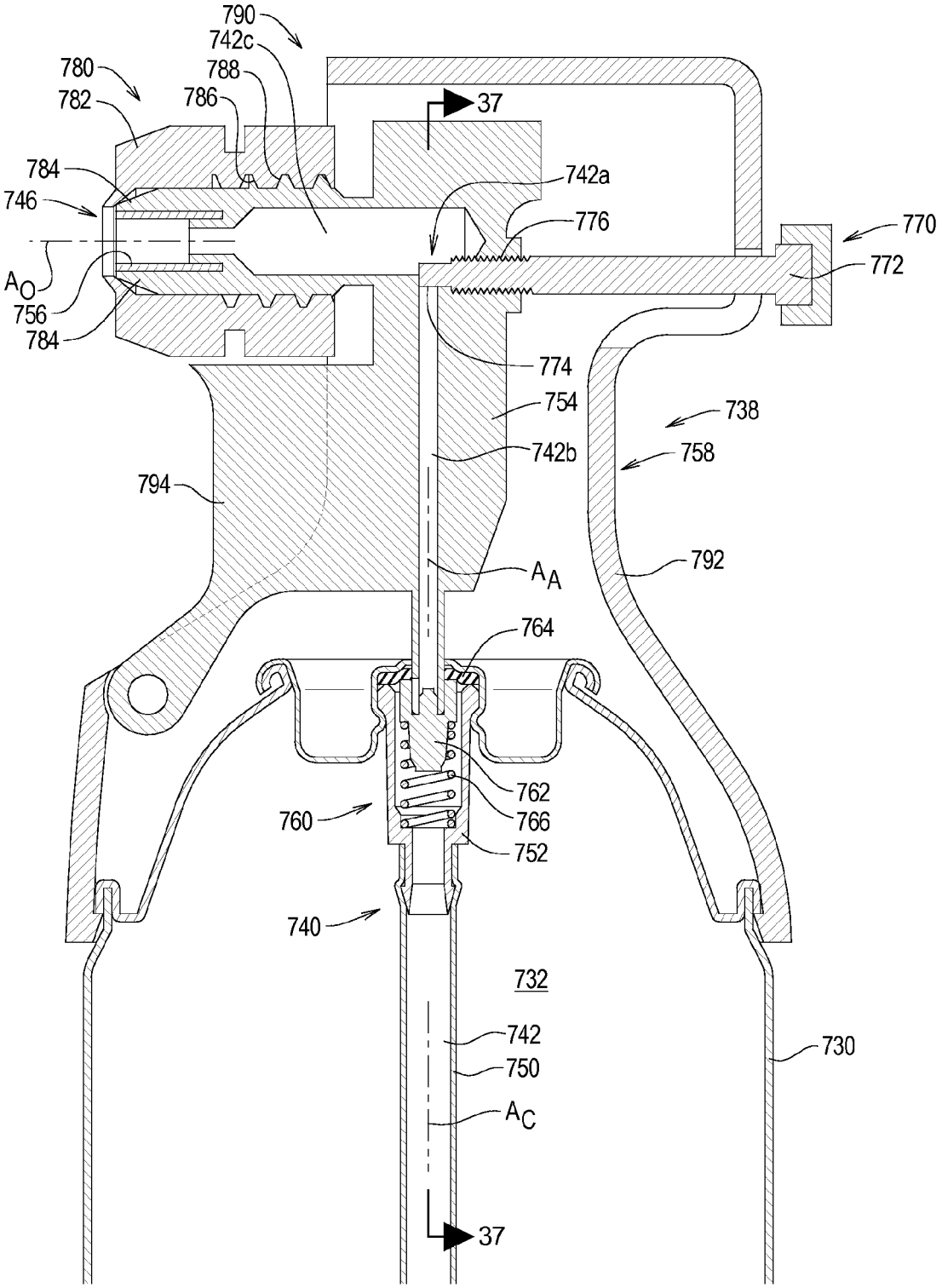
FIG. 36 is a side elevation section view of an actuator member and first and second adjustment systems of the eighth example aerosol texturing system, with the first example adjustment system in a terminal configuration.
Figure 37:
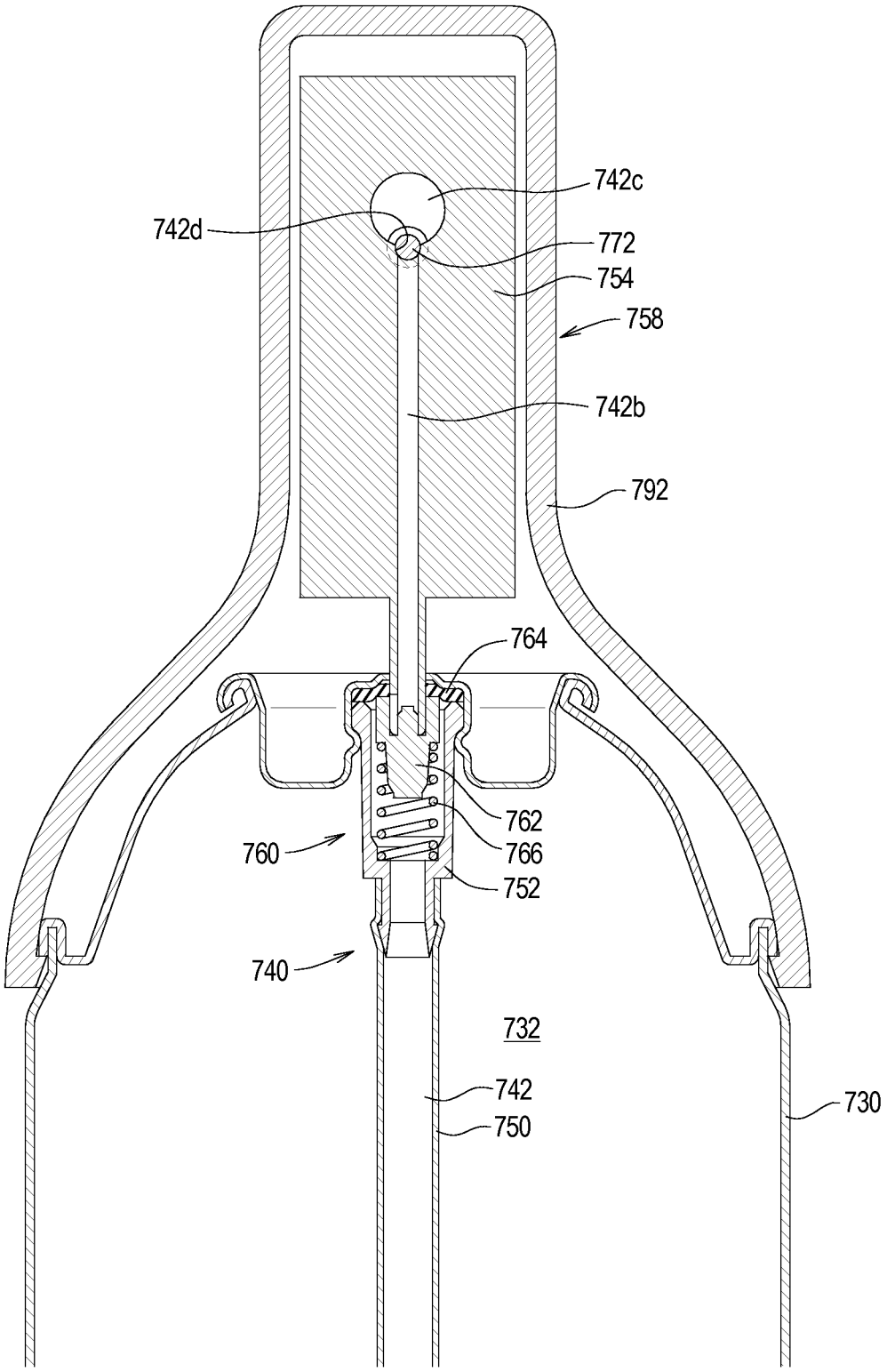
FIG. 37 is a front elevation section view of an actuator member and first adjustment system of the eighth example aerosol texturing system taken along lines 37-37 in FIG. 36, with the first example adjustment system in the terminal configuration.
Figure 38:
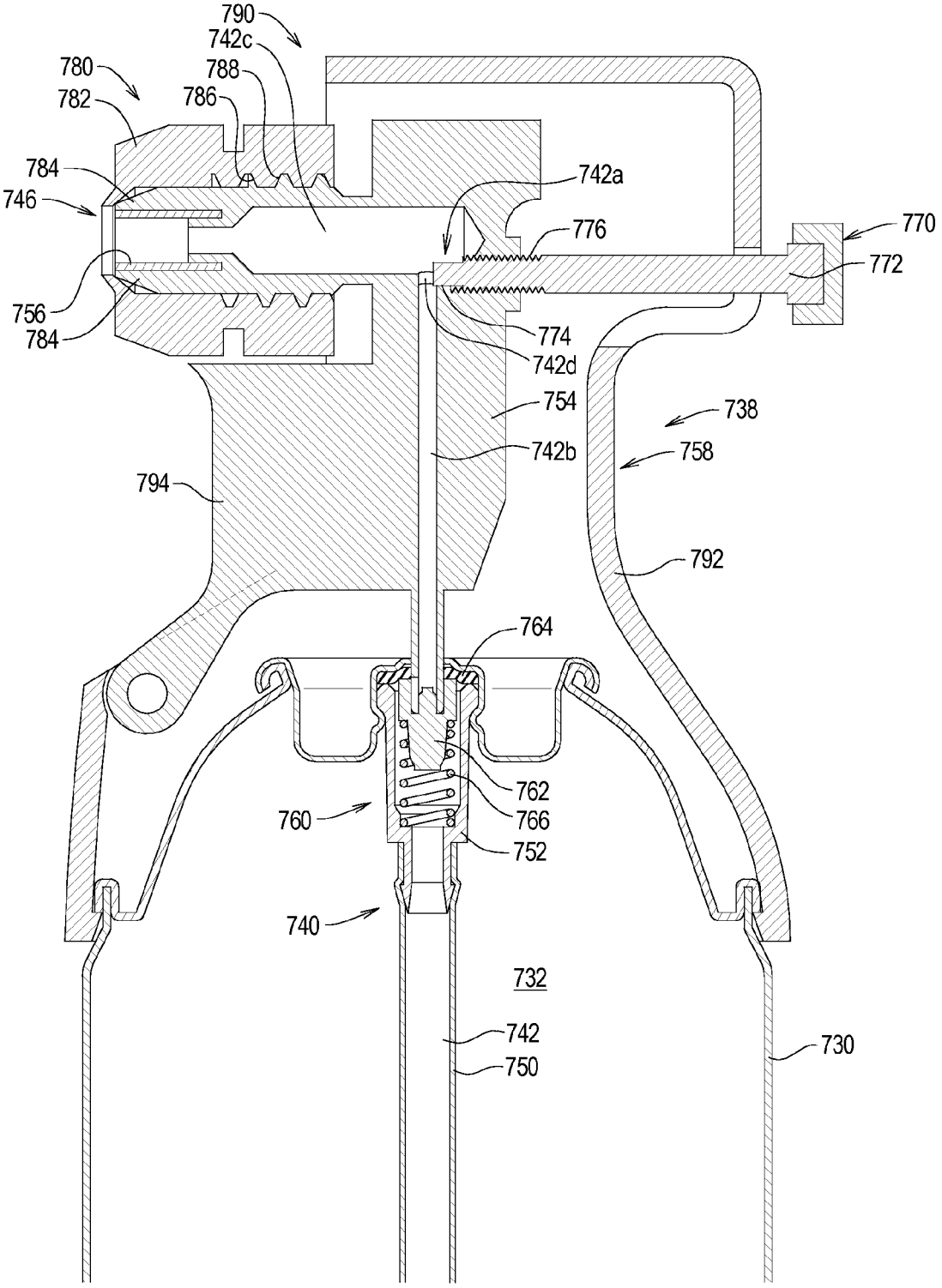
FIG. 38 is a side elevation section view of an actuator member and first and second adjustment systems of the eighth example aerosol texturing system, with the first example adjustment system in an intermediate configuration.

FIG. 36 illustrates that the ninth example aerosol dispensing system 720 comprises a conduit 740 defining a conduit passageway 742. The conduit 740 is supported by the container 730 such that the conduit passageway 742 defines a conduit inlet 744 arranged within the chamber 732 and a conduit outlet or outlet opening 746 arranged outside of the chamber 732. The example conduit 740 is formed by an inlet tube 750, a valve housing 752, an actuator member 754, and an outlet member 756. The conduit passageway 742 extends through the inlet tube 750, the valve housing 752, the actuator member 754, and the outlet member 756. The valve housing 752 is arranged between the conduit inlet 744 and the actuator member 754, and the actuator member 754 is arranged between the valve housing 752 and the conduit outlet 746. The outlet member 756 is supported by the actuator member 754 to define the conduit outlet 746.

FIG. 36 further shows that a valve assembly 760 is formed within the valve housing 752. The example valve assembly 760 comprises a valve member 762, a valve seat 764, and a valve spring 766. The valve assembly 760 operates in a closed configuration and an open configuration. In the closed configuration, the valve spring 766 forces the valve member 762 against the valve seat 764 such that the valve assembly 760 substantially prevents flow of fluid along the conduit passageway 742. In the open configuration, the valve member 762 is displaced away from the valve seat 764 against the force of the valve spring 766 such that the valve assembly 760 allows flow of fluid along the conduit passageway 742 between the valve member 762 and the valve seat 764. Because the valve spring 766 biases the valve member 762 towards the valve seat 764, the example valve assembly 760 is normally closed. As will be described in further detail below, the valve assembly 760 engages the actuator member structure 754 such that the application of deliberate manual force on the actuator member 754 towards the container 730 moves the valve member 762 away from the valve seat 764 and thus places the valve system 760 in the open configuration.

A first flow adjustment system 770 having a first adjustment member 772 having a valve surface 774 and an externally threaded surface 776 is arranged to intersect the conduit passageway 742 at an intermediate location 742*a* between the valve assembly 760 and the conduit outlet 746. The conduit passageway has a first portion 742*b* and a second portion 742*c*. The first passageway portion 742*b* defines an actuator axis $A_A$ aligned with a container axis $A_C$ defined by the container assembly 730, and the second actuator passageway portion 742*c* is aligned with an outlet axis $A_O$ defined by the outlet member 756. The example intermediate location 742*a* is located at the juncture of the first and second passageway portions 742*b* and 742*c*. A juncture surface 742*d* having a profile that matches that of the valve surface 774 is arranged at the intermediate location 742*a* as perhaps best shown in FIG. 37.

An internally threaded surface 778 is formed in the actuator member 754. The threaded surfaces 776 and 778 are adapted to engage each other such that, as shown in FIG. 34, rotation of the first adjustment member 772 relative to the actuator member 754 causes the valve surface 774 move into the conduit passageway 742 and thus alter a cross-sectional area of the conduit passageway 742 between the valve system 760 and the second flow adjustment system 780.

A second flow adjustment system 780 comprises a second adjustment member 782 and a plurality of fingers 784 extending from the actuator member 754. The second flow adjustment system 780 is arranged relative to the conduit passageway 742 to form at least a portion of the conduit outlet (or outlet opening) 746. The second adjustment member 782 defines an internal threaded surface 786 that engages an external threaded surface 788 of the actuator member 754 such that rotation of the second adjustment member 782 relative to the actuator member 754 deforms the fingers and thus the outlet member 756, thereby altering a cross-sectional area of the conduit outlet or outlet opening 746.

The first flow adjustment system 770 is supported by the actuator member 754 between the valve assembly 760 and the second adjustment system 780 such that manual operation of the first adjustment member 772 affects the flow of fluid material along the conduit passageway 742 as generally described above. In particular, the second adjustment system 780 functions as a flow restrictor, where operation of the first adjustment member 772 variably reduces the size of the conduit passageway 742 such that a pressure of the fluid material upstream of the first flow adjustment system 770 is relatively higher than the pressure of the fluid material downstream of the first flow adjustment system 770. The example first flow adjustment system 770 operates in a fully open configuration (least amount of flow restriction) and a terminal configuration (largest amount of flow restriction).

The second adjustment system 780 is supported by the actuator member 754 downstream of the first adjustment system 770. The outlet member 756 is a resiliently deformable tube, and manual operation of the second adjustment member 782 deforms the walls of the outlet member 756 and thereby affects the flow of fluid material flowing out of the conduit passageway 742 through the conduit outlet or outlet opening 746. The second adjustment system 780 thus functions as a variable orifice. Operation of the second adjustment member 782 variably reduces the size of the conduit outlet or outlet opening 746 relative to the size of the conduit passageway 742 upstream of the second adjustment system 780.

The outlet member 756, first adjustment member 772, and second adjustment member 782 are supported by the actuator member 754 to define a control assembly 790. FIG. 36 further shows that the grip assembly 758 comprises a grip housing 792 and that the actuator member 754 defines a trigger portion 794. To form the actuator assembly 738, the grip assembly 758 is combined with the control assembly 790 by pivotably attaching the actuator member 754 to the grip housing 792. The actuator assembly 738 is supported by the container assembly 730 as generally described above. An elongated slot 796 is formed in the grip housing 792 to allow the first adjustment member 772 to extend through the grip housing 792 without interfering with operation of the actuator member 754 as described herein.

To operate the ninth example aerosol dispensing system 720, the container 730 and grip housing 792 are grasped such that the user's fingers can squeeze the trigger portion 794, thereby depressing the actuator member 754. The conduit outlet or outlet opening 746 is initially aimed at a test surface and the actuator member 754 is depressed to place the valve assembly 760 in the open configuration such that the pressurized material 736 forces some of the stored material 734 out of the container 730 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 722.

The process of spraying a test pattern and adjusting the first and second adjustment members 772 and 782 is repeated until the test pattern formed by the dispensed material 722 corresponds to a desired texture pattern that substantially matches the pre-existing texture pattern.

Leaving the first and second adjustment members 772 and 782 as they were when the test texture pattern corresponded to the desired texture pattern, the aerosol dispensing system 720 is then arranged such that the conduit outlet or outlet opening 746 is aimed at the un-textured portion of the target surface. The trigger member 794 is again squeezed to place the valve assembly 760 in the open configuration such that the pressurized material 736 forces the stored material 734 out of the container 730 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface in a desired texture pattern that substantially matches a physical appearance of the textured portion. One or more layers of primer and/or paint may next be applied over the cured layer of dispensed material.

The following Table I represents example ranges and dimensions for constructing a physical embodiment of a flow adjustment system that may be used as the example first flow adjustment system 770:

TABLE I

| Config. | Units | Example | First Range | Second Range |
|---|---|---|---|---|
| Fully Open | % Passageway | 100 | 95-100 | 90-100 |
| | Square Inches | .00385 | 0.00424-0.00347 | 0.00578-0.00193 |
| Terminal | % Passageway | 12 | 8-16 | 5-20 |
| | Square Inches | .00045 | 0.00050-0.00041 | 0.00068-0.00023 |

E. Tenth Example Aerosol Dispensing System

Referring now to FIGS. 39-42 of the drawing, depicted at 920 therein is a tenth example aerosol dispensing system constructed in accordance with, and embodying, the principles of the present invention. Like the fifth example aerosol dispensing system 20*b*, the tenth example dispensing system is adapted to spray droplets of dispensed material 922 onto a target surface (not shown). In the example use of the dispensing system 920 depicted in FIG. 39, the dispensed material 922 is or contains texture material, and the dispensing system 920 is being used to form a coating on an un-textured portion of the target surface having a desired texture pattern that substantially matches a pre-existing texture pattern of a textured portion of the target surface.

Figure 39:
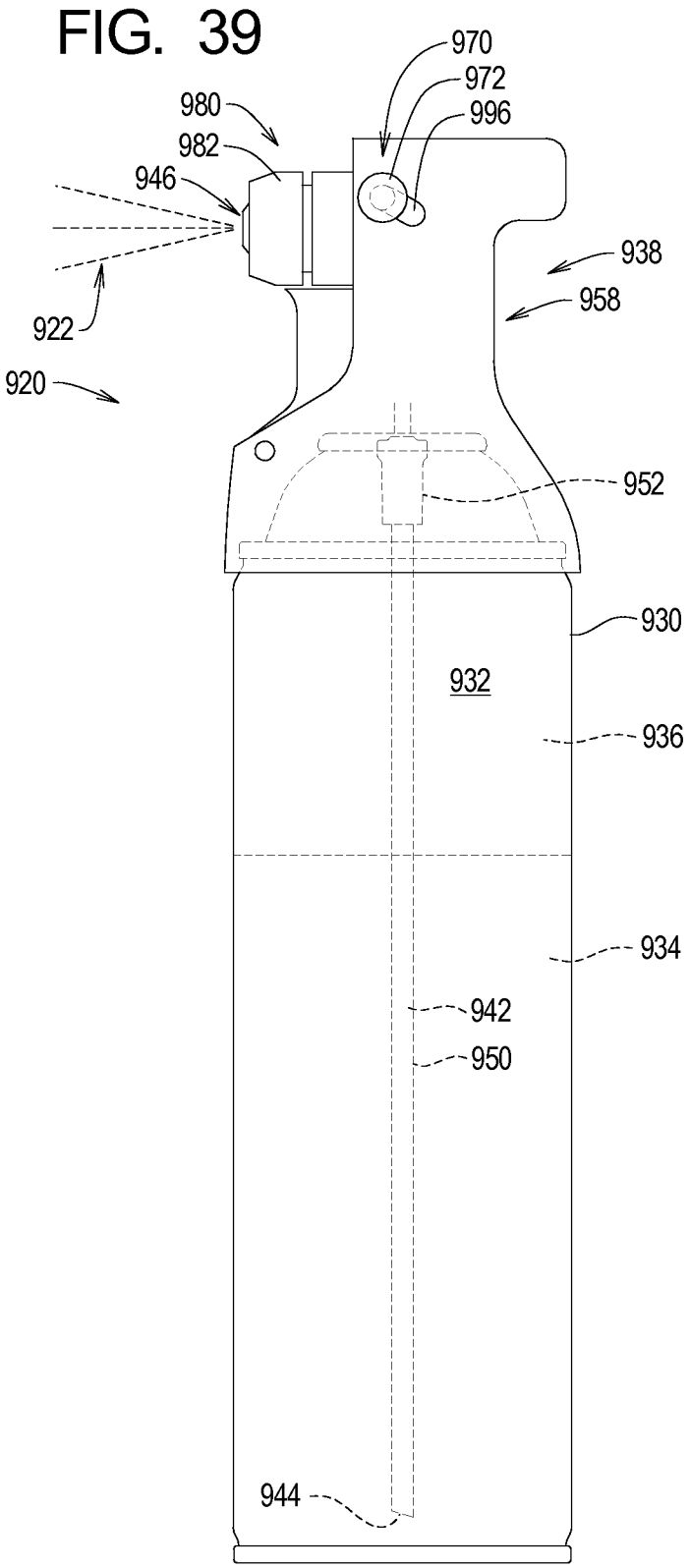
FIG. 39 is a side elevation view of a ninth example aerosol texturing system of the present invention.

FIG. 39 further illustrates that the example dispensing system 920 comprises a container 930 defining a chamber 932 in which stored material 934 and pressurized material 936 are contained. Like the stored materials (e.g., 34*a* and 34*b*) described above, the stored material 934 is a mixture of texture material and propellant material in liquid phase, while the pressurized material is propellant material in gas phase. An actuator assembly 938 is mounted on the container assembly 930 to facilitate the dispensing of the dispensed material 922 as will be described in further detail below.

Figure 40:
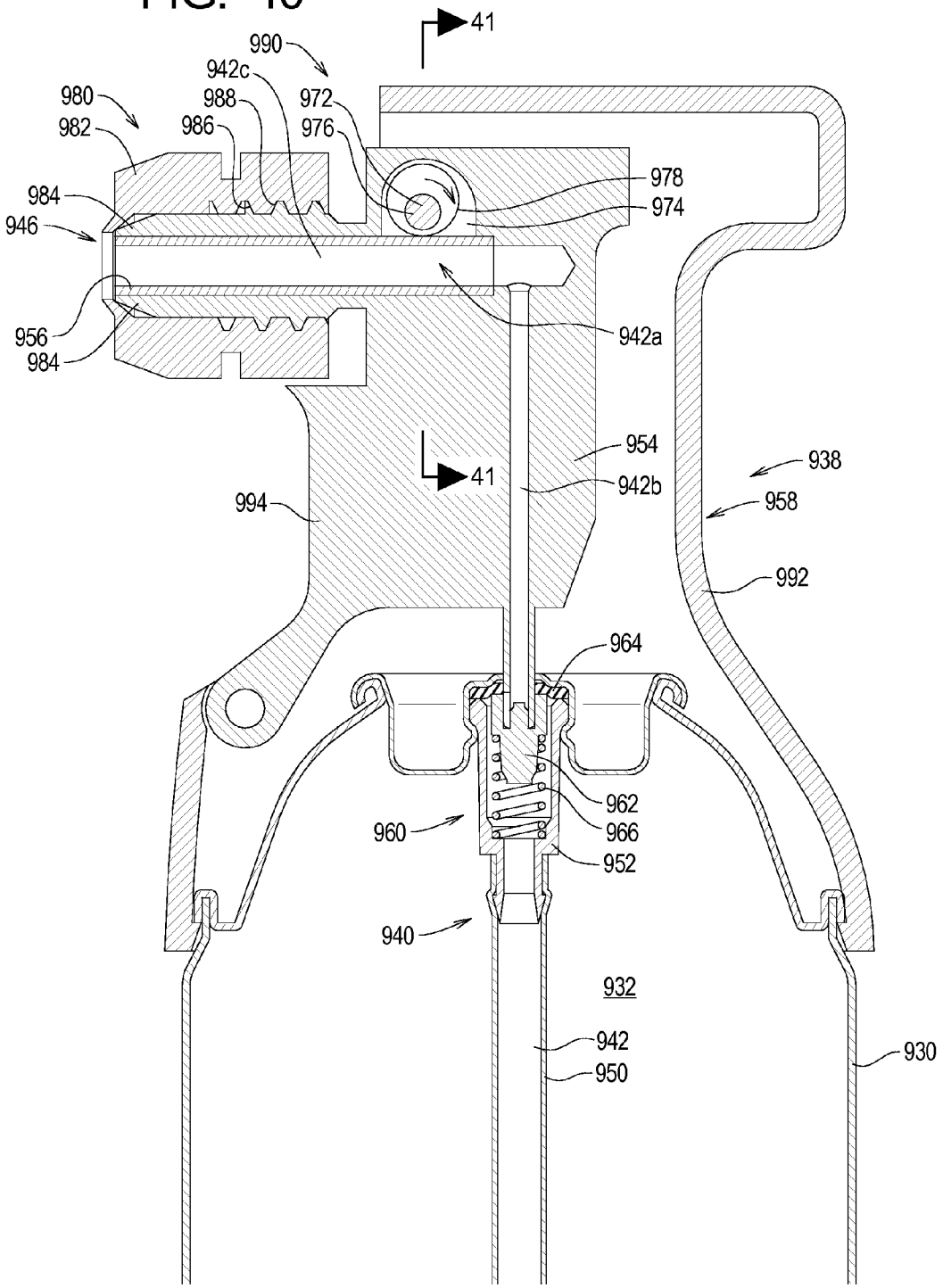
FIG. 40 is a side elevation section view of an actuator member and first and second adjustment systems of the ninth example aerosol texturing system, with the first example adjustment system in a full open configuration.
Figure 41:
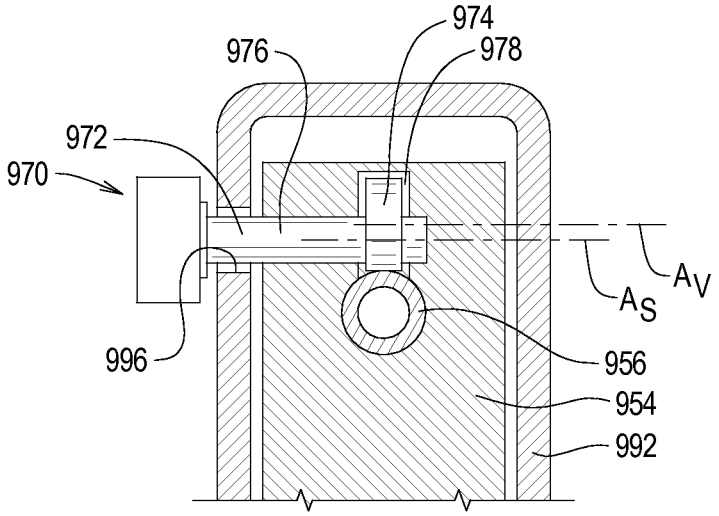
FIG. 41 is a front elevation section view of an actuator member and first adjustment system of the ninth example aerosol texturing system taken along lines 46-46 in FIG. 40, with the first example adjustment system in the fully open configuration.
Figure 42:
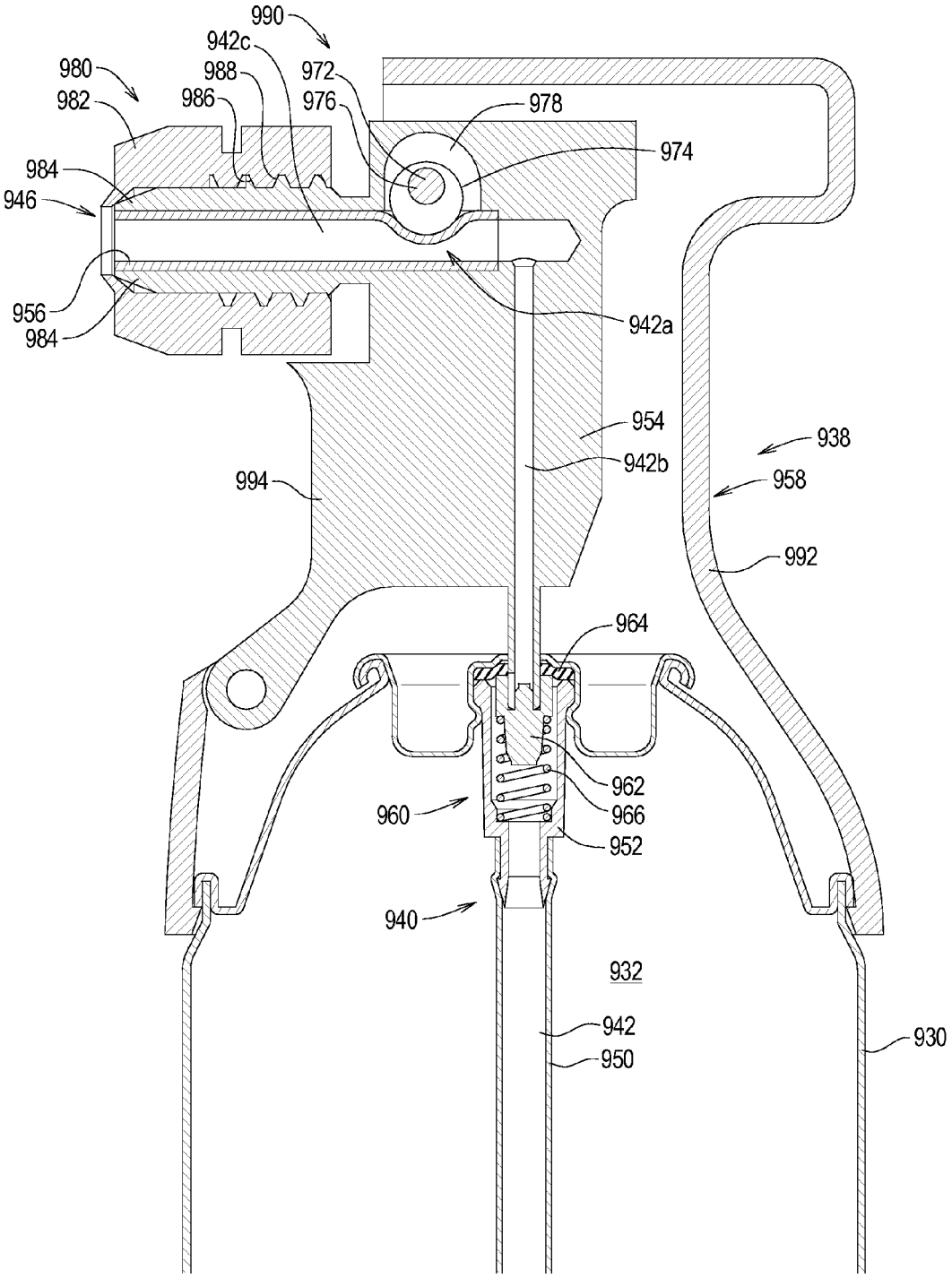
FIG. 42 is a side elevation section view of an actuator member and first and second adjustment systems of the ninth example aerosol texturing system, with the first example adjustment system in an intermediate configuration.

FIG. 40 illustrates that the tenth example aerosol dispensing system 920 comprises a conduit 940 defining a conduit passageway 942. The conduit 940 is supported by the container 930 such that the conduit passageway 942 defines a conduit inlet 944 arranged within the chamber 932 and a conduit outlet or outlet opening 946 arranged outside of the chamber 932. The example conduit 940 is formed by an inlet tube 950, a valve housing 952, an actuator member 954, and an outlet member 956. The conduit passageway 942 extends through the inlet tube 950, the valve housing 952, the actuator member 954, and the outlet member 956. The valve housing 952 is arranged between the conduit inlet 944 and the actuator member 954, and the actuator member 954 is arranged between the valve housing 952 and the conduit outlet 946. The outlet member 956 is supported by the actuator member 954 to define the conduit outlet 946.

FIG. 40 further shows that a valve assembly 960 is formed within the valve housing 952. The example valve assembly 960 comprises a valve member 962, a valve seat 964, and a valve spring 966. The valve assembly 960 operates in a closed configuration and an open configuration. In the closed configuration, the valve spring 966 forces the valve member 962 against the valve seat 964 such that the valve assembly 960 substantially prevents flow of fluid along the conduit passageway 942. In the open configuration, the valve member 962 is displaced away from the valve seat 964 against the force of the valve spring 966 such that the valve assembly 960 allows flow of fluid along the conduit passageway 942 between the valve member 962 and the valve seat 964. Because the valve spring 966 biases the valve member 962 towards the valve seat 964, the example valve assembly 960 is normally closed. As will be described in further detail below, the valve assembly 960 engages the actuator member structure 954 such that the application of deliberate manual force on the actuator member 954 towards the container 930 moves the valve member 962 away from the valve seat 964 and thus places the valve system 960 in the open configuration.

A first flow adjustment system 970 having a first adjustment member 972 having a valve surface 974 and a shaft portion 976 is arranged to intersect the conduit passageway 942 at an intermediate location 942*a* between the valve assembly 960 and the conduit outlet 946. The conduit passageway has a first portion 942*b* and a second portion 942*c*. The first passageway portion 942*b* defines an actuator axis $A_A$ aligned with a container axis $A_C$ defined by the container assembly 930, and the second actuator passageway portion is aligned with an outlet axis $A_O$ defined by the outlet member 956. The example intermediate location 942*a* is located in the second passageway portion 942*c*.

A support opening 978 is formed in the actuator member 954. The shaft 976 extends through the opening 978 such that, as shown in FIGS. 45 and 47, rotation of the first adjustment member 972 relative to the actuator member 954 causes the valve surface 974 to engage and deform the outlet member 956 and thus alter a cross-sectional area of the conduit passageway 942 between the valve system 960 and the second flow adjustment system 980. In particular, the valve surface 974 defines a valve axis $A_V$ that is offset from a shaft axis $A_S$ defined by the shaft portion 976. Accordingly, rotation of the first adjustment member 972 about the shaft axis $A_S$ causes eccentric rotation of the valve surface 974. Because of this eccentric rotation, a distance between the portion of the valve surface 974 in contact with the outlet member 956, relative to the shaft axis $A_S$, increases and decreases based on an angular position of the first adjustment member 972.

A second flow adjustment system 980 comprises a second adjustment member 982 and a plurality of fingers 984 extending from the actuator member 954. The second flow adjustment system 980 is arranged relative to the conduit passageway 942 to form at least a portion of the conduit outlet (or outlet opening) 946. The second adjustment member 982 defines an internal threaded surface 986 that engages an external threaded surface 988 of the actuator member 954 such that rotation of the second adjustment member 982 relative to the actuator member 954 deforms the fingers and thus the outlet member 956, thereby altering a cross-sectional area of the conduit outlet or outlet opening 946.

The first flow adjustment system 970 is supported by the actuator member 954 between the valve assembly 960 and the second adjustment system 980 such that manual operation of the first adjustment member 972 affects the flow of fluid material along the conduit passageway 942 as generally described above. In particular, the second adjustment system 980 functions as a flow restrictor, where operation of the first adjustment member 972 variably reduces the size of the conduit passageway 942 such that a pressure of the fluid material upstream of the first flow adjustment system 970 is relatively higher than the pressure of the fluid material downstream of the first flow adjustment system 970. The example first flow adjustment system 970 thus is operable in a fully open configuration (least amount of flow restriction) and a terminal configuration (greatest amount of flow restriction).

The second adjustment system 980 is supported by the actuator member 954 downstream of the first adjustment system 970. The outlet member 956 is a resiliently deformable tube, and manual operation of the second adjustment member 982 deforms the walls of the outlet member 956 and thereby affects the flow of fluid material flowing out of the conduit passageway 942 through the conduit outlet or outlet opening 946. The second adjustment system 980 thus functions as a variable orifice. Operation of the second adjustment member 982 variably reduces the size of the conduit outlet or outlet opening 946 relative to the size of the conduit passageway 942 upstream of the second adjustment system 980.

The outlet member 956, first adjustment member 972, and second adjustment member 982 are supported by the actuator member 954 to define a control assembly 990. FIG. 40 further shows that the grip assembly 958 comprises a grip housing 992 and that the actuator member 954 defines a trigger portion 994. To form the actuator assembly 938, the grip assembly 958 is combined with the control assembly 990 by pivotably attaching the actuator member 954 to the grip housing 992. The actuator assembly 938 is supported by the container assembly 930 as generally described above. An elongated slot 996 is formed in the grip housing 992 to allow the first adjustment member 972 to extend through the grip housing 992 without interfering with operation of the actuator member 954 as described herein.

To operate the tenth example aerosol dispensing system 920, the container 930 and grip housing 992 are grasped such that the user's fingers can squeeze the trigger portion 994, thereby depressing the actuator member 954. The conduit outlet or outlet opening 946 is initially aimed at a test surface and the actuator member 954 is depressed to place the valve assembly 960 in the open configuration such that the pressurized material 936 forces some of the stored material 934 out of the container 930 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 922.

The process of spraying a test pattern and adjusting the first and second adjustment members 972 and 982 is repeated until the test pattern formed by the dispensed material 922 corresponds to a desired texture pattern that substantially matches the pre-existing texture pattern.

Leaving the first and second adjustment members 972 and 982 as they were when the test texture pattern corresponded to the desired texture pattern, the aerosol dispensing system 920 is then arranged such that the conduit outlet or outlet opening 946 is aimed at the un-textured portion of the target surface. The trigger member 994 is again squeezed to place the valve assembly 960 in the open configuration such that the pressurized material 936 forces the stored material 934 out of the container 930 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface in a desired texture pattern that substantially matches a physical appearance of the textured portion. One or more layers of primer and/or paint may next be applied over the cured layer of dispensed material.

The following Table K represents example ranges and dimensions for constructing a physical embodiment of a flow adjustment system that may be used as the example first flow adjustment system 970:

TABLE K

| Config. | Units | Example | First Range | Second Range |
|---|---|---|---|---|
| Fully Open | % Passageway | 100 | 95-100 | 90-100 |
| | Square Inches | .00385 | 0.00424-0.00347 | 0.00578-0.00193 |
| Terminal | % Passageway | 0 | 0-16 | 0-20 |
| | Square Inches | 0.0000 | 0.00000-0.00041 | 0.00000-0.00023 |

III. Summary

Each of the embodiments described above contains a unique first adjustment system and one of several example second adjustment systems. Any one of the example second adjustment systems disclosed herein may be combined with any one of the unique first adjustment systems associated with each of the embodiments discussed above. Accordingly, the specific pairings of example first and second adjustment systems as described above are for illustrative purposes only, and, in one form, the principles of the present invention may be implemented by using any pair of example first and second adjustment systems whether that particular pairing is disclosed explicitly above or disclosed implicitly by reference in this Summary section.

Accordingly, the embodiments described herein may be embodied in other specific forms without departing from their spirit or essential characteristics. The described embodiments are to be considered in all respects only as illustrative and not restrictive. The scope of the invention is, therefore, indicated by the claims to be appended hereto rather than by the foregoing description. All changes which come within the meaning and range of equivalency of the claims are to be embraced within their scope.

TABLE A-4

| Ref. | Material | Commercial Example | Function/Description | Example | First Range | Second Range |
|---|---|---|---|---|---|---|
| A | Diacetone alcohol | | Medium-evaporating, low odor solvent | 3.85 | 3.85 ± 5% | 3.85 ± 10% |
| B | Propylene Carbonate | | Slow evaporating, low odor solvent | 2.31 | 2.31 ± 5% | 2.31 ± 10% |
| C | Denatured Ethanol | PM 6193-200 | Fast evaporating, low odor solvent | 13.33 | 13.33 ± 5% | 13.33 ± 10% |
| D | Resin | TB-044 resin (Dai) | Acrylic resin/binder (soluble in "weak" solvents) | 4.93 | 4.93 ± 5% | 4.93 ± 10% |
| E | Clay Pigment | Bentone 34 | Anti-settle/anti-sag clay pigment | 1.26 | 1.26 ± 5% | 1.26 ± 10% |
| F | Fumed Silica | Aerosil R972 | Anti-settle fumed silica | 0.08 | 0.08 ± 5% | 0.08 ± 10% |
| G | Dispersant | Byk Anti-Terra 204 | Dispersing aid | 0.51 | 0.51 ± 5% | 0.51 ± 10% |
| H | Calcium carbonate | MarbleWhite 200 (Specialty Minerals) | filler/extender | 33.87 | 33.87 ± 5% | 33.87 ± 10% |
| I | Nepheline syenite | Minex 4 | filler/extender | 33.87 | 33.87 ± 5% | 33.87 ± 10% |
| J | Denatured Ethanol | PM 6193-200 | Fast evaporating, low odor solvent | 4.00 | 4.00 ± 5% | 4.00 ± 10% |
| K | Denatured Ethanol | PM 6193-200 | Fast evaporating, low odor solvent | 1.99 | 1.99 ± 5% | 1.99 ± 10% |
| | | | | 100 | | |

TABLE A-5

| Ref. | Material | Commercial Example | Function/Description | Example | First Range | Second Range |
|---|---|---|---|---|---|---|
| A | Diacetone alcohol | | Medium-evaporating, low odor solvent | 13.73 | 5-15% | 0-20% |
| B | Propylene Carbonate | | Slow evaporating, low odor solvent | 2.11 | 1-3% | 0-5% |
| C | Denatured Ethanol | PM 6193-200 | Fast evaporating, low odor solvent | 10.56 | 5-15% | 0-20% |
| D | Resin | TB-044 resin (Dai) | Acrylic resin/binder (soluble in "weak" solvents) | 4.93 | 2-6% | 1-10% |
| E | Clay Pigment | Bentone 34 | Anti-settle/anti-sag clay pigment | 1.26 | 0.5-1.5% | 0.1-2.0% |
| F | Fumed Silica | Aerosil R972 | Anti-settle fumed silica | 0.08 | 0-0.20% | 0-0.50% |
| G | Dispersant | Byk Anti-Terra 204 | Dispersing aid | 0.51 | 0.3-0.7% | 0.1-1.5% |
| H | Calcium carbonate | MarbleWhite 200 (Specialty Minerals) | filler/extender | 33.87 | 20-40% | 0-70% |
| I | Nepheline syenite | Minex 4 | filler/extender | 33.87 | 20-40% | 0-70% |
| J | Titanium Dioxide | | White pigment | 0.00 | 0-5% | 0-20% |
| K | Calcined clay | Optiwhite | White extender pigment | 0.00 | 0-10% | 0-20% |
| L | Hexane | | Very fast evaporating, low odor solvent | 0.00 | 0-10% | 0-20% |

What is claimed is:

1. An aerosol dispensing system for dispensing stored material in a spray, comprising:

a container defining a chamber containing the stored material and pressurized material;

a conduit defining a conduit passageway having a conduit inlet and a conduit outlet, where the conduit inlet is arranged within the chamber and the conduit outlet is arranged outside of the chamber;

a first adjustment system arranged to control a flow of stored material along the conduit passageway, where the first adjustment system comprises a valve member configured to move between a closed configuration in which stored material is prevented from flowing along the conduit passageway and a fully open configuration, and an adjustment member arranged to limit movement of the valve member to at least one partially open configuration between the closed configuration and the fully open configuration to vary the flow of material along the conduit passageway; and a second adjustment system arranged to vary the flow of stored material along the conduit passageway, where the second adjustment system is arranged between the first adjustment system and the conduit outlet.

2. An aerosol dispensing system as recited in claim 1, in which the stored material is texture material.

3. An aerosol dispensing system as recited in claim 1, in which the first adjustment system is arranged to define an effective cross-sectional area of the conduit passageway.

4. An aerosol dispensing system as recited in claim 1, in which the second adjustment system is arranged to define an effective cross-sectional area of the conduit outlet.

5. An aerosol dispensing system as recited in claim 3, in which the second adjustment system is arranged to define an effective cross-sectional area of the conduit outlet.

6. An aerosol dispensing system as recited in claim 1, in which the adjustment member is supported relative to the container.

7. An aerosol dispensing system as recited in claim 1, in which the first adjustment system allows pressure of fluid material upstream of the first adjustment system to be greater than the pressure of fluid material downstream of the first adjustment system.

8. An aerosol dispensing system as recited in claim 1, in which the conduit comprises:

a valve housing, and an actuator structure supported by the valve member; whereby displacement of the actuator structure relative to the valve housing displaces the valve member relative to the valve housing.

9. An aerosol dispensing system as recited in claim 8, in which the second adjustment system comprises an outlet member and a second adjustment member, where the actuator structure supports the outlet member and the second adjustment member such that movement of the second adjustment member relative to the outlet member alters an effective cross-sectional area of the conduit outlet.

10. An aerosol dispensing system as recited in claim 9, in which the second adjustment member deforms the outlet member to alter the effective cross-sectional area of the conduit outlet.

11. An aerosol dispensing system as recited in claim 10, in which the actuator structure defines a plurality of fingers that support the outlet member, where the second adjustment member deforms the fingers to deform the outlet member.

12. An aerosol dispensing system as recited in claim 1, in which the valve member is part of a valve assembly.

13. An aerosol dispensing system as recited in claim 12, further comprising an actuator member, in which:

the actuator member supports the second adjustment system;

the valve assembly comprises a valve seat, the valve member, and a valve spring that biases the valve member towards the valve seat; and the actuator member engages the valve member such that displacement of the actuator member towards the valve assembly displaces the valve member away from the valve seat against the bias applied by the valve spring.

14. An aerosol dispensing system as recited in claim 13, in which the adjustment member is supported to limit movement of the actuator member towards the valve assembly to limit movement of the valve member away from the valve seat.

15. An aerosol dispensing system for dispensing stored material in a spray, comprising:

a container defining a chamber containing the stored material and pressurized material;

a conduit defining a conduit passageway having a conduit inlet and a conduit outlet, where the conduit inlet is arranged within the chamber and the conduit outlet is arranged outside of the chamber;

a valve assembly arranged selectively to allow and prevent flow of stored material along the conduit passageway;

a first adjustment member arranged to vary a flow of stored material along the conduit passageway, where the first adjustment member is arranged between the conduit inlet and the conduit outlet; and a second adjustment member arranged to vary a flow of stored material along the conduit passageway, where the second adjustment member is arranged between the first adjustment member and the conduit outlet.

16. An aerosol dispensing system as recited in claim 15, in which the stored material is texture material.

17. An aerosol dispensing system as recited in claim 15, in which the first adjustment member is arranged to define an effective cross-sectional area of the conduit passageway.

18. An aerosol dispensing system as recited in claim 15, in which the second adjustment member is arranged to define an effective cross-sectional area of the conduit outlet.

19. An aerosol dispensing system as recited in claim 17, in which the second adjustment member is arranged to define an effective cross-sectional area of the conduit outlet.

20. An aerosol dispensing system as recited in claim 15, in which the first adjustment member restricts flow of fluid along the conduit passageway.

21. An aerosol dispensing system as recited in claim 15, in which the first adjustment member allows pressure of fluid material upstream of the first flow adjustment member to be greater than pressure of fluid material downstream of the first adjustment member.

22. An aerosol dispensing system as recited in claim 15, in which the conduit comprises:

a valve housing, where the valve assembly is arranged within the valve housing; and an actuator structure; whereby displacement of the actuator structure relative to the valve housing operates the valve assembly.

23. An aerosol dispensing system as recited in claim 15, in which the valve assembly is configured selectively to allow and prevent flow of stored material along the conduit passageway.

24. An aerosol dispensing system as recited in claim 15, further comprising an actuator structure defining an actuator passageway, in which:

the actuator structure supports the first adjustment member such that an adjustment portion of the first adjustment member extends into the actuator passageway, and movement of the first adjustment member relative to the actuator structure causes the adjustment portion to alter a cross-sectional area of the actuator passageway.

25. An aerosol dispensing system as recited in claim 24, in which the adjustment portion of the first adjustment member is shaped such that rotation of the first adjustment member relative to the actuator structure alters the cross-sectional area of the actuator passageway.

26. An aerosol dispensing system as recited in claim 15, further comprising an actuator structure, where the actuator structure supports an outlet member and the second adjustment member such that movement of the second adjustment member relative to the outlet member alters an effective cross-sectional area of the conduit outlet.

27. An aerosol dispensing system as recited in claim 17, further comprising an outlet member, where the second adjustment member deforms the outlet member to alter the effective cross-sectional area of the conduit outlet.

28. An aerosol dispensing system as recited in claim 27, further comprising an actuator structure, where the actuator structure defines a plurality of fingers that support the outlet member, where the second adjustment member deforms the fingers to deform the outlet member.

29. An aerosol dispensing system as recited in claim 15, further comprising an actuator member, in which:

the actuator member supports the second adjustment member;

the valve assembly comprises a valve seat, a valve member, and a valve spring that biases the valve member towards the valve seat; and the actuator member engages the valve member such that displacement of the actuator member towards the valve assembly displaces the valve member away from the valve seat against the bias applied by the valve spring.

30. An aerosol dispensing system as recited in claim 29, further comprising a stop member, where the stop member is supported to limit movement of the actuator member towards the valve assembly to limit movement of the valve member away from the valve seat.

31. An aerosol dispensing system as recited in claim 16, in which the texture material comprises:

a first solvent having a first evaporation rate;

a second solvent having a second evaporation rate, where the second evaporation rate is lower than the first evaporation rate;

a third solvent having a third evaporation rate, where the third evaporation rate is higher than the first evaporation rate;

a binder;

a pigment;

fumed silica;

a dispersant;

a first filler extender;

a second filler extender.

32. An aerosol dispensing system for dispensing stored material in a spray, comprising:

a container defining a chamber containing the stored material and pressurized material;

a conduit defining a conduit passageway having a conduit inlet and a conduit outlet, where the conduit inlet is arranged within the chamber and the conduit outlet is arranged outside of the chamber;

an actuator structure defining an actuator passageway;

a first adjustment system comprising a first adjustment member arranged to vary a flow of stored material along the conduit passageway, where the first adjustment system is arranged between the conduit inlet and the conduit outlet, and configured selectively to allow and prevent flow of stored material along the conduit passageway; and a second adjustment system arranged to vary the flow of stored material along the conduit passageway, where the second adjustment system is arranged between the first adjustment system and the conduit outlet; wherein the actuator structure supports the first adjustment member such that an adjustment portion of the first adjustment member extends into the actuator passageway, and movement of the first adjustment member relative to the actuator structure causes the adjustment portion to alter a cross-sectional area of the actuator passageway; and the adjustment portion of the first adjustment member is shaped such that rotation of the first adjustment member relative to the actuator structure alters the cross-sectional area of the actuator passageway.

33. An aerosol dispensing system as recited in claim 1, in which the adjustment member is supported by the container.

34. An aerosol dispensing system as recited in claim 1, in which the adjustment member is supported by a housing detachably attached to the container.

35. An aerosol dispensing system for dispensing stored material in a spray, comprising:

a container defining a chamber containing the stored material and pressurized material;

a conduit defining a conduit passageway having a conduit inlet and a conduit outlet, where the conduit inlet is arranged within the chamber and the conduit outlet is arranged outside of the chamber;

a first adjustment system arranged to control a flow of stored material along the conduit passageway, where the first adjustment system is arranged between the conduit inlet and the conduit outlet and configured to operate in a closed configuration in which stored material is prevented from flowing along the conduit passageway, a fully open configuration, and at least one partially open configuration between the closed configuration and the fully open configuration to vary the flow of stored material along the conduit passageway; and a second adjustment system arranged to vary the flow of stored material at the conduit outlet; whereby the first adjustment system comprises an actuator structure defining an actuator passageway, and a first adjustment member defining an adjustment portion; and the actuator structure supports the first adjustment member such that the adjustment portion of the first adjustment member extends into the actuator passageway, and movement of the first adjustment member relative to the actuator structure causes the adjustment portion to reduce a cross-sectional area of the actuator passageway between the conduit inlet and the conduit outlet;

the actuator structure supports the second adjustment system such that the second adjustment system is arranged between the first adjustment system and the conduit outlet.

36. An aerosol dispensing system as recited in claim 35, in which the adjustment portion of the first adjustment member is shaped such that rotation of the first adjustment member relative to the actuator structure alters the cross-sectional area of the actuator passageway to place the first adjustment system in the at least one partially open configuration.

37. An aerosol dispensing system as recited in claim 34, in which the second adjustment system comprises an outlet member and a second adjustment member, where the actuator structure supports the outlet member and the second adjustment member such that movement of the second adjustment member relative to the outlet member alters an effective cross-sectional area of the conduit outlet.

38. An aerosol dispensing system as recited in claim 37, in which the second adjustment member deforms the outlet member to alter the effective cross-sectional area of the conduit outlet.

39. An aerosol dispensing system as recited in claim 38, in which the actuator structure defines a plurality of fingers that support the outlet member, where the second adjustment member deforms the fingers to deform the outlet member.

40. An aerosol dispensing system as recited in claim 37, in which the second adjustment member engages the outlet member such that the second adjustment member deforms the outlet member to alter the effective cross-sectional area of the conduit passageway between the conduit inlet and the conduit outlet.

* * * * *